US006692294B2

(12) United States Patent
Kobayashi

(10) Patent No.: US 6,692,294 B2
(45) Date of Patent: Feb. 17, 2004

(54) CONNECTOR

(75) Inventor: Yutaka Kobayashi, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 25 days.

(21) Appl. No.: 10/096,467

(22) Filed: Mar. 12, 2002

(65) Prior Publication Data

US 2002/0132518 A1 Sep. 19, 2002

(30) Foreign Application Priority Data

| | | |
|---|---|---|
| Mar. 15, 2001 | (JP) | 2001-074349 |
| Mar. 16, 2001 | (JP) | 2001-076583 |
| Mar. 16, 2001 | (JP) | 2001-076584 |
| Jun. 22, 2001 | (JP) | 2001-190115 |
| Jun. 22, 2001 | (JP) | 2001-190156 |

(51) Int. Cl.[7] ..... H01R 9/07
(52) U.S. Cl. ..... 439/496; 439/607
(58) Field of Search ..... 439/496, 495, 439/74, 497, 660, 493, 874, 579, 108, 607, 610

(56) References Cited

U.S. PATENT DOCUMENTS 5,049,090 A * 9/1991 Johnson ..... 439/493
5,194,020 A * 3/1993 Voltz ..... 439/579
6,135,829 A * 10/2000 Johnston ..... 439/874
6,264,500 B1 * 7/2001 Kawabe ..... 439/496

FOREIGN PATENT DOCUMENTS

| | | |
|---|---|---|
| JP | 3-59978 | 3/1991 |
| JP | 2000-77123 | 3/2000 |

* cited by examiner

*Primary Examiner*—Gary Paumen
*Assistant Examiner*—Phuongchi Nguyen
(74) *Attorney, Agent, or Firm*—Gerald E. Hespos; Anthony J. Casella

(57) ABSTRACT

A connector has a plug-side housing and a plurality of concave core holding grooves into which cores of shielded electric wires of a flat cable are inserted individually. The core holding grooves are deeper than the outer diameter of each core. The cores are inserted into the core wire-holding grooves. Thus even if the plug-side housing deforms, the cores remain accommodated in the core holding grooves. The housing also has a retainer-mounting opening into which a retainer can be mounted. The retainer retains each core by sandwiching the core between the retainer and the housing.

8 Claims, 50 Drawing Sheets

CONNECTOR

BACKGROUND OF THE INVENTION

1. Field of the Invention

The invention relates to a connector for a flat cable.

2. Description of the Related Art

A flat cable has a plurality of electric wires arranged parallel to one another. A connector is used to connect ends of the wires in the flat cable to other circuit components. One such connector is disclosed in Japanese Utility Model Application No. 1-132078 and also is shown in FIG. 54 herein. The connector of FIG. 54 includes a housing 1 with a groove 2 for receiving the flat cable. A holder 4 holds the terminal end of the flat cable in the groove 2 of the housing 1. More particularly, the flat cable includes a plurality of electric wires 5, each of which has a cover 5A and a core 5B. The covers 5A and cores 5B adjacent the end of the cable are sandwiched between the holder 4 and the housing 1 so that a front portion of the core 5B is exposed outwardly from the housing 1. The connector of FIG. 54 is used with a mating housing 6, as shown in FIG. 55. The mating housing 6 has terminal fittings 7 that elastically contact the front portions of the respective cores 5B. In this manner, the cores 5B and the mating terminal fittings 7 become electrically conductive with each other.

The above-described connector does not hold the front portion of the core 5B. Thus, the front portion of the core 5B can move up from the housing 1 and can be bent laterally. Accordingly, there is a possibility that the front portion of the core wire 5B will contact the terminal fitting 7 with insufficient pressure when the housing 1 and the mating housing 7 are connected. As a result, a reliable continuity connection cannot be obtained.

There is also the possibility that the resin of the housing 1 or the holder 4 may deform during cooling of the molded resin, after the resin is cooled or due to heat generated after the holder is mounted on the housing. Such deformation of the resin could cause a gap between the housing 1 and the holder 4. Accordingly, there is a fear that the small diameter cores 5B may move apart from the holding groove 2 and may penetrate into the gap between the housing 1 and the holder 4. Thus, adjacent cores 5B could contact each other.

Japanese Patent Application Laid-Open No.2000-77123 discloses a shielded connector for a flat cable. The shielded connector includes a plug-side connector mounted on the flat cable and a receptacle-side housing fixed to a circuit substrate. The plug-side connector has a housing, a plurality of terminal fittings fixed in the housing, and a shield mounted on and covering the housing. The flat cable has a plurality of shielded electric wires that have a shielding layer and a core. The core of each shielded electric wire of the flat cable is soldered to a terminal fitting, and the shielding layer of each shielded electric wire is connected to the shielded shell. The receptacle-side connector has a housing with terminal fittings and a ground. The plug-side connector fits on the receptacle-side connector to connect the terminal fittings of both connectors. The shielding shell and the ground also become conductive to each other.

The above-described conventional shielded connector has many component parts. It is possible to reduce the number of parts by bringing the cores and the receptacle-side terminal fittings into contact without the plug-side terminal fitting. However, the cores are flexible, and it is difficult to insert and position the flexible cores in the housing. Thus, mounting efficiency is low.

The cores could be disposed along the outer surface of the housing. However, the shielding shell interferes with the receptacle-side terminal fittings and the cores when they contact each other. Therefore, a notch must be formed on a region of the shielding shell that corresponds to the cores disposed on the outer surface of the housing. However, the notch does not display a shielding function and there is a fear that noise is generated.

Additionally the terminal fittings of the above-described shielded connector has the terminal fittings arranged parallel with one another on the front face of the receptacle-side housing, and shielding members are formed on the right and left surfaces of the receptacle side housing. Only the shielding members function for connecting the shielding shell and the circuit substrate to each other. Thus the shielding member has a small region corresponding to the plug-side housing. The number of portions for connecting the shielding members and the plug-side shielding shell to each other is small. Therefore there may be insufficient shielding.

The present invention has been made in view of the above-described situations. Accordingly, one object of the invention is to provide a connector capable of holding a front end of a core of a flat cable. Another object of the invention is to provide a connector that prevents movement of the cores of the wires of a flat cable. An additional object of the invention is to provide a connector for a flat cable that prevents adjacent cores from contacting each other. A further object of the invention is to provide efficient shielding for a connector for a flat cable.

SUMMARY OF THE INVENTION

The invention is directed to a connector with a housing made of synthetic resin. The connector is used with a flat cable that has a plurality of electric wires. Each wire has a conductive core and an insulation cover. The insulation cover is removed at the terminal end of each wire to expose the core.

The housing has an outer surface with cover disposing portion for receiving portions of the insulation covers of the wires near the exposed cores. The housing further comprises core holding means for holding the exposed cores so that the cores cannot move. The core holding means may comprise core holding grooves that are arranged parallel with one another on the outer surface of the housing. A depth of each core holding groove with respect to the outer surface of the housing may be larger than an outer diameter of each of the cores, and the cores may be disposed individually along rear the core holding grooves. Mating terminals can be inserted into the core holding grooves for connection to the individual cores.

A wiring path for the insulation covers of the wires held on the outer surface of the housing preferably is perpendicular with a wiring path for the cores held individually by the core holding means.

A core holder preferably is mounted on the housing so that front portions of the cores are sandwiched between the housing and the core holder. Thus it is possible to prevent the core from moving or curving. The core holder preferably is mounted on the housing for movement between a temporary locking position, where the cores can be inserted between the core holder and the housing, and a main locking position, where the cores are retained between the core holder and the housing. An assembling operation can be performed easily by delivering the housing to a flat cable-mounting site with the core holder in the temporary locking position. The core holder then is moved to the main locking position to retain the cores to the housing. As a result, the contact pressure between the mating terminal fitting and the cores is secure, and a reliable continuity connection is obtained.

Each electric wire may be shielded and may have a shielding layer formed on the outer periphery of the cover. The covers are held on the cover-disposing portion of the housing by a short-circuiting member fixed to the flat cable in a way to short-circuit the shielding layers of the shielded electric wires to each other and by a fixing means for fixing the short-circuiting member to the housing.

The short-circuiting member for short-circuiting the shielding layer of each of the electric wires may be fixed to the flat cable, and the cover holding means may comprise a locking piece that is integral with the housing and can be locked to the short-circuiting member. Because the cover holding means is integral with the housing, the cover of the shielded electric wire can be held without using a separate member. Therefore the number of component parts can be reduced.

Each core is inserted into the rear end of the core holding groove. As noted above, each core holding groove is wider than the outer diameter of the core. Thus even if the plug-side housing deforms, the core will not slip out of the core holding groove and remains accommodated therein. In other words, adjacent cores can be held reliably separately on the outer surface of the housing. Further, the shielded electric wire of the flat cable is disposed along the outer surface of the housing. Therefore the shielded electric wire can be positioned more easily than a construction in which it is inserted into an opening formed on the housing.

The electric wire of the subject connector preferably is disposed in an L-shape along the outer surface of the housing. Hence, it is possible to prevent the electric wire from slipping out of place in the axial direction of the wire.

According to the above-described construction, the core holding means holds the core in a movement-prevented state in the core holding groove. Thus the core can be connected reliably to the mating terminal that has been inserted into the core holding groove.

The short-circuiting member of the above-described connector serves the dual function of short-circuiting the shielding layers to each other and holding the covers of the electric wires on the cover-holding portion. Therefore fewer components parts are used in the present invention than in the case where the cover-holding means is separate from the short-circuiting member.

The invention also is directed to a shielded connector comprising a plug-side connector connected to a flat cable and a receptacle-side connector on a circuit substrate. The plug-side connector is constructed such that the core of each shielded electric wire of the flat cable is disposed along an outer surface of a plug-side housing. A plug-side shielding shell then is mounted on the plug-side housing and shielded layers of the shielded electric wire are connected to each other. The shielding shell can hold the core holder. Therefore, the shielding shell and core holder can be mounted on the housing at a time and at a site where the shielding shell and core holder are mounted on the housing. Therefore it is easy to perform the assembling work.

The receptacle-side connector has a receptacle-side housing fixed to the circuit substrate. The receptacle-side housing has receptacle-side terminal fittings connected to the circuit substrate and a ground that also is connected to the circuit substrate. The plug-side connector can be fit on the receptacle-side connector to connect the core to the receptacle-side terminal fitting, and to connect the plug-side shielding shell to the ground.

The receptacle-side connector has a receptacle-side shielding shell that corresponds to a core holding region on the outer surface of the plug-side housing. The receptacle-side shielding shell is connected to the plug-side shielding shell when the connectors are fitted on each other.

The receptacle-side shielding shell and the ground preferably are integral with each other.

The receptacle-side shielding shell may have right and left side walls and a rear wall that correspond to right and left side walls and a rear wall of the plug-side housing respectively. The receptacle-side shielding shell may further have a connection portion connected to the plug-side shielding shell and formed on each of the right and left side walls and the rear wall thereof.

According to the above-described construction, the receptacle-side shielding shell corresponds to the rear surface of the plug-side housing as well as the right and left side surfaces thereof. Thus improved shielding effect can be obtained. The portions of connection between the receptacle-side shielding shell and the plug-side shielding shell are formed not only on the right and left side surfaces thereof but also on the rear surface. Thus a large number of connection portions are formed on the receptacle-side shielding shell and the plug-side shielding shell. Hence, improvement of the shielding effect can be achieved.

The receptacle-side housing preferably has a tubular fit-on portion that can accommodate the plug-side housing. The receptacle-side terminal fitting is disposed inside the tubular fit-on portion, and the receptacle-side shielding shell is disposed outside the tubular fit-on portion.

The receptacle-side shielding shell may have an inwardly projecting slip-off prevention locking piece. The receptacle-side housing may have an erroneous fit-on prevention projection that projects in from an inner surface of the fit-on tubular portion and a locking space formed therein. The receptacle-side shielding shell is placed in a slip-off prevention state by accommodating the locking piece in the locking space and by engaging the locking piece with an inner wall of the locking space. The receptacle-side shielding shell has the slip-off prevention slip-off prevention locking piece projecting inward from the rear wall thereof. Thus it is possible to prevent the receptacle-side housing from becoming large. Additionally, the erroneous fit-on preventing projection prevents the plug-side housing from fitting on the receptacle-side housing with the plug-side housing disposed in an improper direction.

The plug-side shielding shell preferably has an elastic contact spaced from the outer surface of the plug-side housing on which the cores are disposed. The elastic contact engages the outer surface of the receptacle-side shielding shell elastically, when the receptacle-side connector and the plug-side connector are fitted on each other.

The receptacle-side shielding shell of the above-described shielding connector is conductive to the plug-side shielding shell and confronts the core disposing region of the outer surface of the plug-side housing when the connectors have been fit on each other. Thus the receptacle-side shielding shell and the plug-side shielding shell surround the cores and the receptacle-side terminal fitting to display a high shielding function.

The ground and the receptacle-side shielding shell of the above-described shielding connector are integral with each other. Thus, fewer components parts are used, as compared to the case where the ground and the receptacle-side shielding shell are separate.

The plug-side housing of the above-described shielding connector and the cores on the outer surface of the plug-side housing are accommodated in the tubular fit-on portion of the receptacle-side housing. Thus the cores are not exposed. Further, the wall of the tubular fit-on portion partitions the receptacle-side shielding shell from both the receptacle-side terminal fitting and the cores. Thus, there is no fear that the receptacle-side shielding shell contacts the receptacle-side terminal fitting or the cores.

The receptacle-side shielding shell of the above described shielding connector is sandwiched elastically between the elastic contact portion of the plug-side shielding shell and the tubular fit-on portion. Therefore, the plug-side shielding shell and the receptacle-side shielding shell can be connected reliably to each other at a predetermined contact pressure. Further, the elastic contact is spaced from the outer surface of the plug-side housing on which the cores are disposed. Hence, there is no fear that the elastic contact portion interferes with the cores.

DETAILED DESCRIPTION OF THE PREFERRED EMBODIMENTS

The first embodiment of the invention will be described below with reference to FIGS. 1 through 24.

A shielded connector is used to connect a flat cable 80 to a circuit substrate 90. The shielded connector has a plug-side connector P that is connected to the flat cable 80 and a receptacle-side connector R that is provided on the circuit substrate 90. The receptacle-side connector R is configured to fit on the plug-side connector P.

Figure 1:
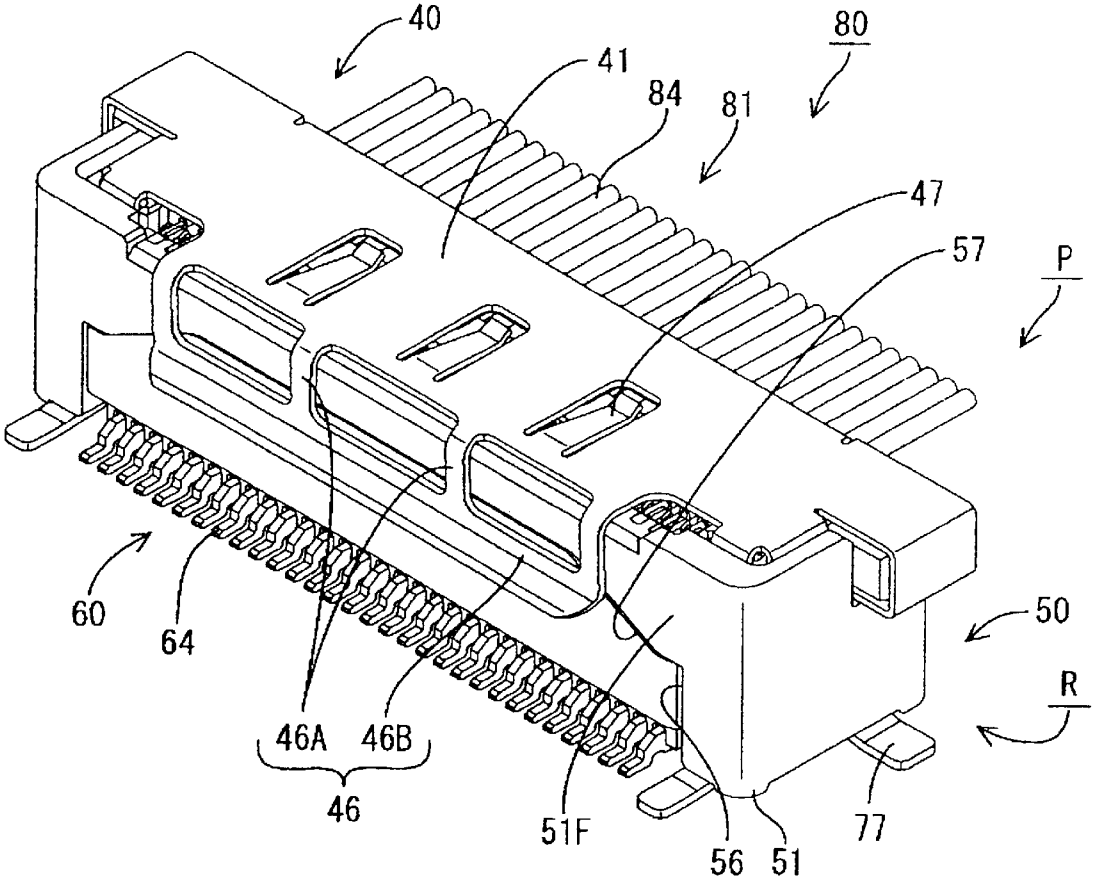
FIG. 1 is a perspective view showing a state in which both connectors have fitted on each other in a first embodiment.
Figure 2:
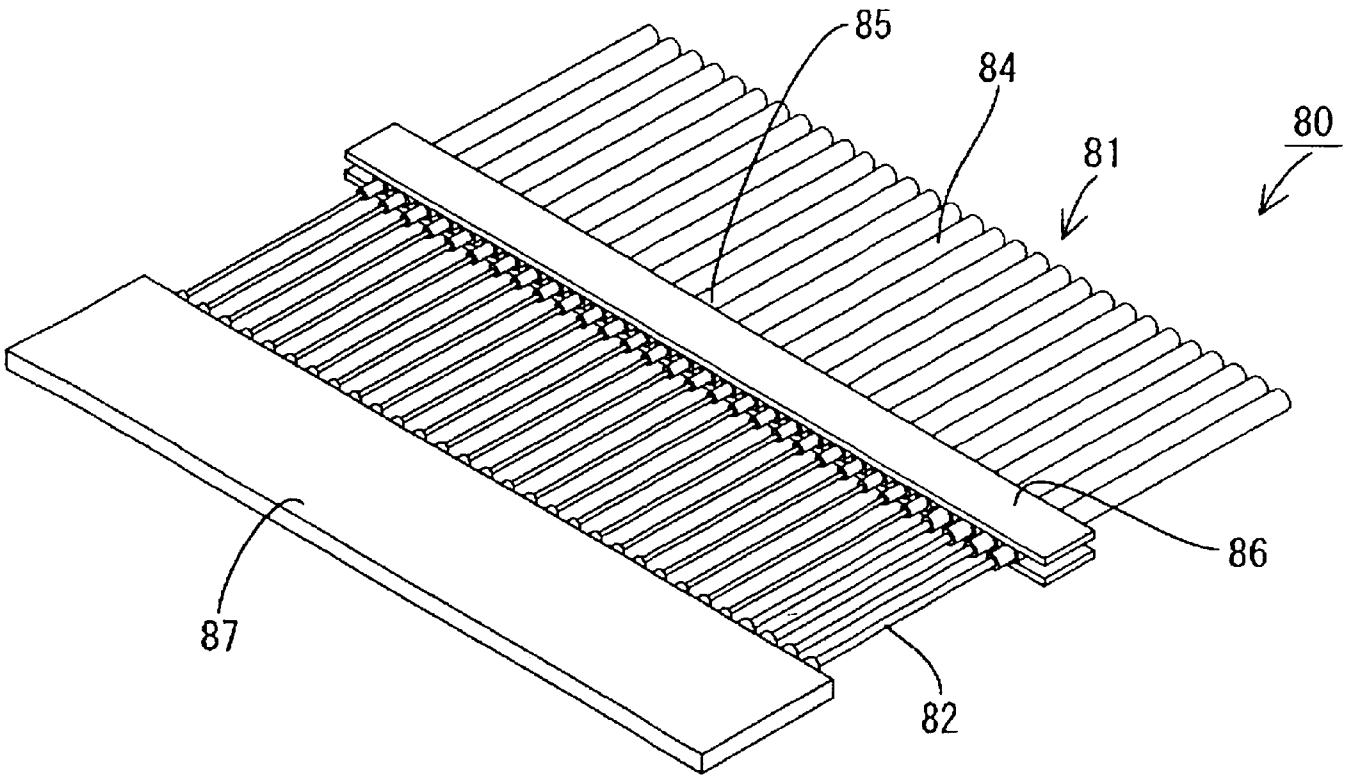
FIG. 2 is a perspective view of a flat cable.
Figure 3:
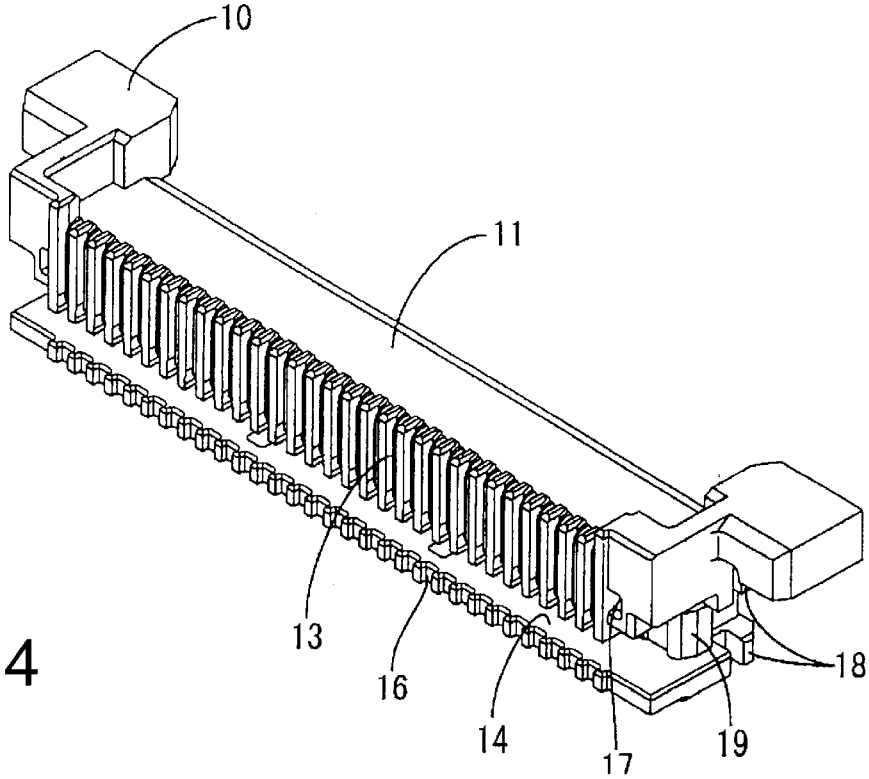
FIG. 3 is a perspective view of a plug-side housing.
Figure 16:
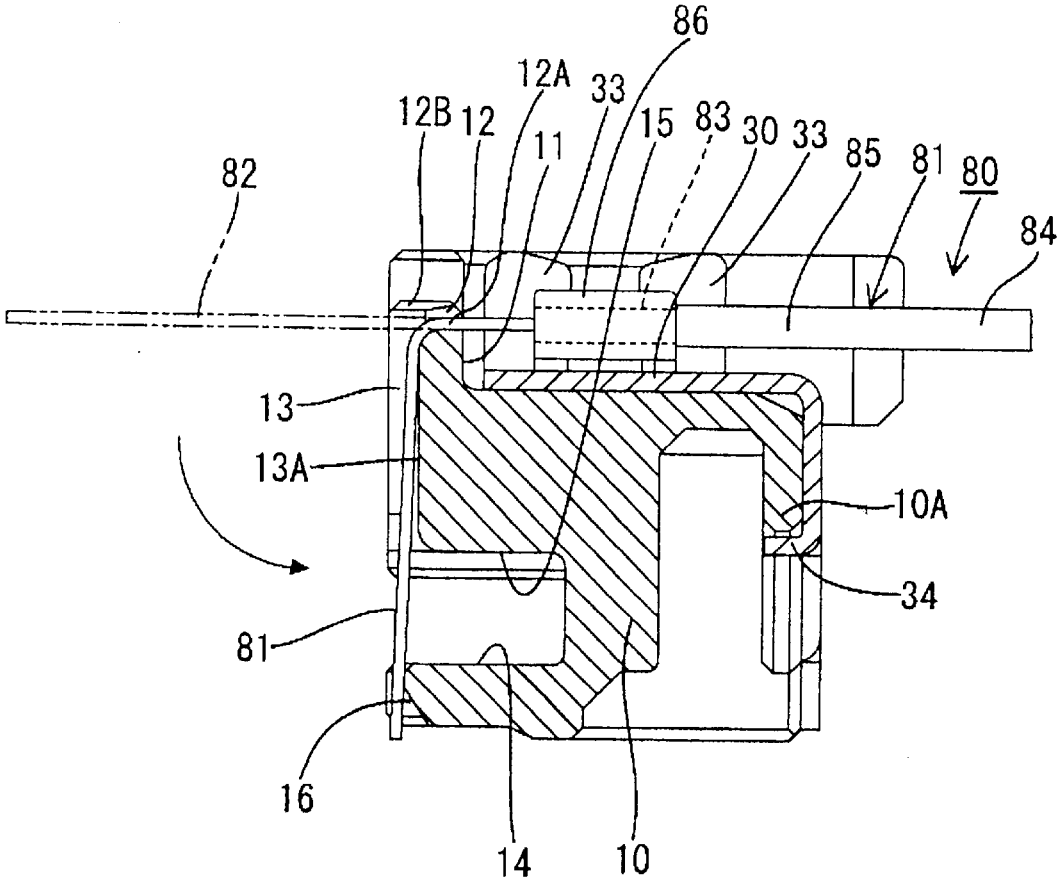
FIG. 16 is a sectional view showing a state in which the fixing plate and the flat cable have been mounted on the plug-side housing.
Figure 17:
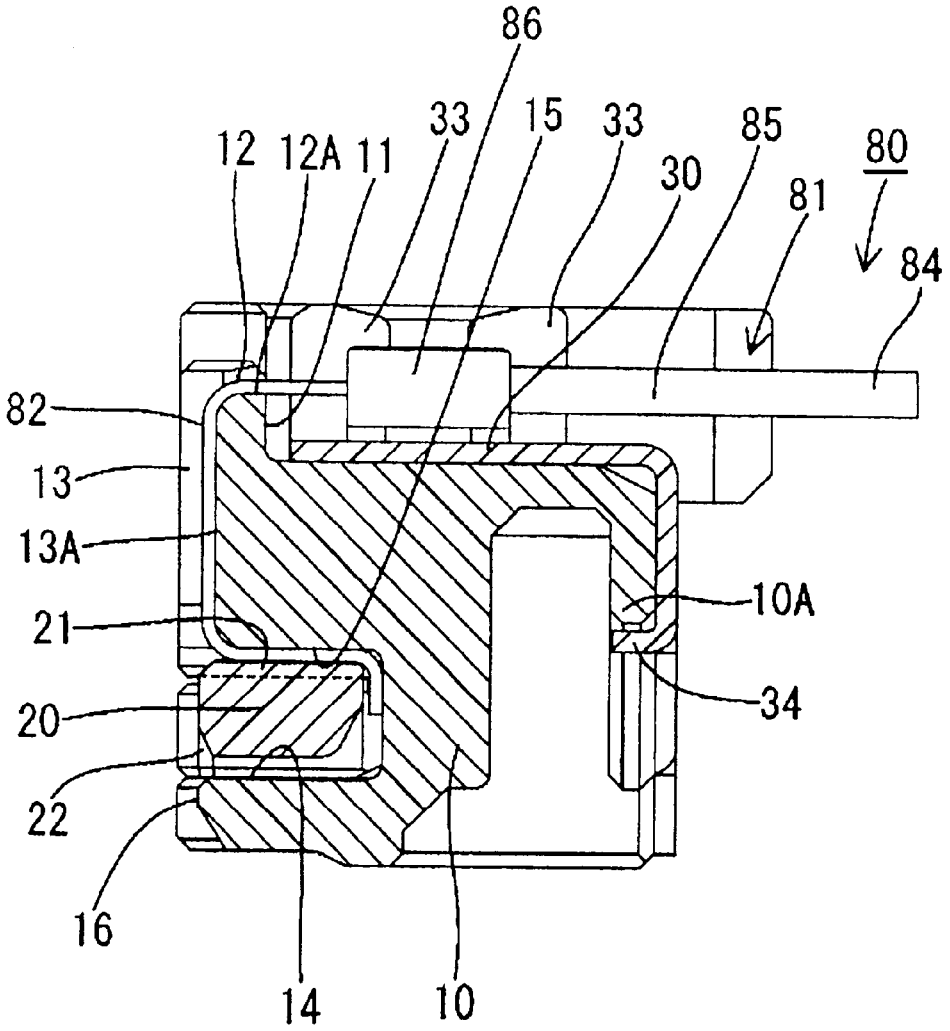
FIG. 17 is a sectional view showing a state in which the retainer has been mounted on the plug-side housing placed in the state shown in FIG. 16.
Figure 18:
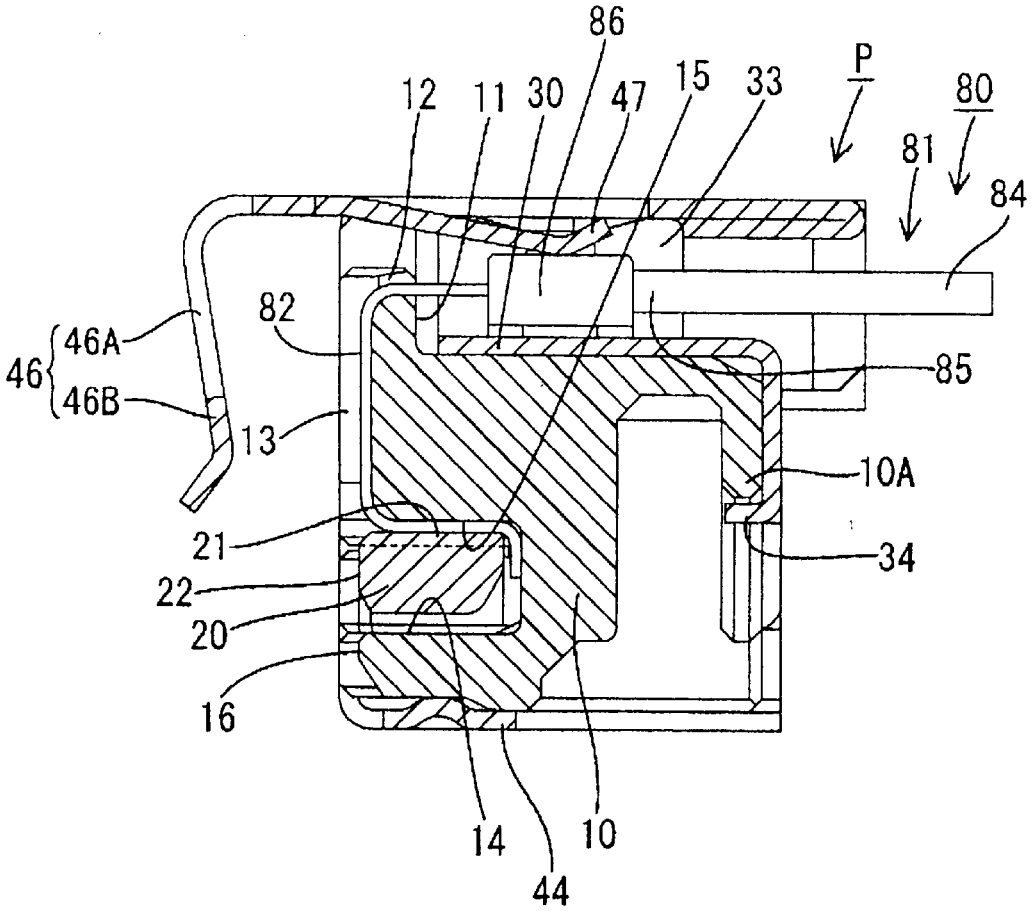
FIG. 18 is a sectional view showing a state in which the plug-side shielding shell has been mounted on the plug-side housing placed in the state shown in FIG. 17 to complete assembling of the plug-side connector.
Figure 19:
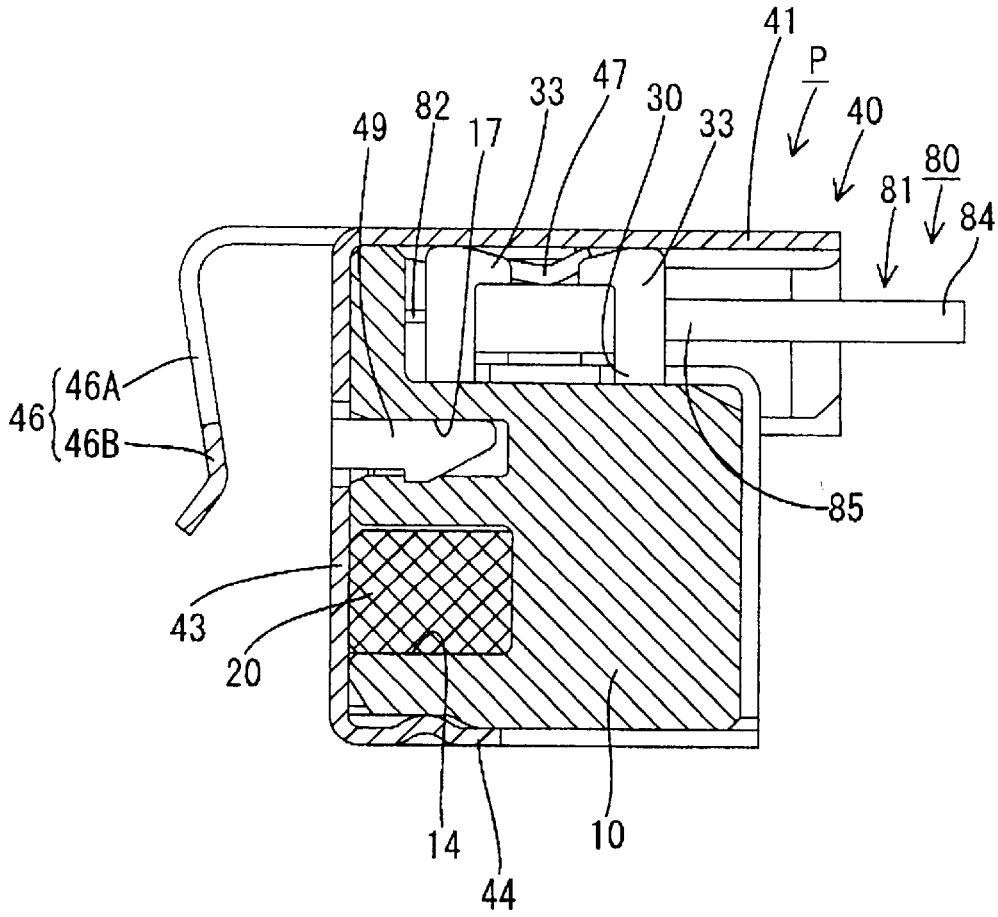
FIG. 19 is a sectional view showing a means for preventing separation of the plug-side shielding shell from the plug-side housing.
Figure 20:
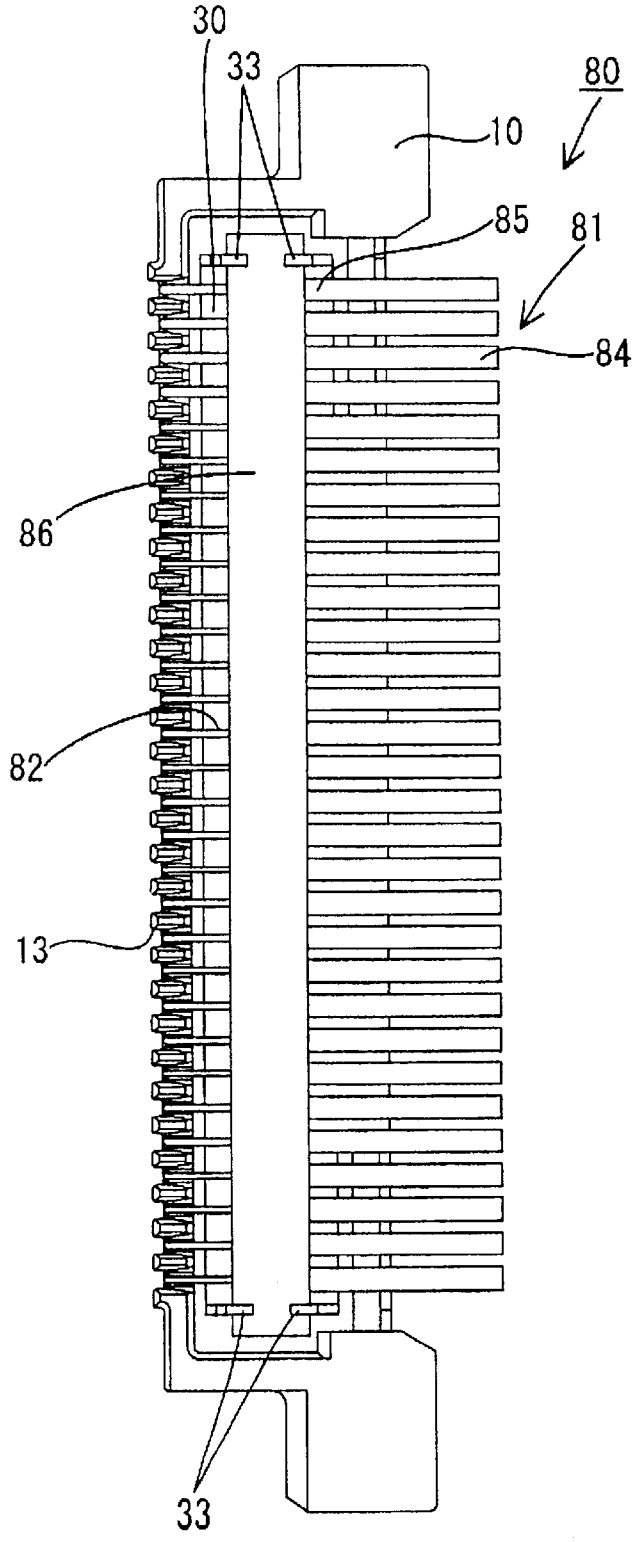
FIG. 20 is a plan view showing a state in which the fixing plate and the flat cable have been mounted on the plug-side housing.

The flat cable 80 includes a plurality of shielded electric wires 81 arranged parallel with one another at predetermined pitches. Each shielded electric wire 81 includes an electrically conductive core 82, a shielding layer 83 that surrounds the core 82, and a cover 84 that covers the shielding layer 83, as shown in FIG. 16. An electrically conductive short-circuiting member 86 is fixed to the end of the flat cable 80. The short-circuiting member 86 is long and narrow in a direction transverse to the wires 81, and closely contacts the shielding layers 83 of the shielded electric wires 81 to hold the parallel wires 81 at predetermined pitches. The flat cable 80 has the covers 84 removed at the side of each shielded electric wire 81 forward from the short-circuiting member 86, to expose the cores 82. The flat cable 80 has a covering portion 85 at the side rearward from the short-circuiting member 86. The cores 82 are connected to a connection member 87, as shown in FIG. 2, to keep a predetermined pitch between the adjacent cores 82 before the cores 82 of the flat cable 80 are mounted on the plug-side connector P.

The plug-side connector P has a plug-side housing 10, a retainer 20 made of synthetic resin, a fixing plate 30, and plug-side shielding shell 40.

Figure 21:
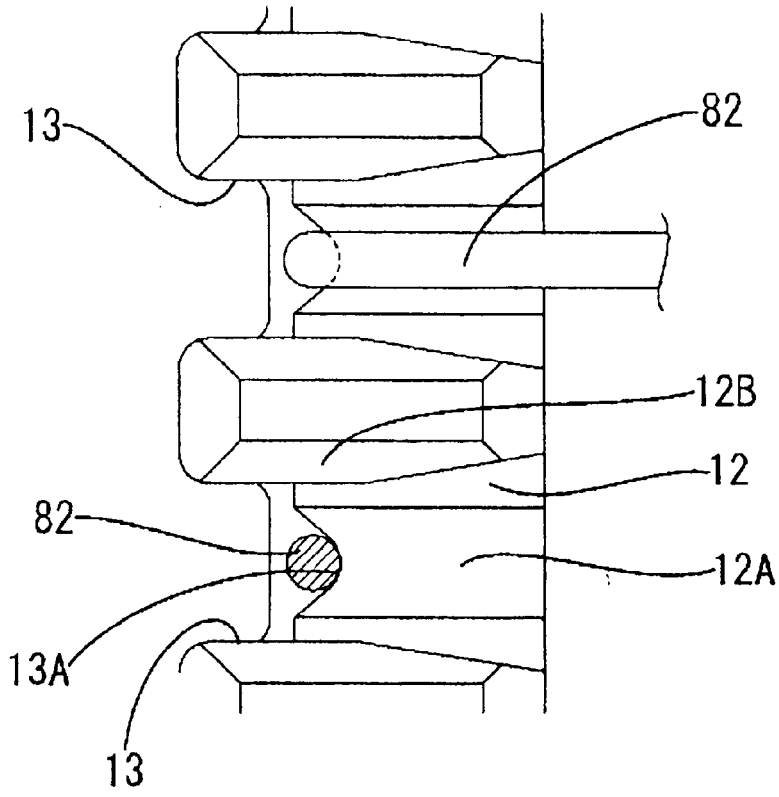
FIG. 21 is a partly enlarged plan view showing a core wire guide groove and a core wire-holding groove.
Figure 22:
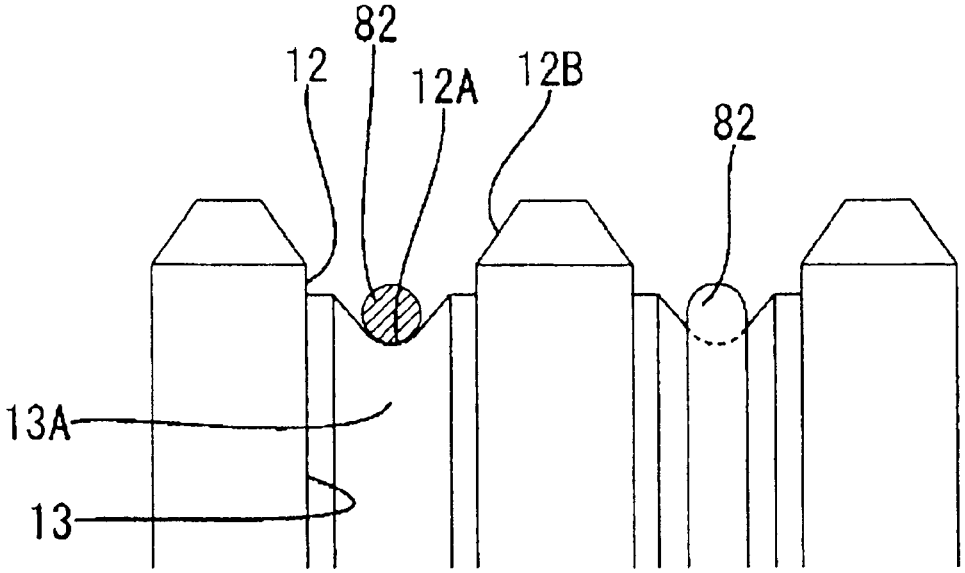
FIG. 22 is a partly enlarged plan view showing the core wire guide groove and the core wire-holding groove.
Figure 23:
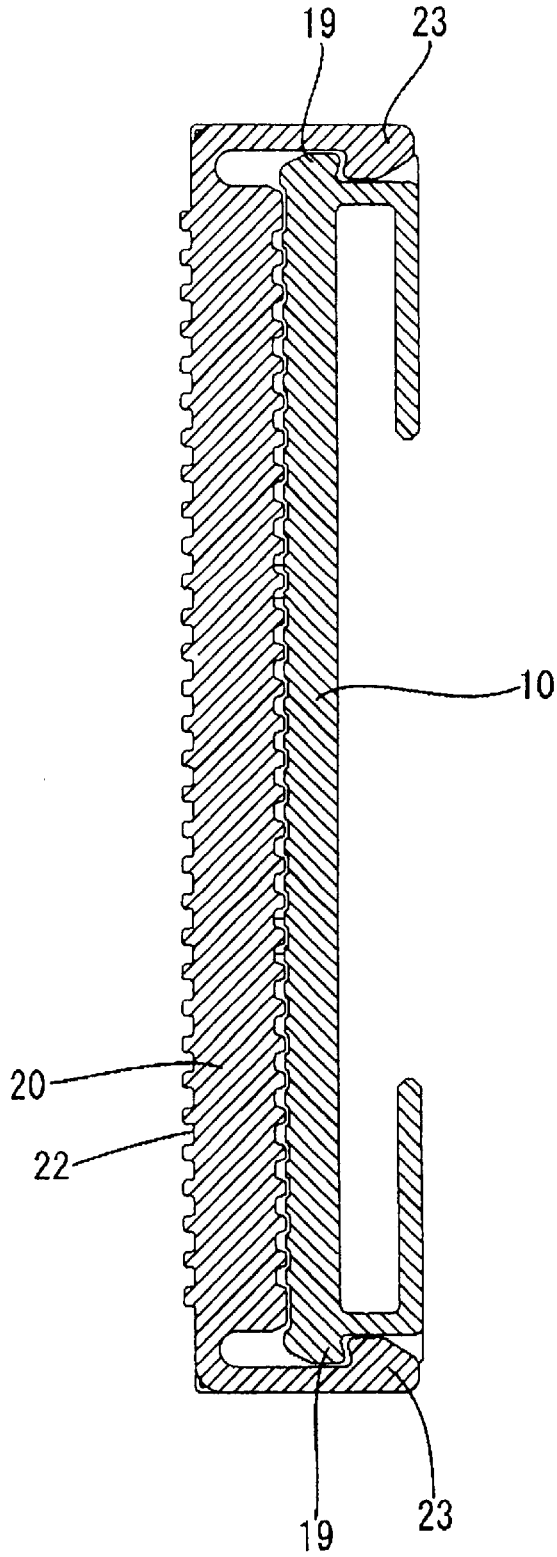
FIG. 23 is a horizontal sectional view showing a means for preventing separation of the retainer from the plug-side housing.

The plug-side housing 10 is a long narrow block with a longitudinal direction aligned transverse to the longitudinal direction of the cable 80. A cover-disposing portion 11 is formed on the upper surface of the plug-side housing 10, and defines a shallow recess with a rear end that is open toward the rear end surface of the plug-side housing 10. Core guide grooves 12 extend in a front-to-back direction on the front end of the upper surface of the plug-side housing 10 and their rear ends communicate with the cover-disposing portion 11. The core guide grooves 12 are parallel with each other at predetermined pitches in a right-to-left direction, which is transverse to the longitudinal direction of the cable 80. The width of each core guide groove 12 increases upward to form a tapered guide inclined surface 12B, as shown in FIG. 21. A semicircular positioning groove 12A is formed at the bottom of the core guide groove 12. The depth of each core guide groove 12, as measured from the upper surface of the plug-side housing 10 to the bottom of the core guide groove 12 in the vertical direction of the plug-side housing 10, exceeds the outer diameter of the core 82. The smallest width of the core groove 12 also exceeds the outer diameter of the core 82.

Core holding grooves 13 extend vertically on the front surface of the plug-side housing 10 and have upper ends that communicate with the core guide grooves 12. The core holding grooves 13 are at the same equal pitches as the core guide grooves 12. A semi-circular positioning groove 13A is formed on the bottom of each core holding groove 13 and communicates with the positioning groove 12A of the corresponding core guide groove 12. The depth of the core holding groove 13, as measured from the front surface of the plug-side housing 10 to the rear end of the core wire-holding groove 13 in a front-to-back direction of the plug-side housing 10, exceeds the outer diameter of the core 82. The width of the core holding groove 13 in the left-to-right direction is equal to the width of the core guide groove 12, and hence is larger than the outer diameter of the core 82.

A retainer-mounting cavity 14 is formed on the front surface of the plug-side housing 10 for fitting the retainer 20 on the plug-side housing 10. Core fixing grooves 15 are formed on the ceiling surface of the retainer-mounting cavity 14 and are perpendicularly continuous with the lower ends of the respective core holding grooves 13. Lower terminal guide grooves 16 are immediately below the core holding grooves 13 on the lower end of the front surface of the plug-side housing 10 and at the same equal pitches as the core holding grooves 13. Press-fit holes 17 are formed at right and left ends of the front surface of the plug-side housing 10. Upper and lower fixing plate-mounting locking projections 18 are formed at each of right and left ends of the plug-side housing 10, and a locking projection 19 is formed between the upper and lower locking projections 18 for preventing separation of the retainer 20 from the plug-side housing 10.

The retainer 20 is made of an insulating synthetic resin and is long and narrow in a right-to-left direction. The retainer 20 is mounted on the retainer-mounting cavity 14 of the plug-side housing 10 from the front. The upper surface of the retainer 20 has core fixing projections 21 that correspond linearly to the core wire-fixing grooves 15 of the retainer-mounting cavity 14. Upper terminal guide grooves 22 are formed on the front surface of the retainer 20 and correspond to the core holding grooves 13 and the lower terminal guide grooves 16 of the plug-side housing 10. Cantilevered arms 23 extend rearward at the right and left ends of the retainer 20.

The fixing plate 30 is made of metal and closely contacts the bottom surface of the cover-disposing portion 11. Right and left elastic supporting pieces 31 are formed in regions of the fixing plate 30 that closely contact the cover-disposing portion 11. The elastic supporting pieces 31 are cantilevered and inclined sideways and upward by cutting and raising a portion of the fixing plate 30. Upper and lower claws 32 and front and rear elastic supporting pieces 33 are formed at each of right and left ends of the fixing plate 30. The fixing plate 30 also has an approximately L-shaped locking claw 34 extending down from the rear end thereof.

The plug-side shielding shell 40 is formed by bending a metal plate and includes an upper wall 41 that covers the upper surface of the plug-side housing 10 where the covering portion 85 of the flat cable 80 is disposed. The plug-side shielding shell 40 further includes right and left side walls 42 that cover the right and left side surfaces of the plug-side housing 10 respectively. A vertical portion 43 extends perpendicularly down from each of right and left ends of the front edge of the upper wall 41, and a connection edge 44, which is long and narrow in the right-to-left direction of the plug-side shielding shell 40, connects the lower ends of both vertical portions 43 to each other. A lower edge 45 extends rearward from each of right and left ends of the connection edge 44.

The upper wall 41 has a plurality of elastic pressing pieces 47 arranged in the right-to-left direction of the plug-side shielding shell 40. The elastic pressing pieces 47 are cantilevered and inclined downward and rearward by cutting and deforming a portion of the upper wall 41. The upper wall 41 has an elastic contact portion 46 that extends down from the front edge thereof. The elastic contact portion 46 includes a plurality of long, narrow elastically deformable pieces 46A that extend down from the front edge of the upper wall 41 at intervals in the right-to-left direction of the plug-side shielding shell 40. The elastic contact portion 46 further has a connection portion 46B that is long and narrow in the right-to-left direction of the plug-side shielding shell 40 and that connects the lower ends of the elastically deformable pieces 46A to each other. The elastically deformable pieces 46A and the connection portion 46B effectively form the elastic contact portion 46 into the shape of a frame that has large windows therein. The elastic contact portion 46 is mounted on the plug-side housing 10 in a position spaced forward from the front surface where the cores 82 of the shielded electric wire 81 are disposed. Thus the elastic contact portion 46 does not display a shielding function for the front surface of the plug-side housing 10.

The side wall 42 has an upper side wall 42A that extends down from a side edge of the upper wall 41 and a lower side wall 42B erect from the lower edge 45. Guidable portions 48 extend horizontally in from the lower edge of the upper side wall 42A and the upper edge of the lower side wall 42B such that the guidable portions 48 overlap each other vertically. A press-fit piece 49 is cantilevered rearward from the right and left vertical portions 43.

The receptacle-side connector R includes a receptacle-side housing 50, a plurality of receptacle-side terminal fittings 60, and a grounding member 70.

Figure 24:
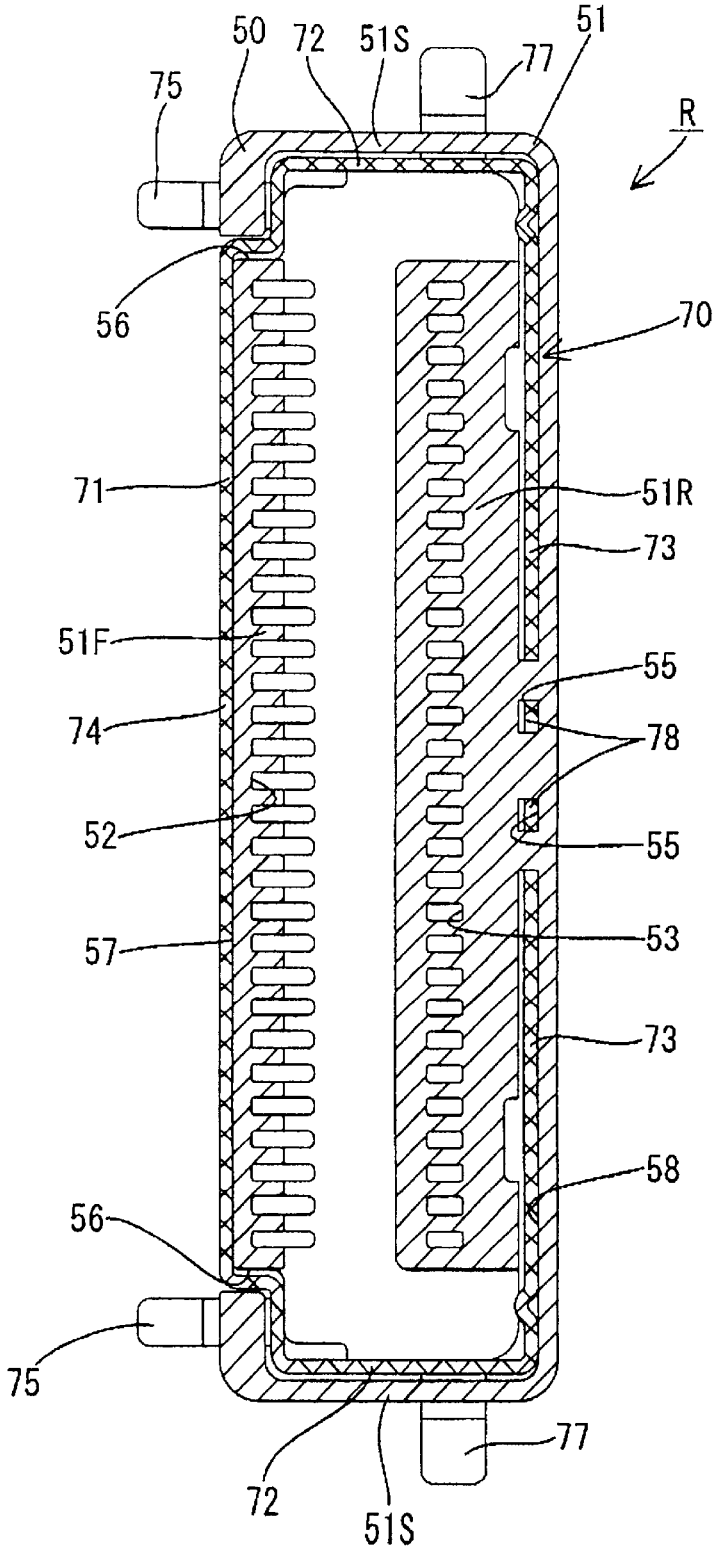
FIG. 24 is a horizontal sectional view showing the receptacle-side connector.

The receptacle-side housing 50 is made of an insulating resin and has a tubular fit-on portion 51 open on its upper surface. The receptacle-side housing 50 is fixed to the upper surface of the circuit substrate 90. Parallel terminal-positioning grooves 52 are formed on the inner surface of a front wall 51F of the tubular fit-on portion 51 of the receptacle-side housing 50. The terminal-positioning grooves 52 are arranged in the right-to-left direction of the receptacle-side housing 50, and are at pitches that equal the pitches of the cores 82 of the plug-side connector P. Terminal-mounting holes 53 are formed on the inner surface of a rear wall 51R of the tubular fit-on portion 51, and are arranged at pitches that equal the pitches of the terminal-positioning grooves 52. Terminal-escaping grooves 54 are formed on the bottom surface of the receptacle-side housing 50 and communicate with both the terminal-positioning grooves 52 and the terminal-mounting holes 53. A shell-mounting hole 55 is formed on the rear wall 51R of the tubular fit-on portion 51, as shown in FIG. 24, and opens on the bottom surface of the receptacle-side housing 50. Shell escaping grooves 56 open on the bottom surface of the receptacle-side housing 50 at right and left ends of the front wall 51F of the tubular fit-on portion 51 and provide communication between inner and outer surfaces of the front wall 51F. A shell accommodation portion 57 is formed on the outer surface of the front wall 51F of the tubular fit-on portion 51 by forming a shallow recess in the outer surface of the front wall 51F.

Figure 13:
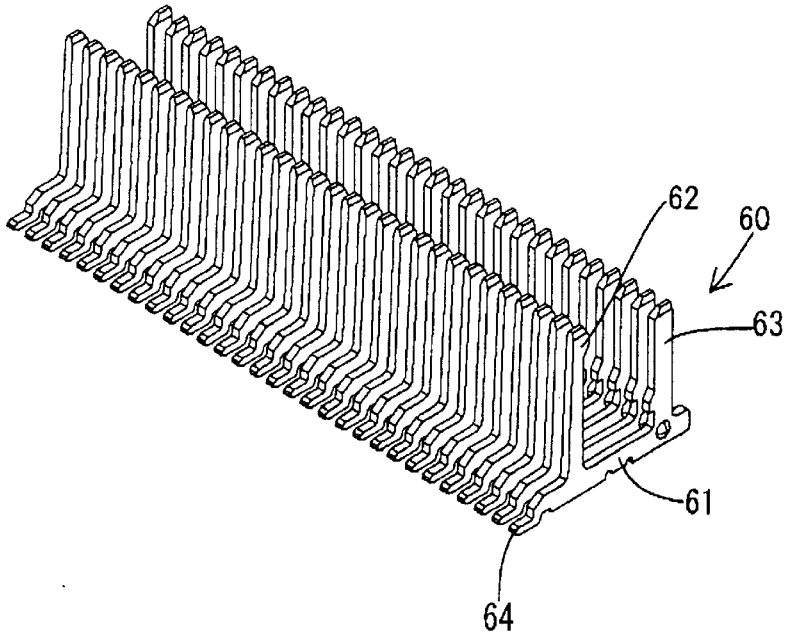
FIG. 13 is a perspective view showing a state in which a plurality of receptacle-side terminal fittings are arranged.
Figure 14:
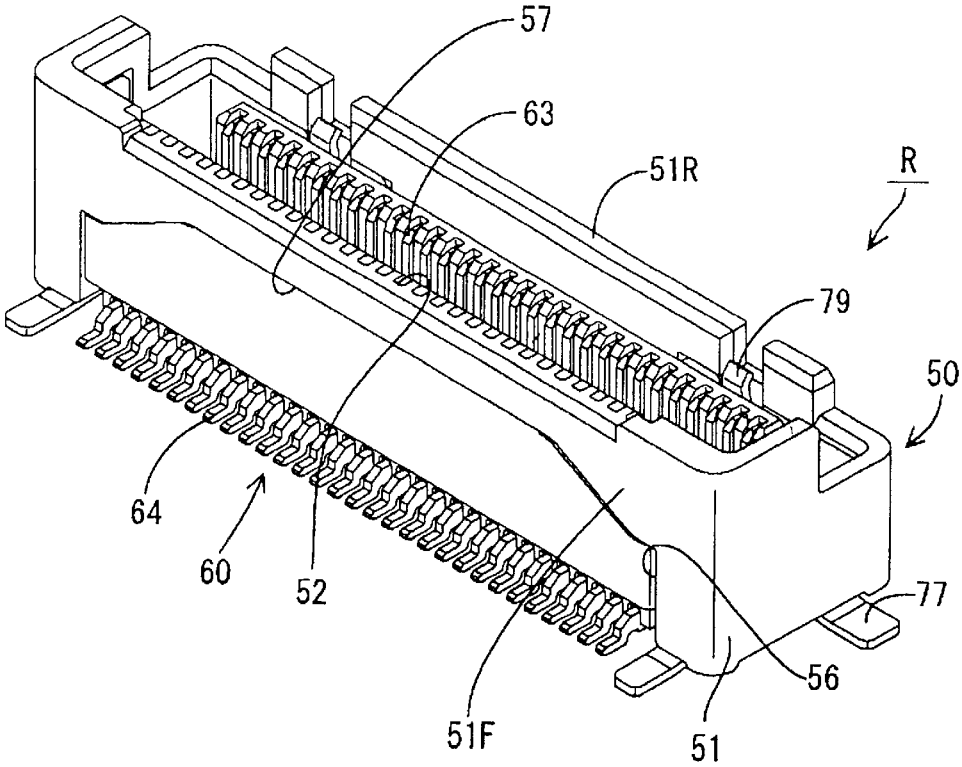
FIG. 14 is a perspective view showing an assembled state of a receptacle-side connector.
Figure 15:
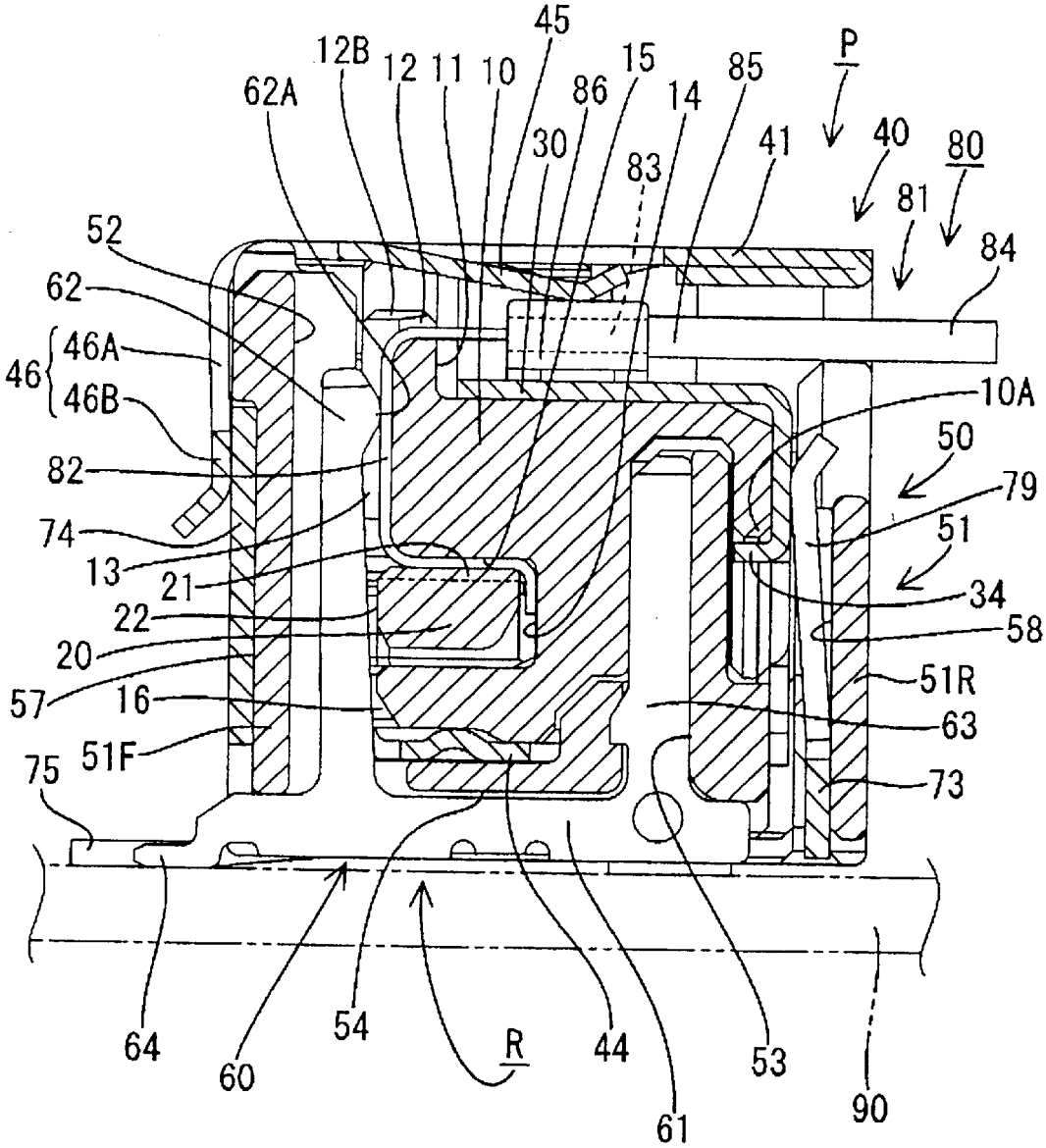
FIG. 15 is a sectional view showing a state in which both connectors have been fitted on each other.

Each receptacle-side terminal fitting 60 includes a base 61 that is long and narrow in the front-to-back direction, as shown in FIG. 13. The base 61 is dimensioned to fit in the terminal-escaping groove 54 of the receptacle-side housing 50. An elastic contact piece 62 extends erect from a position near the front end of the base 61, and a mounting portion 63 extends erect from the rear end of the base 61. Substrate connections 64 of the base 61 are connected to contacts (not shown) of the circuit substrate 90.

The grounding member 70 is formed by bending a metal plate and makes the plug-side shielding shell 40 of the plug-side connector P conductive to a ground contact (not shown) of the circuit substrate 90. The grounding member 70 has a front plate 71 and side plates 72 that extend from right and left ends of the front plate 71. A mounting plate 73 extends inward from the rear end of each side plate 72. The front plate 71 of the grounding member 70 is disposed to cover the front surface of the plug-side housing 10 and the cores 82 disposed thereon, when the connectors P and R are fitted on each other. Thus the front plate 71 serves as a receptacle-side shielding shell 74 and displays a shielding function. Substrate connections 75 extend forward from the lower end of each of right and left ends of the front plate 71 of the grounding member 70.

A portion of each side plate 72 is cut and raised to form cantilevered elastic contact pieces 76 that incline down and in. A substrate connection portion 77 extends forward from the lower end of the side plate 72, and press-fit pieces 78 project up from extended ends of the mounting plate 73. Portions of the mounting plate 73 are cut and raised to form forwardly extending cantilevered elastic contact pieces 79.

Figure 7:
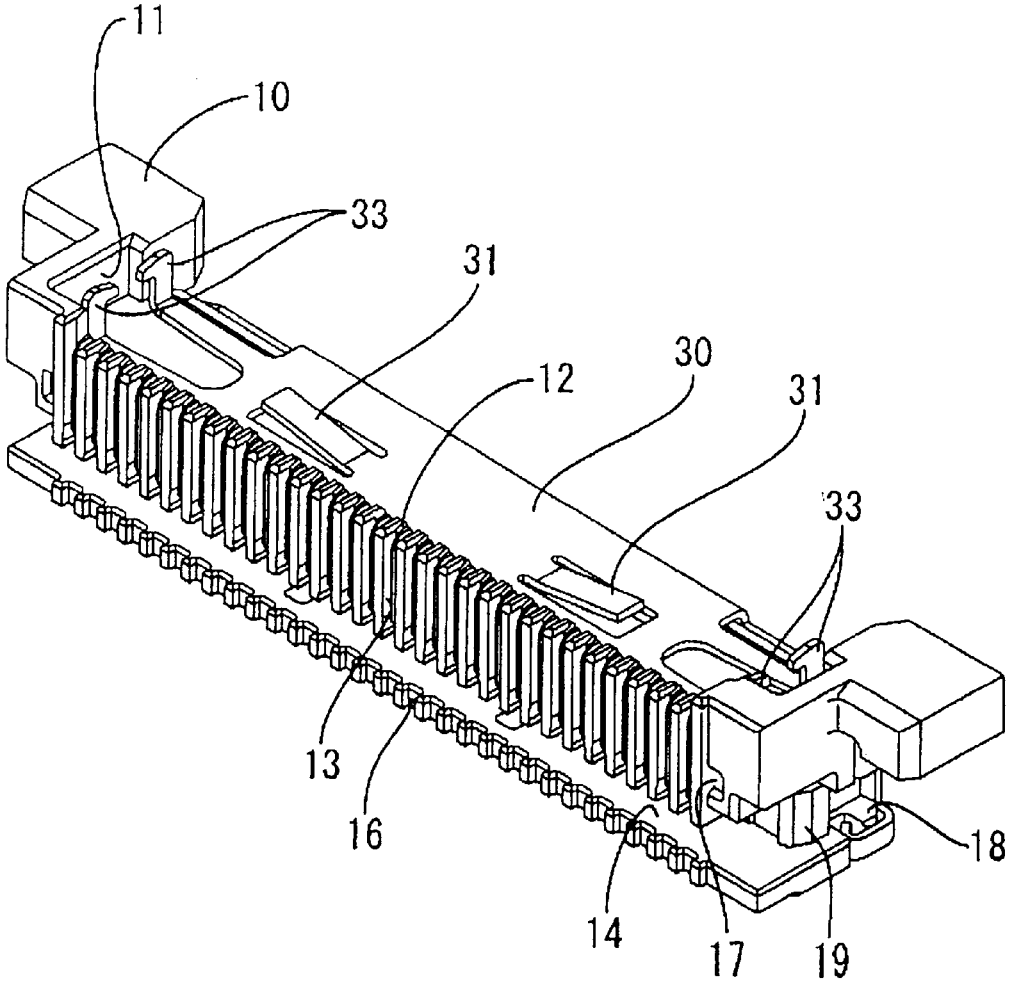
FIG. 7 is a perspective view showing a state in which the fixing plate has been mounted on the plug-side housing.
Figure 8:
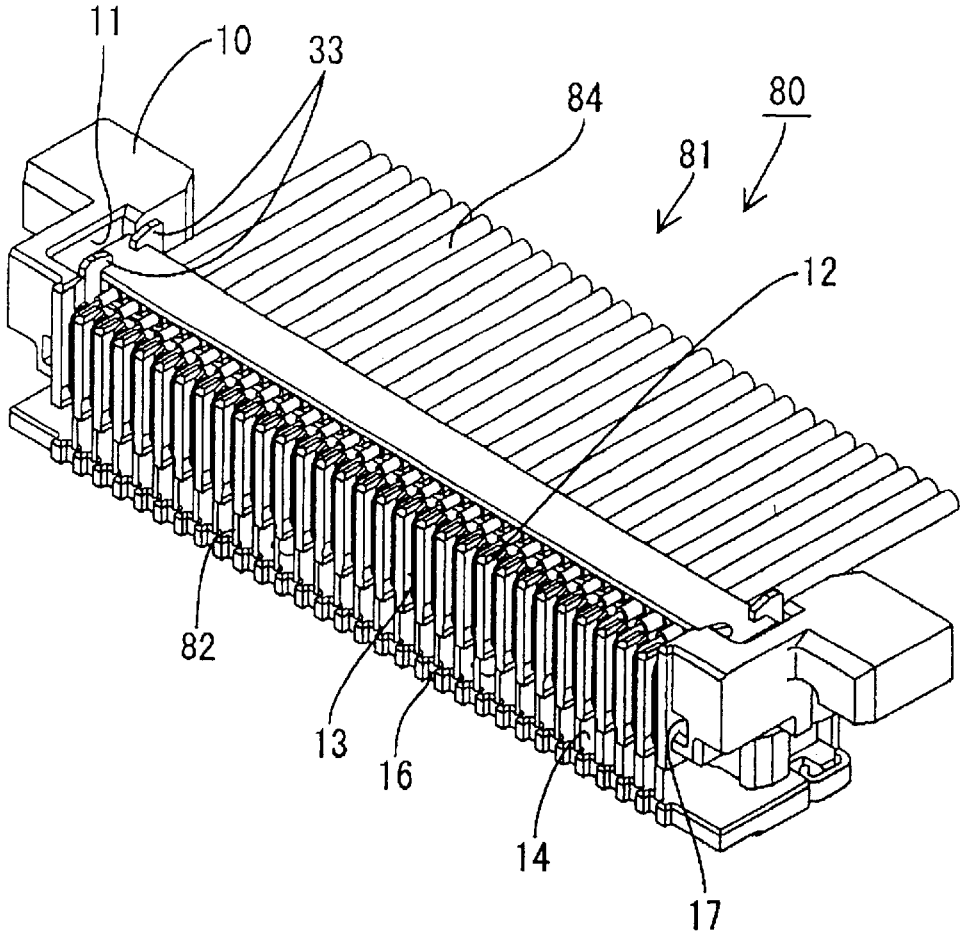
FIG. 8 is a perspective view showing a state in which the flat cable has been mounted on the plug-side housing placed in the state shown in FIG. 7.
Figure 9:
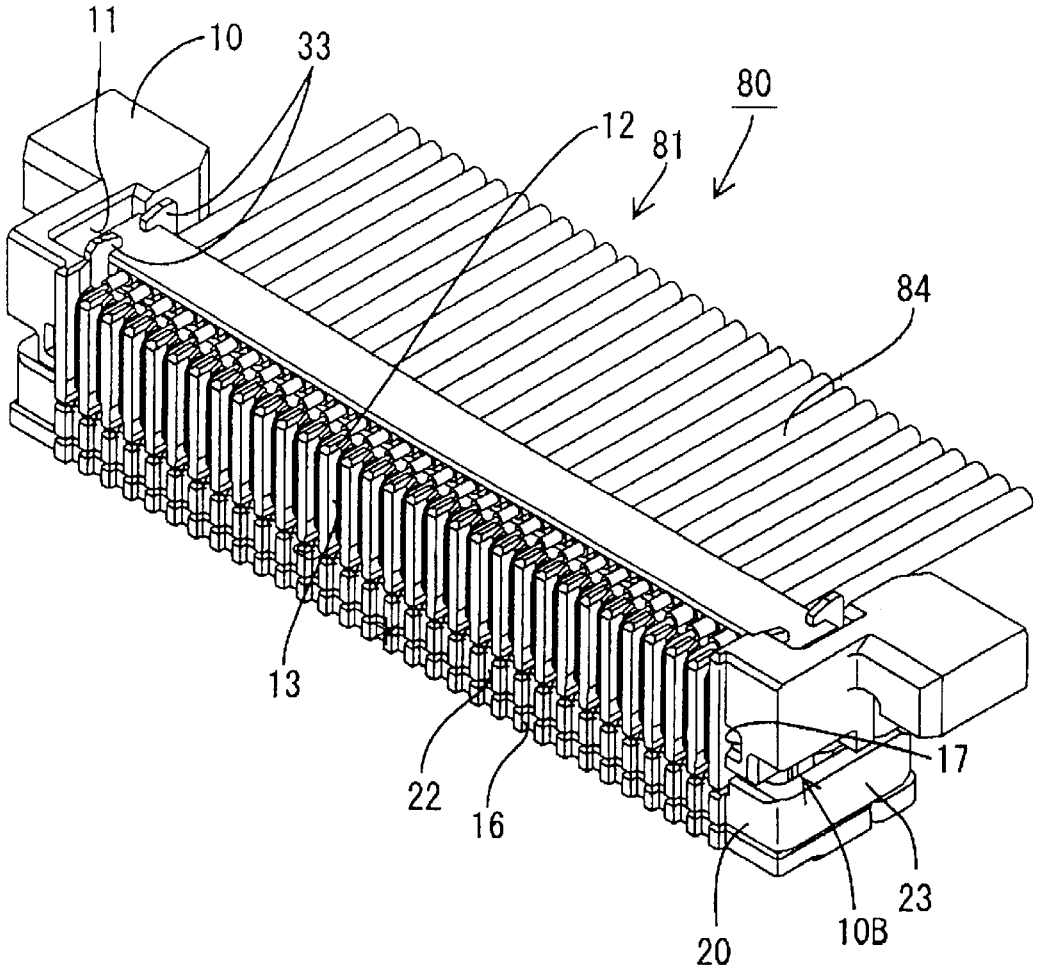
FIG. 9 is a perspective view showing a state in which the retainer has been mounted on the plug-side housing placed in the state shown in FIG. 8.
Figure 10:
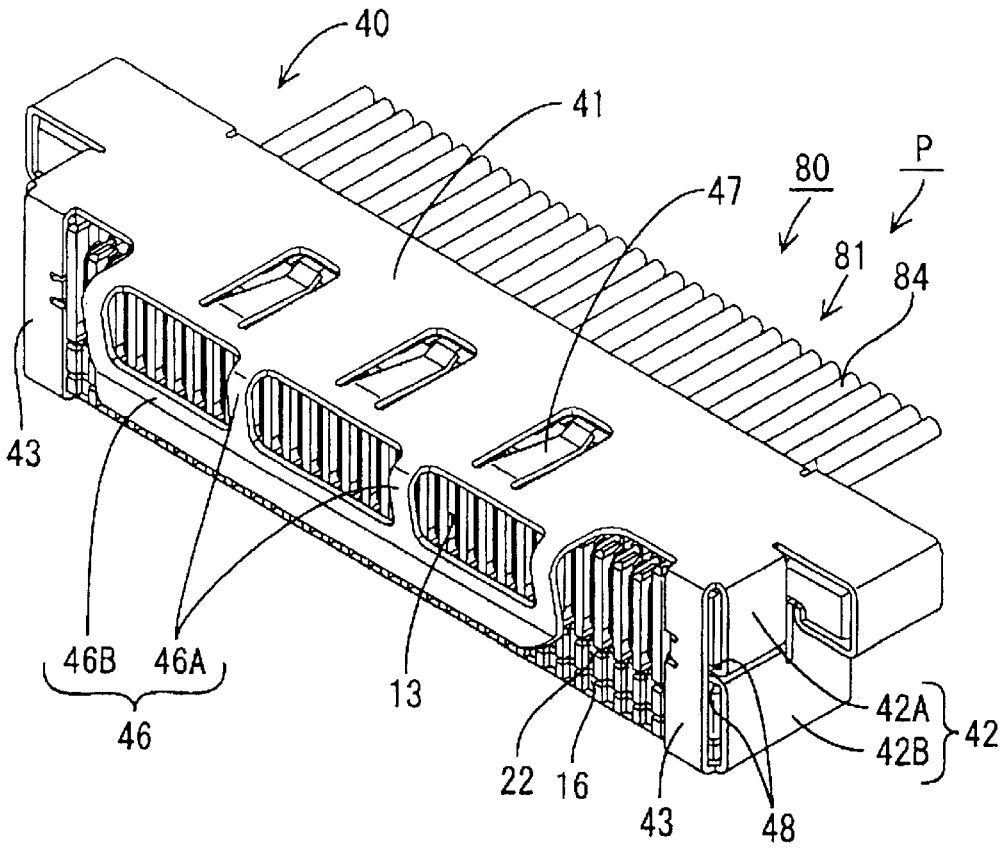
FIG. 10 is a perspective view showing a state in which the plug-side shielding shell has been mounted on the plug-side housing placed in the state shown in FIG. 9 to complete assembling of the plug-side connector.
Figure 11:
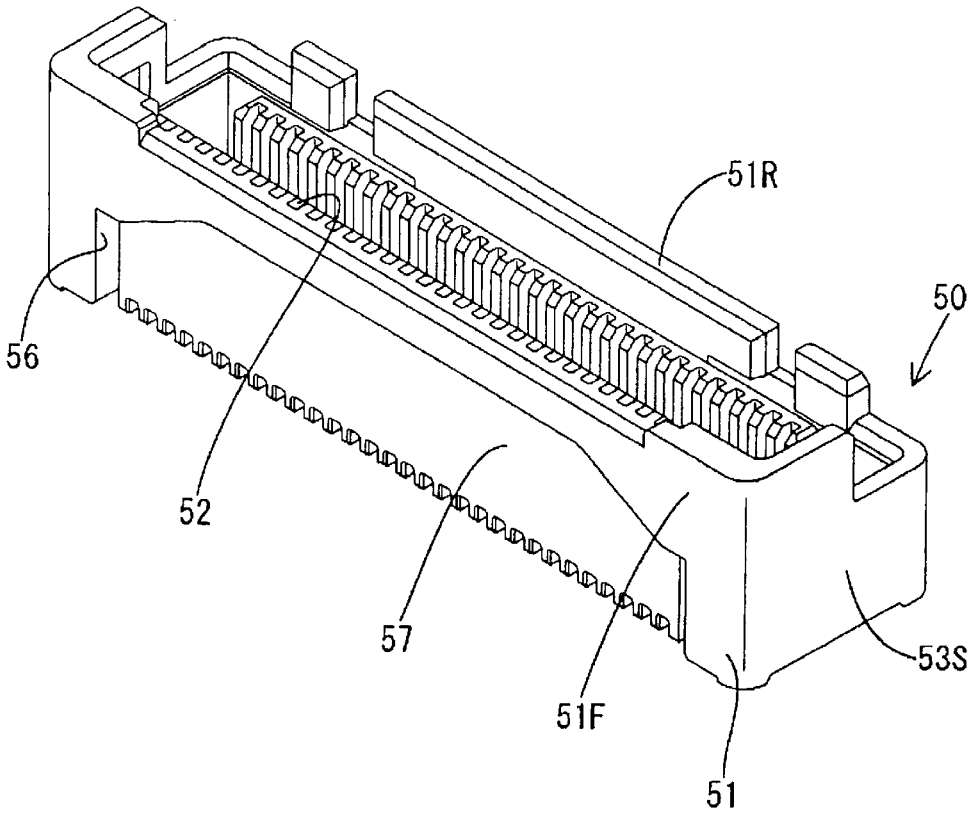
FIG. 11 is a perspective view of a receptacle-side housing.
Figure 12:
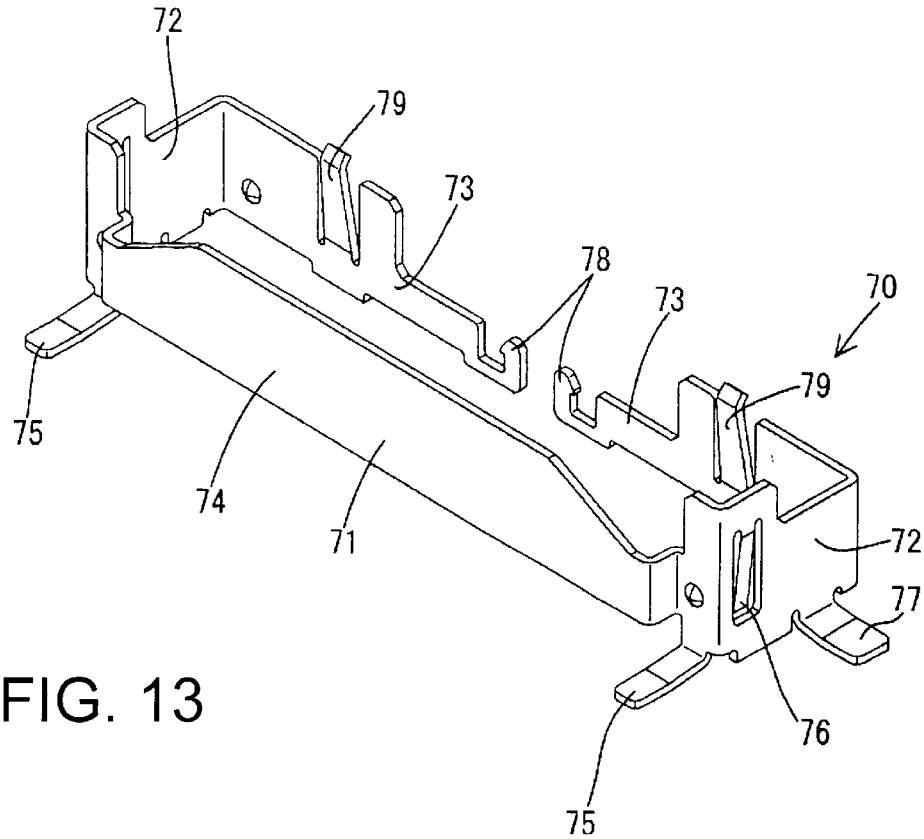
FIG. 12 is a perspective view of a grounding member.

The plug-side connector P is assembled by first mounting the fixing plate 30 on the cover-disposing portion 11 of the plug-side housing 10 from above. Forward movement of the fixing plate 30 is prevented by contact between the front end thereof and the front wall of the cover-disposing portion 11. Rearward movement of the fixing plate 30 is prevented by locking the claws 32 to the locking projections 18 for the fixing plate 30, as shown in FIG. 7. The fixing plate 30 is prevented from being separated upward from the plug-side housing 10 by locking the locking claws 34 of the fixing plate 30 to a receiving portion 10A formed on the rear surface of the plug-side housing 10 (see FIGS. 15 through 18).

The flat cable 80 then is mounted on the plug-side housing 10. More particularly, the short-circuiting member 86 of the flat cable 80 and the covering portion 85 short-circuited by the short-circuiting member 86 are accommodated in the cover-disposing portion 11. The elastic supporting pieces 33 of the fixing plate 30 lock both ends of the short-circuiting member 86 in the cover-disposing portion 11. Thus the flat cable 80 is fixed to the plug-side housing 10 (see FIGS. 8 and 9). The elastic supporting piece 31 of the fixing plate 30 contacts the lower surface of the short-circuiting member 86 elastically. Hence, the shielding layer 83 of each shielded electric wire 81 is connected conductively to the fixing plate 30 through the short-circuiting member 86. A portion of each core 82 near the short-circuiting member 86 is inserted into the core guide groove 12, as shown in FIG. 16, by using an unillustrated comb-shaped jig. At this time, the cores 82 can be guided reliably into the core guide grooves 12 through a guide inclined surface 12B.

The above-described comb-shaped jig is used again to insert all of the cores 82 into the core holding grooves 13 by bending the cores 82 down, as shown in FIG. 16. At this time, the front end of each core 82 is positioned at the opening of the retainer-mounting cavity 14. The retainer 20 then is mounted in the retainer-mounting cavity 14 of the plug-side housing 10 from the front. The retainer 20 presses the front side of each core 82 into the retainer-mounting cavity 14. Thus, the front side of each core 82 is inserted into the corresponding core-fixing groove 15 on the ceiling of the retainer-mounting cavity 14. The front side of each core 82 is sandwiched between and pressurized by the core fixing groove 15 and the core fixing projection 21 of the retainer 20. As a result, the front side of each core 82 is prevented from moving (see FIG. 17). In this manner, each core 82 is held in an unmovable and strained state in the positioning groove 13A of the core holding groove 13 and is exposed on the front surface of the plug-side housing 10. The retainer 20 remains fixed to the retainer-mounting cavity 14 by locking the front end of the right and left arms 23 to the retainer-locking projection 19 of the plug-side housing 10 (see FIG. 23).

The plug-side shielding shell 40 then is mounted on the plug-side housing 10 from the front. More particularly, the plug-side shielding shell 40 is placed vertically in position by fitting the guidable portion 48 of the plug-side shielding shell 40 on a guide groove 10B (see FIG. 9) formed on the right and left side surfaces of the plug-side housing 10 along the upper surface of the arm 23 of the retainer 20. The mounted plug-side shielding shell 40 is prevented from being separated forward from the plug-side housing 10 by pressing the press-fit piece 49 into the press-fit hole 17 of the plug-side housing 10 (see FIG. 19). The mounted plug-side shielding shell 40 is prevented from moving vertically by contacting the upper wall 41 with the upper surface of the plug-side housing 10 and by locking the connection edge 44 to the front end of the bottom surface of the plug-side housing 10. Thus, the plug-side shielding shell 40 is fixed to the plug-side housing 10. In this mounted state, the elastic pressing pieces 47 of the plug-side shielding shell 40 contact the upper surface of the short-circuiting member 86 elastically. Thus, the shielding layer 83 of the shielded electric wire 81 is connected conductively to the plug-side shielding shell 40. Further the plug-side shielding shell 40 and the fixing plate 30 become conductive to each other through the short-circuiting member 86. In this manner, the assembly of the plug-side connector P is complete, and the connection between the plug-side housing 10 and the flat cable 80 is complete.

The receptacle-side connector R is assembled by initially mounting the grounding member 70 on the receptacle-side housing 50 from below. The receptacle-side shielding shell 74, consisting of the front plate 71, is fitted in the shell accommodation portion 57 formed on the outer surface of the front wall 51F of the tubular fit-on portion 51. Simultaneously, the side plates 72 are disposed along the inner surfaces of the right and left side walls 51S of the tubular fit-on portion 51, and the mounting plate 73 is accommodated in a slit-shaped cavity 58 formed inside the rear wall 51R of the tubular fit-on portion 51. Thus, the grounding member 70 is prevented from moving in the front-to-back and right-to-left directions with respect to the receptacle-side housing 50. The grounding member 70 is prevented from moving up with respect to the receptacle-side housing 50 by contacting the substrate connections 75 and 77 with the bottom surface of the receptacle-side housing 50. The grounding member 70 is prevented from being separated down from the receptacle-side housing 50 by pressing the press-fit piece 78 into the shell-mounting hole 55.

The receptacle-side terminal fittings 60 then are mounted on the receptacle-side housing 50 from below. More particularly, the base 61 of each receptacle-side terminal fitting 60 is fitted in the terminal-escaping groove 54 on the bottom surface of the receptacle-side housing 50. Additionally, the elastic contact pieces 62 are fitted in the terminal-positioning grooves 52 formed on the inner surface of the front wall 51F of the tubular fit-on portion 51, and the mounting portions 63 are pressed into the terminal-mounting holes 53 of the rear wall 51R of the tubular fit-on portion 51 to prevent removal of the receptacle-side terminal fittings 60. The elastic contact pieces 62 of the receptacle-side terminal fitting 60 are allowed to deform elastically forward to the inward side of the terminal-positioning groove 52. In this manner, assembling of the receptacle-side connector R is completed.

The receptacle-side connector R is installed on the circuit substrate 90 by fixing the receptacle-side housing 50 to the upper surface of the circuit substrate 90. The substrate connections 75 and 77 of the grounding member 70 and the substrate connection 64 of each receptacle-side terminal fitting 60 are connected to the circuit of the circuit substrate 90.

The plug-side connector P is fitted on the tubular fit-on portion 51 of the receptacle-side connector R so that contact projections 62A on the upper end of the elastic contact pieces 62 of the receptacle-side terminal fittings 60 pass sequentially through the lower terminal guide grooves 16 of the plug-side housing 10 and the upper terminal guide groove 22 of the retainer 20. Thus the elastic contact pieces 62 elastically contact the cores 82 held in the core holding grooves 13. The elastic contact piece 79 of the grounding member 70 contacts the L-shaped locking claw 34 of the fixing plate 30 elastically. Thus, the shielding layer 83 of the shielded electric wire 81 and the grounding member 70 become conductive to each other through the short-circuiting member 86 and the fixing plate 30.

The receptacle-side shielding shell 74 of the grounding member 70 confronts the front surface of the plug-side housing 10 on which the cores 82 are disposed. Additionally, the elastic contact 46 of the plug-side shielding shell 40 contacts the receptacle-side shielding shell 74 elastically. As a result, the receptacle-side shielding shell 74 displays a shielding function.

In this first embodiment, the cores 82 are inserted into the rear end of the core holding grooves 13 that are wider than the outer diameter of the core 82. Thus, even if the plug-side housing 10 deforms, the core 82 is prevented from slipping off from the core holding groove 13 and remains accommodated therein. Accordingly, the adjacent cores 82 are held reliably separate on the outer surface of the plug-side housing 10, and adjacent cores 82 are prevented from contacting each other.

The shielded electric wire 81 of the flat cable 80 is disposed along the outer surface of the plug-side housing 10. Hence, the shielded electric wire 81 can be disposed more easily than a construction in which it is inserted into an opening on the plug-side housing.

The wiring path for the covering portions 85 on the cover-disposing portion 11 of the plug-side housing 10 is perpendicular to and continuous with a wiring path for the cores 82 held individually by the core wire-holding grooves 13. Thus the shielded electric wire 81 is disposed in a U-shape along the outer surface of the plug-side housing 10. Accordingly it is possible to prevent the shielded electric wire 81 from slipping out of place in the axial direction thereof.

The cores 82 in the core holding grooves 13 are placed in an unmovable and strained state by the short-circuiting member 86 fixed to the fixing plate 30 and the retainer 20 serves as the core holding means. Thus the cores 82 and the receptacle-side terminal fittings 60 that have been inserted into the core holding grooves 13 can be connected reliably to each other.

The short-circuiting member 86 for short-circuiting the shielding layers 83 to each other serves as the means for holding the covering portion 85 of the shielded electric wire 81 in the cover-disposing portion 11. Therefore fewer components parts are used in the present invention than in the case where the means for holding the covering portion 85 is separate from the short-circuiting member 86.

To improve workability while wiring the shielded electric wire 81 on the plug-side housing 10, the plug-side connector P is not provided with a shielding function-displaying means to cover the cores disposed on front surface of the plug-side housing 10. However when both connectors P and R have been fitted on each other, the receptacle-side shielding shell 74 of the receptacle-side connector R is conductive to the plug-side shielding shell 40 and confronts the front surface of the plug-side housing 10. Thus the receptacle-side shielding shell 74 and the plug-side shielding shell 40 surround the core wire 82 and the receptacle-side terminal fitting 60 to display a high shielding function.

The grounding member 70 and the receptacle-side shielding shell 74 are integral with each other. Thus, fewer components are used than in the case where the grounding member and the receptacle-side shielding shell are separate from each other.

The receptacle-side housing 50 has the tubular fit-on portion 51 for accommodating the plug-side housing 10. The receptacle-side terminal fitting 60 is disposed inside the tubular fit-on portion 51 to connect the receptacle-side terminal fittings 60 and the cores 82 to each other. Thus the cores 82 are accommodated in the tubular fit-on portion 51, which prevents the cores 82 from being exposed.

The front wall 51F of the tubular fit-on portion 51 partitions the receptacle-side shielding shell 74 from the receptacle-side terminal fittings 60 and the cores 82. Hence, there is no fear that the receptacle-side shielding shell 74 will contact the receptacle-side terminal fitting 60 or the cores 82.

The receptacle-side shielding shell 74 is sandwiched elastically between the elastic contact 46 of the plug-side shielding shell 40 and the front wall 51F of the tubular fit-on portion 51. Thus, the plug-side shielding shell 40 and the receptacle-side shielding shell 74 can be connected reliably to each other at a predetermined contact pressure.

The elastic contact 46 is spaced from the front surface of the plug-side housing 10 on which the cores 82 are disposed. Therefore, there is no possibility that the elastic contact 46 and the cores 82 will interfere with each other.

Figure 25:
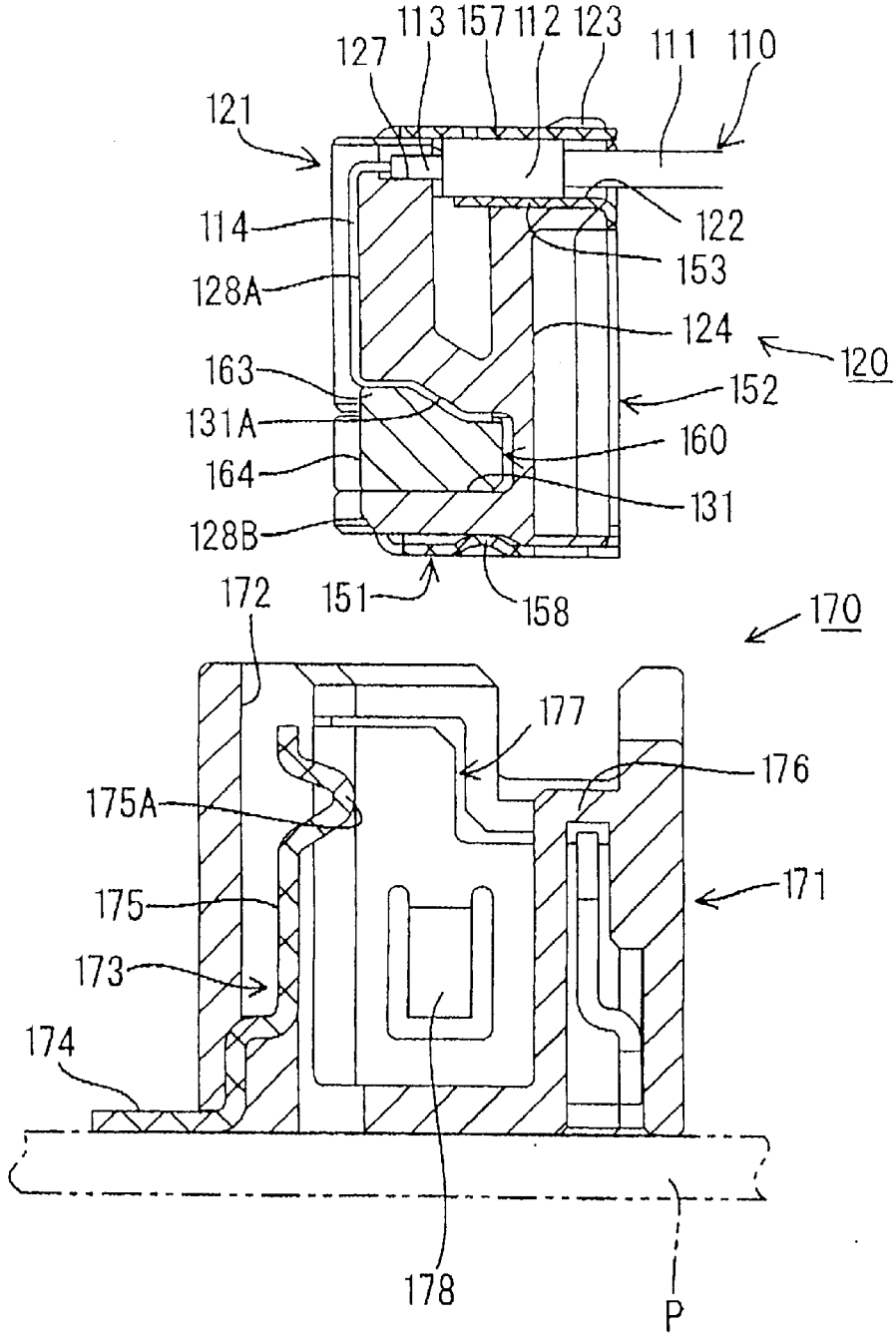
FIG. 25 is a side sectional view showing a state before a plug fits on a receptacle in a second embodiment.
Figure 26:
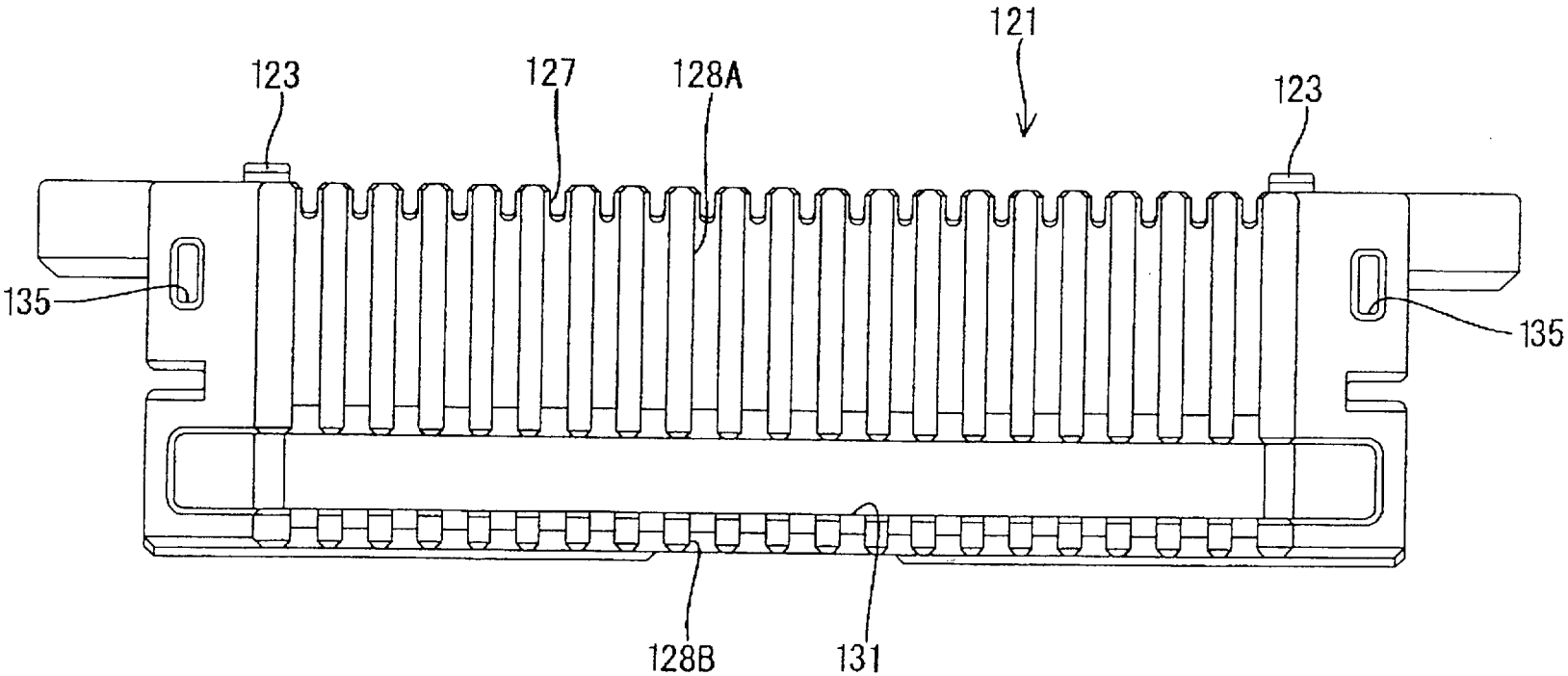
FIG. 26 is a front view of a housing of the second embodiment.
Figure 27:
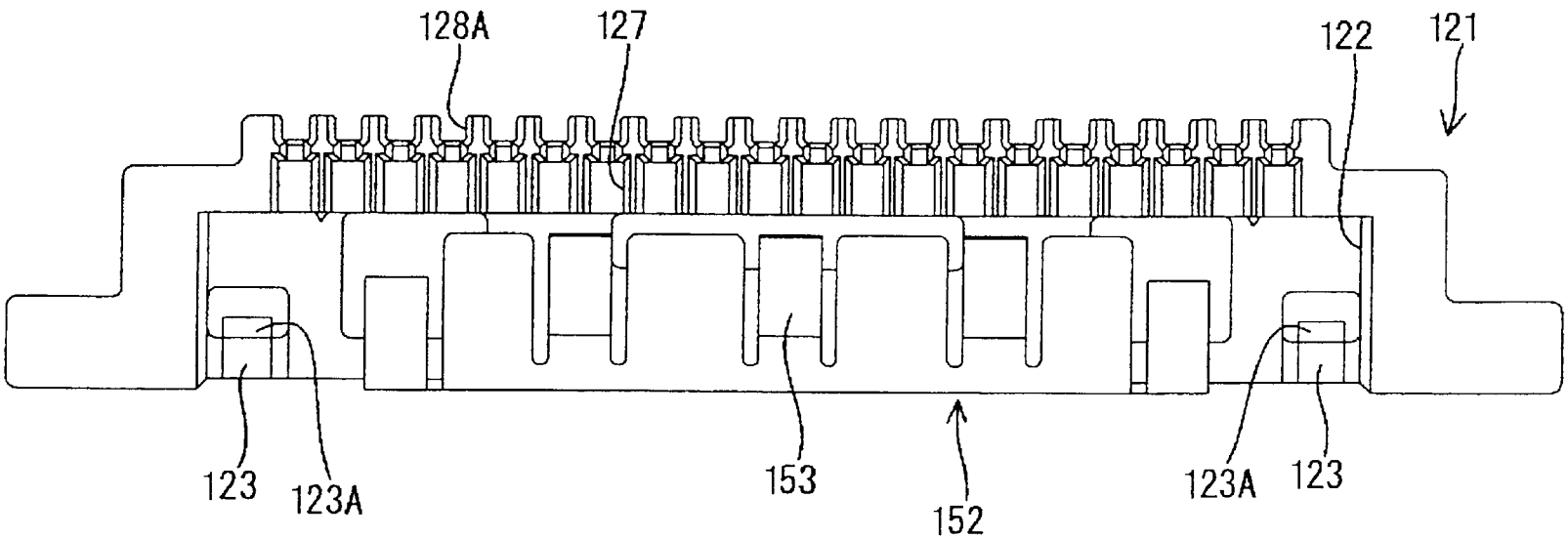
FIG. 27 is a plan view of the housing of FIG. 26.
Figure 28:
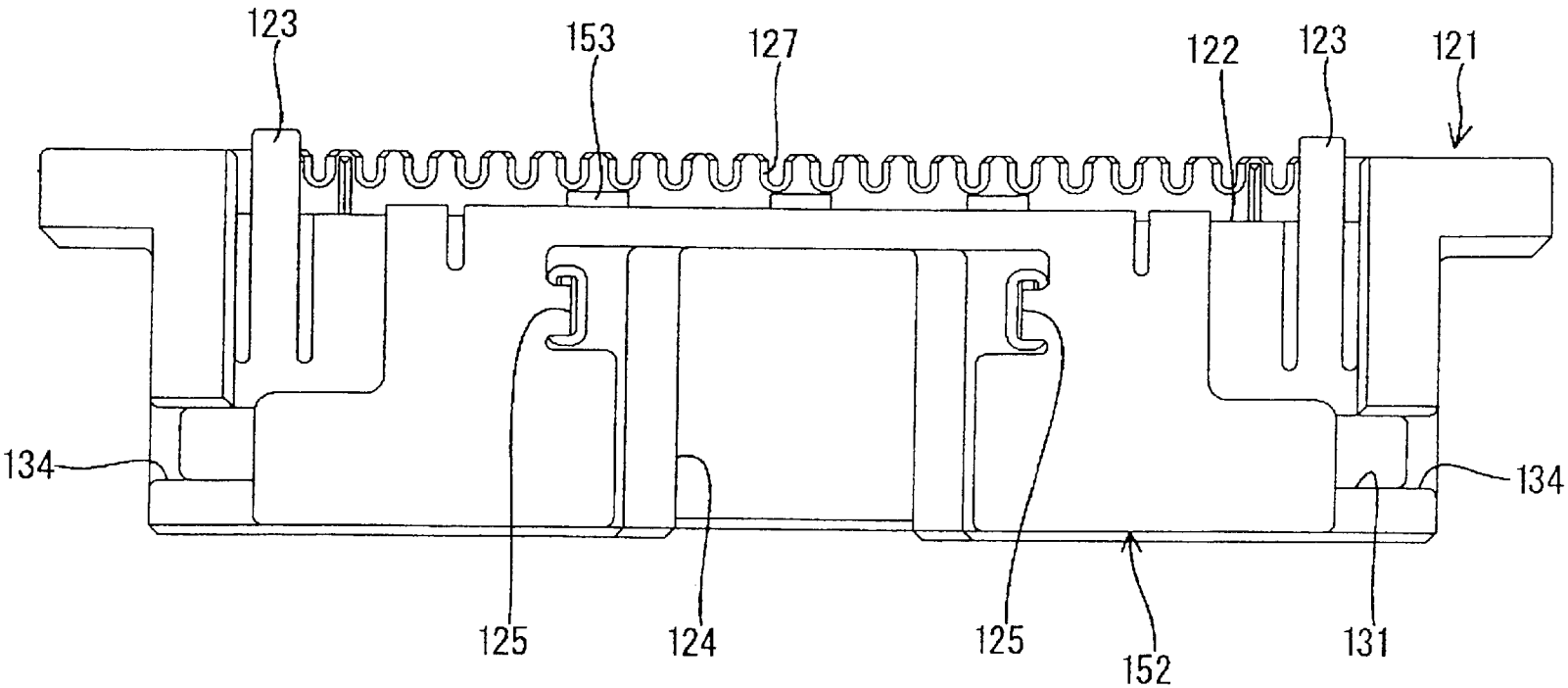
FIG. 28 is a rear view of the housing of FIG. 26.

A second embodiment of the invention will be described below with reference to FIGS. 25 through 36. The second embodiment relates to a connector or plug 120 that is connected with the end of a flat cable 110, as shown in FIG. 25. More particularly, the plug 120 can be fitted on a substrate-side connector or receptacle 170, which is disposed on a circuit substrate P. Thus, the flat cable 110 and a circuit of the circuit substrate P can be connected electrically to each other.

The flat cable 110 includes a plurality of shielded electric wires 111 arranged parallel with one another at predetermined intervals. An unillustrated film covers the shielded electric wires 111. Thus the flat cable 110 is belt-shaped. A short-circuiting member 112 is fixed to the flat cable 110 near the end thereof for short-circuiting shielding layers (not shown) of the shielded electric wires 111 to each other. An inner covering 113 of each shielded electric wire 111 is exposed in a region forward from the short-circuiting member 112, and an exposed core wire 114 extends forward from the inner covering 113.

The plug 120 includes a housing 121. A pair of shielding shells 151 and 152 are mounted on the housing 121 to cover the housing 121 from the front and rear sides. A retainer 160 also is mounted on the housing 121. In the following description, the side at which the retainer 160 is mounted on the housing 121 is referred to as the front, and the side at which the housing 121 fits on the receptacle 170 is referred to as the bottom.

Figure 4:
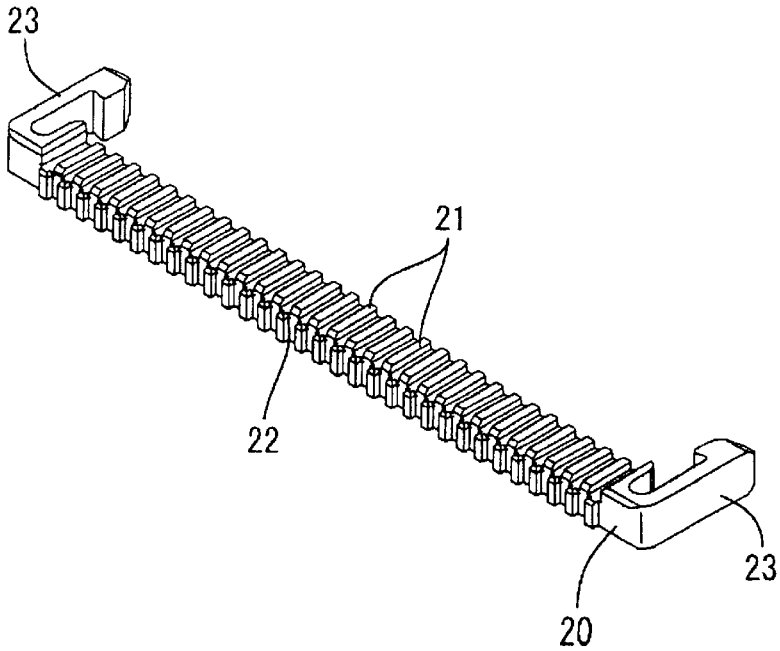
FIG. 4 is a perspective view of a retainer.
Figure 5:
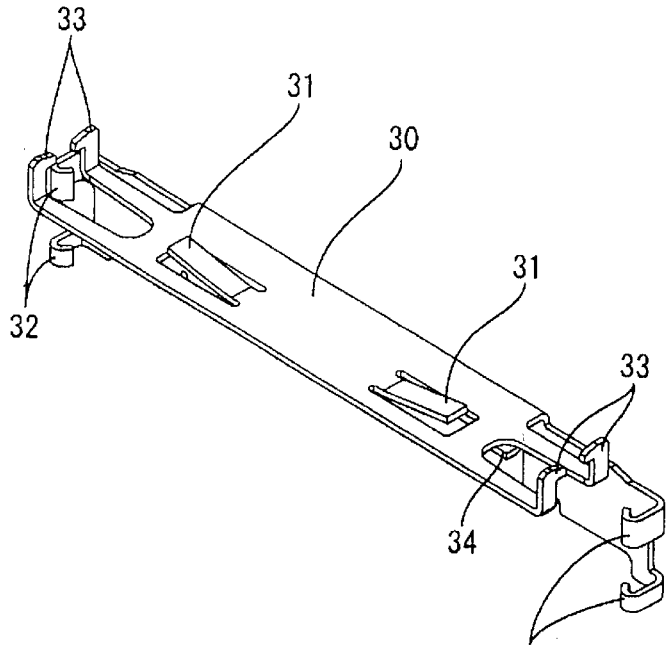
FIG. 5 is a perspective view of a fixing plate.
Figure 6:
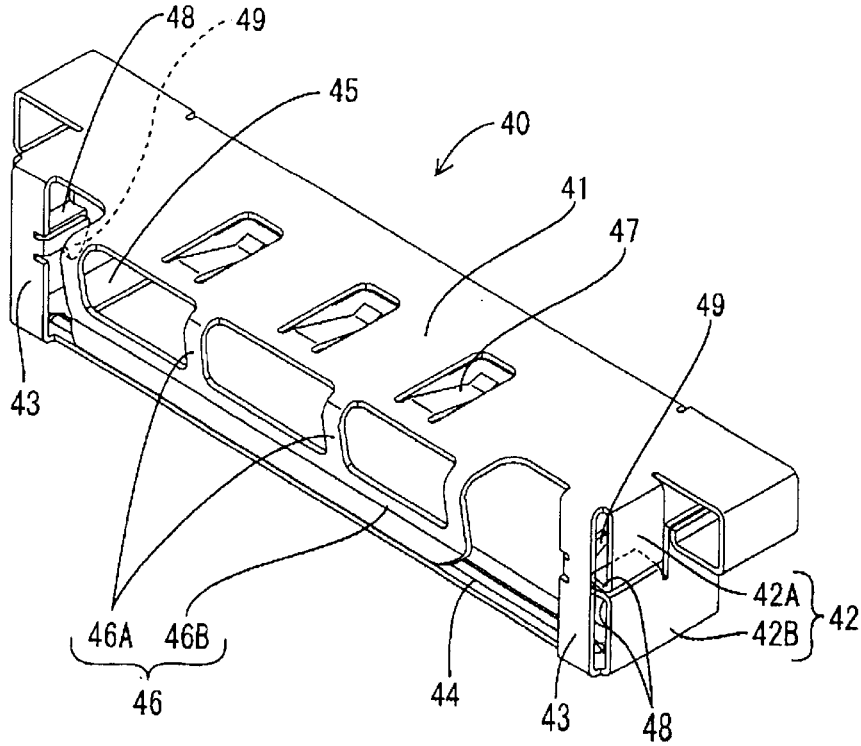
FIG. 6 is a perspective view of a plug-side shielding shell.
Figure 29:
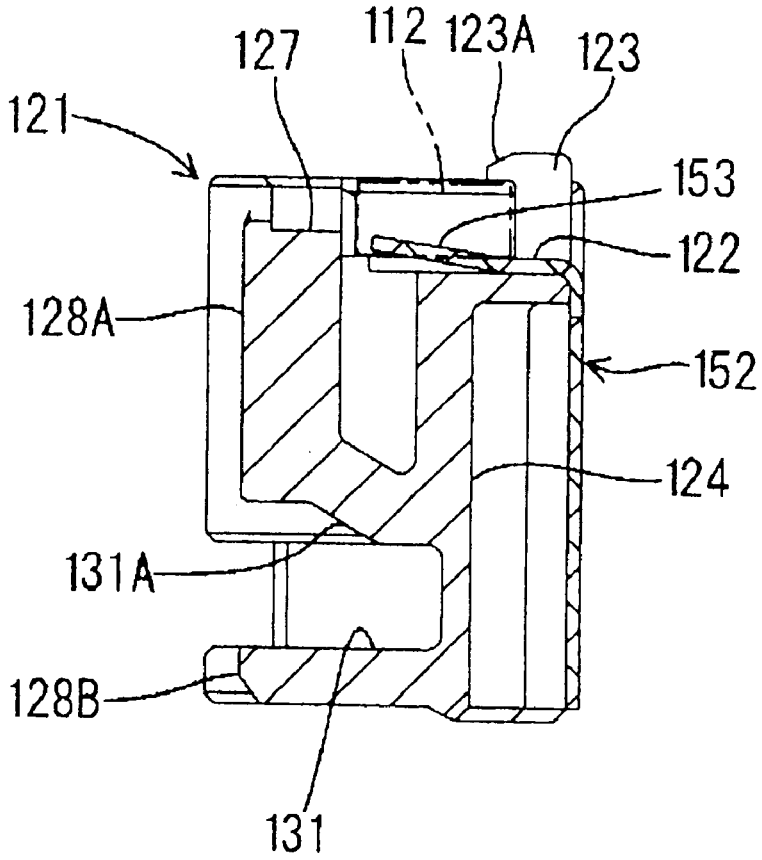
FIG. 29 is a side sectional view of the housing of FIG. 26.

The housing 121 is made of a resinous material. As shown in FIGS. 26 through 29, the housing 121 is box-shaped and long and narrow in a width direction. A long narrow accommodation cavity 122 extends along a right-to-left direction of the housing 121 and is formed on the rear side of the upper surface of the housing 121. The accommodation cavity 122 accommodates the short-circuiting member 112 of the flat cable 110. Elastic locking pieces 123 are formed integrally with the housing 121 and extend up from the vicinity of right and left ends of the rear surface of the housing 121. Upper portions of the elastic locking pieces 123 project into the accommodation cavity 122. A projection 123A projects forward from the front end of the elastic locking piece 123. The projection 123A is locked to the short-circuiting member 112 in the accommodation cavity 122, as shown in FIG. 29, thus locking the short-circuiting member 112 to the housing 121. A fit-in cavity 124 is formed at the widthwise center of the rear surface of the housing 121. A projection 176 formed on the receptacle 170, which will be described later, fits into the fit-in concavity 124. As shown in FIG. 4, the rear surface of the housing 121 has a pair of mounting holes 125 for mounting the rear shielding shell 152 on the housing 121, with the mounting holes 125 sandwiching the fit-in cavity 124 therebetween.

The rear shielding shell 152 is made of an electrically conductive metal plate, and is mounted on the housing 121 by pressing a pair of press-fit projections (not shown) into the mounting holes 125. Thus, the rear-shielding shell 152 covers a part of the rear surface of the housing 121 except the fit-in cavity 124. The upper end of the rear-side shielding shell 152 is bent along the bottom surface of the accommodation cavity 122. Three upwardly extending elastic contact portions 153 are formed in the accommodation cavity 122. The elastic contact portions 153 contact the short-circuiting member 112 elastically to obtain continuity.

Parallel holding grooves 127 are arranged widthwise on the upper surface of the housing 121. The holding grooves 127 extend from the accommodation cavity 122 to the front end of the housing 121. The inner coverings 113 of the flat cable 110 are inserted into the holding grooves 127 respectively. Communication grooves 128A and 128B are formed on the front surface of the housing 121 at the same pitches as the holding grooves 127, and extend vertically to the lower end of the housing 121 for communication with the respective holding grooves 127. The cores 114 extend from the inner covering 113 in the holding grooves 127 and are inserted into the upper communication grooves 128A. Terminal fittings 173 of the receptacle 170, which will be described later, contact the cores 114 at this position. A wide retainer-mounting opening 131 is formed in a lower portion of the front surface of the housing 121 at the lower-ends of the upper communication grooves 128A. The front ends of the cores 114 extend from the communication grooves 128A and are inserted into the retainer-mounting opening 131. The retainer 160 that will be described later also is inserted into the retainer-mounting opening 131 to hold the cores 114 therein.

Figure 30:
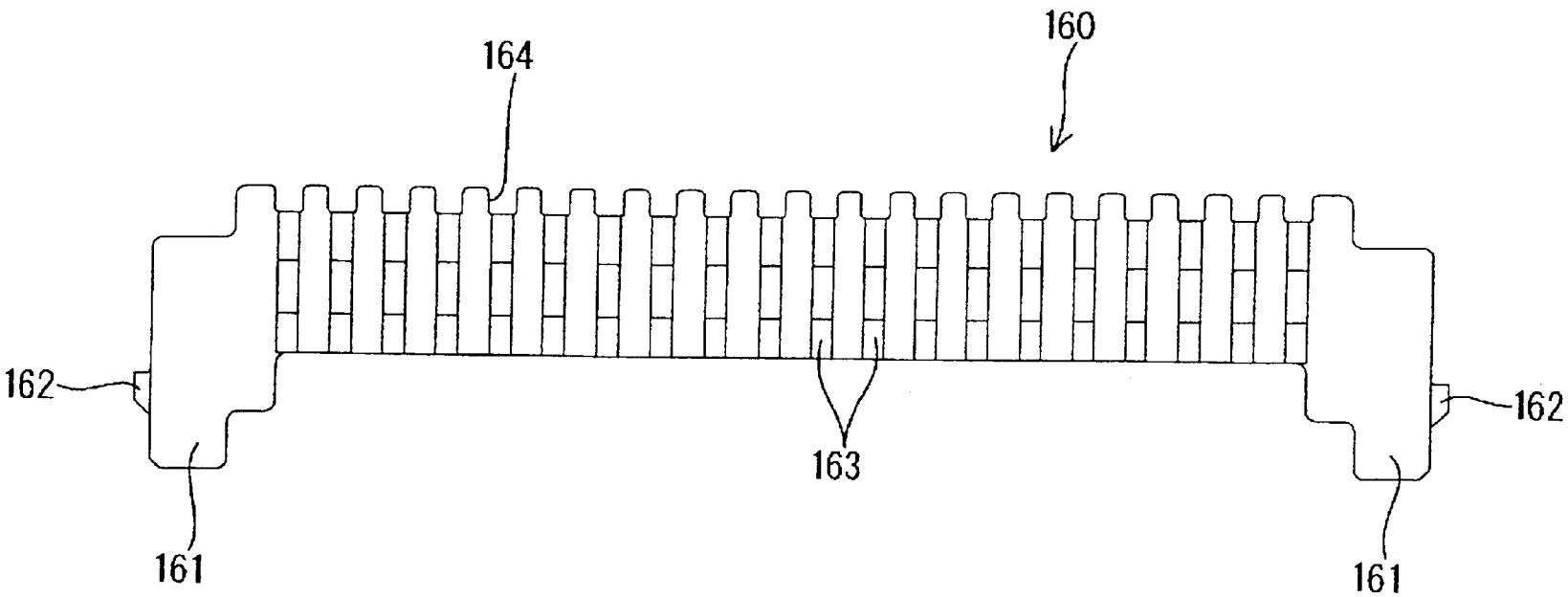
FIG. 30 is a plan view of a retainer of the second embodiment.

As shown in FIG. 30, the synthetic resin retainer 160 is plate-shaped and is long and narrow in a widthwise direction. The retainer 160 is mounted into the retainer-mounting opening 131 of the housing 121. Arms 161 extend forward from both lateral ends of the retainer 160, and locking projections 162 project from the outer surface of each arm 161. The upper surface of the retainer 160 is formed with sandwiching projections 163 at a positions corresponding to each communication groove 128A for sandwiching the cores 114 between the sandwiching projections 163 and the housing 121.

Figure 31:
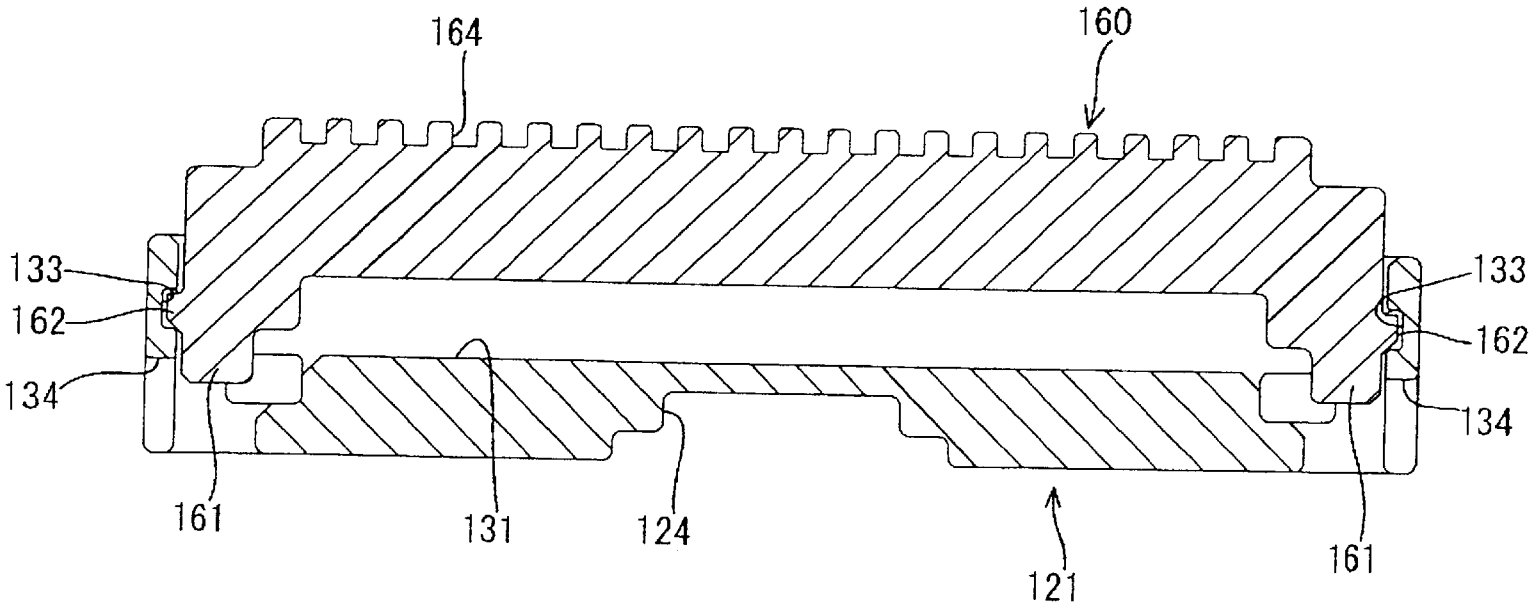
FIG. 31 is a plan sectional view of the second embodiment showing a state in which the retainer has been mounted at a temporary locking position.
Figure 32:
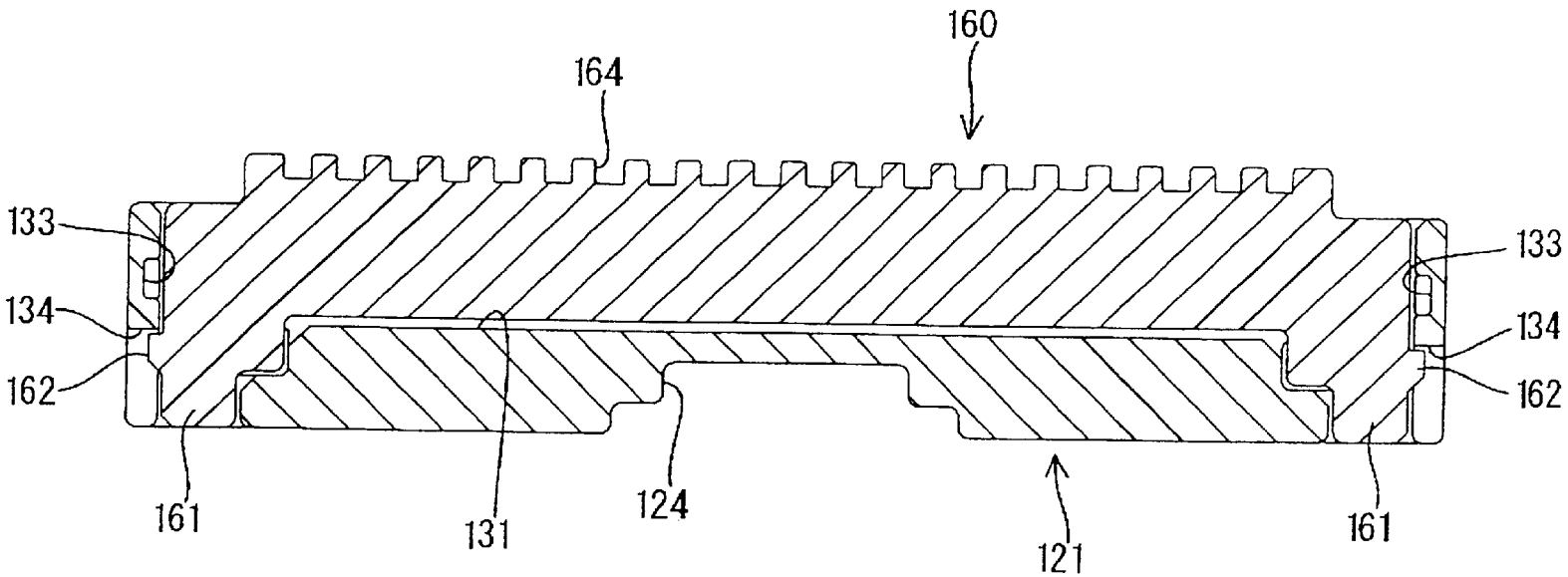
FIG. 32 is a plan sectional view of the second embodiment showing a state in which the retainer has been mounted at a main locking position.

The retainer 160 can be inserted into the retainer-mounting opening 131 at a temporary locking position, where the insertion depth is small, and a main locking position, where the retainer 160 is inserted into the innermost potion. At the temporary locking position, as shown in FIG. 31, the locking projections 162 engage temporary locking cavities 133 formed on the side walls of the retainer-mounting opening 131. At this time, a gap is formed between the sandwiching projections 163 and an upper surface 131A (shown in FIG. 29) of the retainer-mounting opening 131. The cores 114 can be inserted into the gap. As shown in FIG. 32, at the main locking position, the locking projections 162 engage notches 134 formed at rear portions of both side walls of the retainer-mounting opening 131. At this time, as shown in FIG. 25, the cores 114 are sandwiched between the sandwiching projections 163 and the upper surface 131A of the retainer-mounting opening 131. Communication grooves 164 continuous with the communication grooves 128A and 128B at the main locking position are arranged on the rear surface of the retainer 160.

Figure 33:
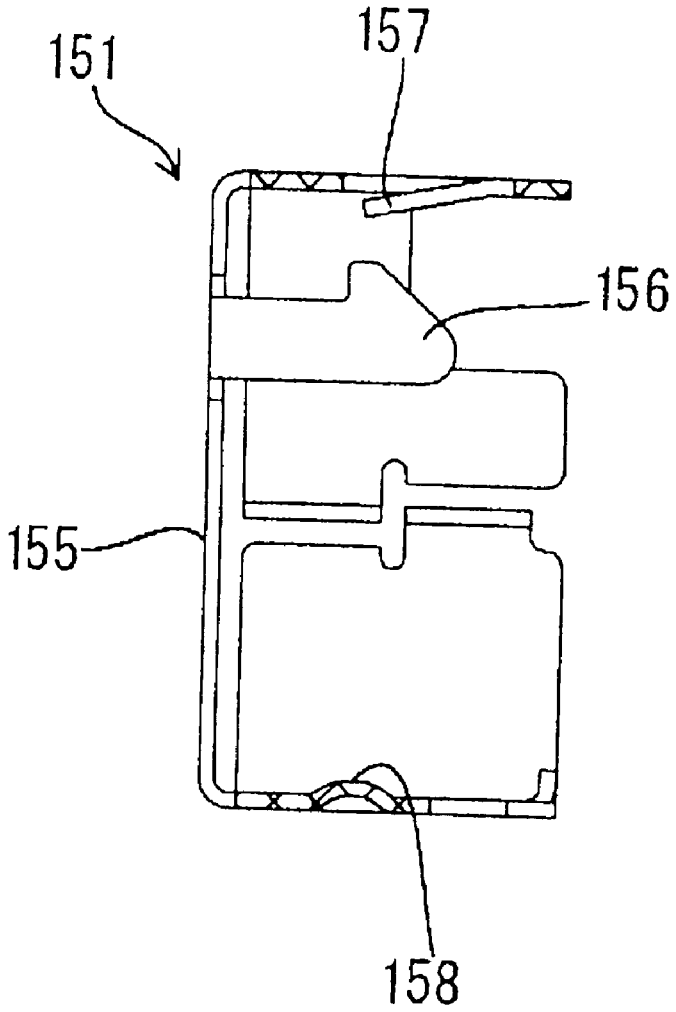
FIG. 33 is a side sectional view of a shielding shell for the second embodiment.
Figure 34:
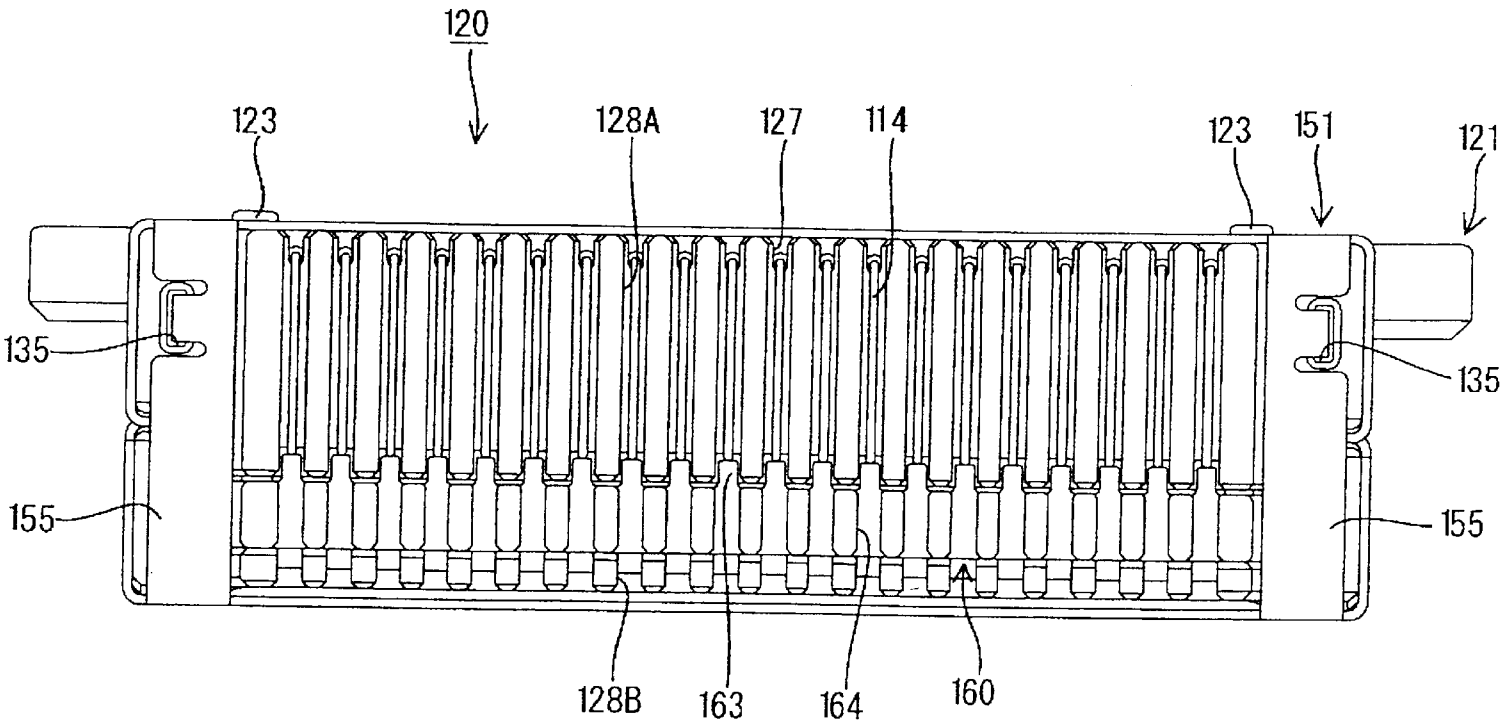
FIG. 34 is a front view of the plug for the second embodiment.

The front shielding shell 151 is made of an electrically conductive metal plate. As shown in FIGS. 33 and 34, the front shielding shell 151 is approximately rectangular and is solid-shaped to cover the upper, lower, right, and left surfaces of the housing 121. Rear plates 155 are formed at right and left ends of the rear surface (left side in FIG. 33) of the front shielding shell 151. Press-fit projections 156 project forward from both rear plates 155. A mounting hole 135 is formed at right and left ends of the front surface of the housing 121, with the communication grooves 128A sandwiched between a pair of the mounting holes 135. The front shielding shell 151 is mounted on the housing 121 by pressing the press-fit projections 156 into the mounting holes 135 respectively. Elastic contacts 157 extend obliquely downward from the upper surface of the front shielding shell 151. The elastic contacts 157 contact the short-circuiting member 112 elastically to obtain continuity. An elongate, laterally extending reinforcing projection 158 is formed on the lower surface of the front shielding shell 151 by upwardly turning out the lower surface thereof. The reinforcing projection 158 contacts the lower surface of the housing 121 when the front shielding shell 151 is mounted on the housing 121, thus preventing deformation of the lower portion of the housing 121, when the retainer 160 is pressed into the retainer-mounting opening 131.

Figure 35:
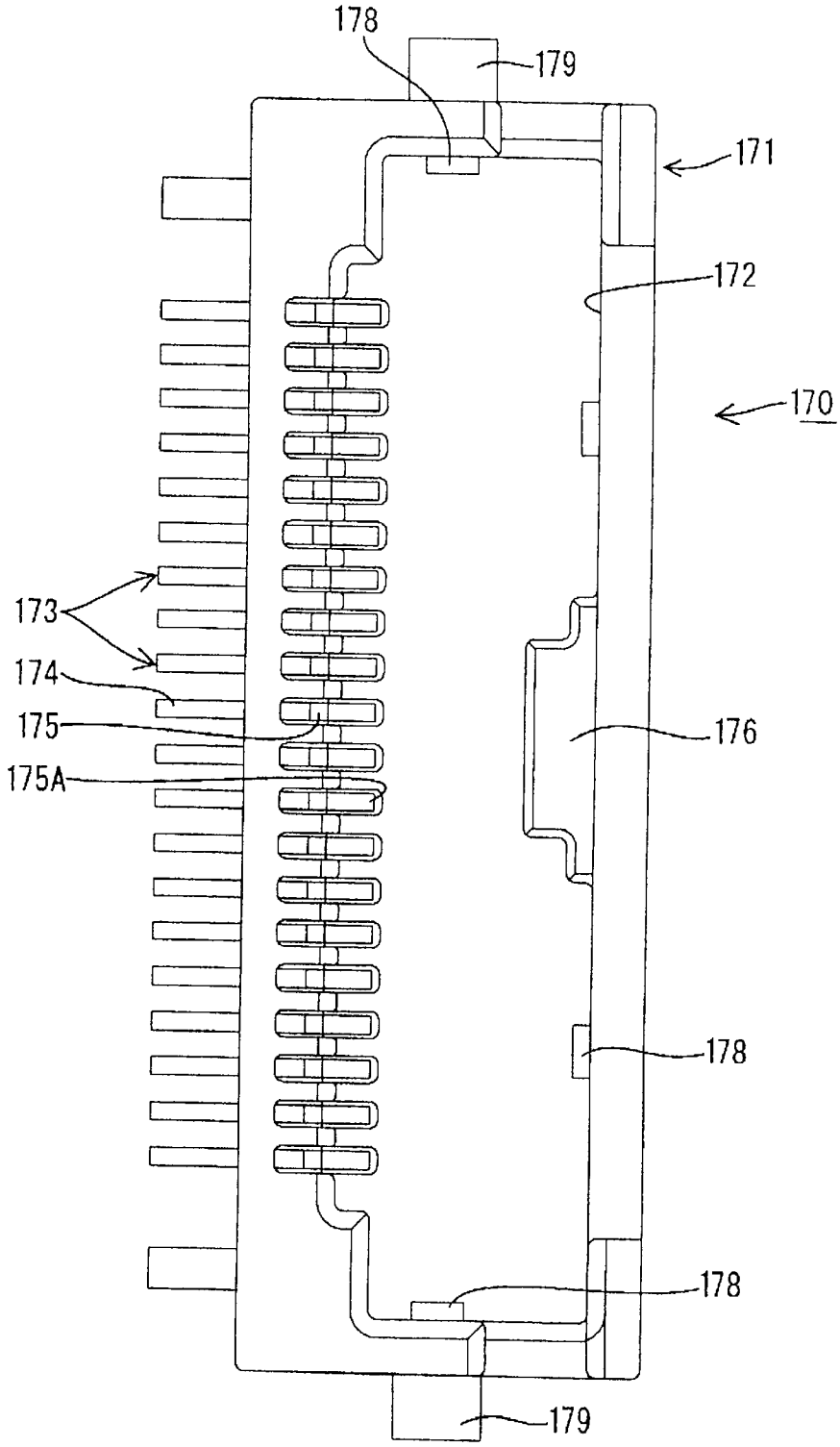
FIG. 35 is a plan view of the receptacle of the second embodiment.
Figure 36:
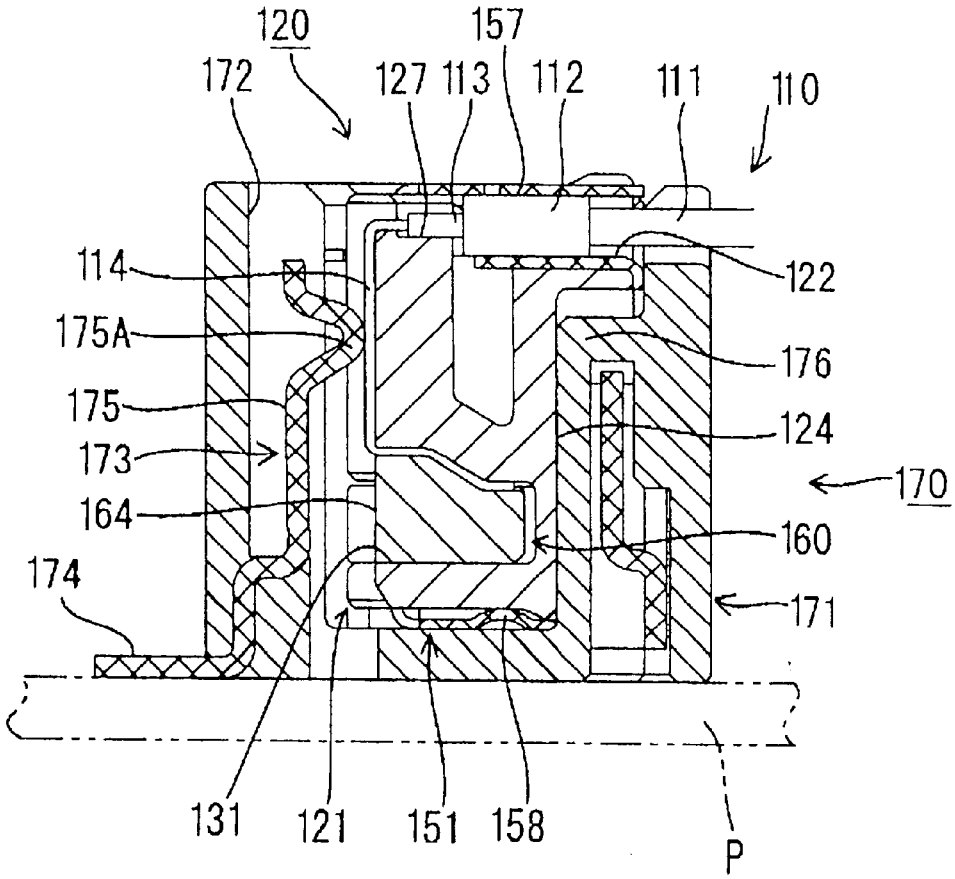
FIG. 36 is a side sectional view showing a state in which the plug of the second embodiment is fitted on the receptacle.

As shown in FIGS. 35 and 36, the receptacle 170 has a synthetic resin receptacle-side housing 171 fixed to the circuit substrate P. The receptacle-side housing 171 has a fit-in tubular portion 172 that opens up. The plug 120 fits on the fit-in tubular portion 172 from above. Terminal fittings 173 are mounted on the receptacle-side housing 171 along the front wall of the fit-in tubular portion 172 at regular pitches in a right-to-left direction. One end of each terminal fitting 173 extends out from the fit-in tubular portion 172 and is connected to a contact (not shown) of the circuit substrate P, thus serving as a connection piece 174. The other end of the terminal fitting 173 projects up into the fit-in tubular portion 172, thus serving as an elastic contact piece 175. A contact 175A is formed near the front end of the terminal fitting 173 and projects into the fit-in tubular portion 172. The contact 175A elastically contacts a part of the core 114 at the side of the plug 120. The receptacle-side housing 171 has a projection 176 that projects into the fit-in tubular portion 172 from the center of the rear wall of the fit-in tubular portion 172.

The fit-in tubular portion 172 accommodates a receptacle-side shielding shell 177 made of an electrically conductive metal plate. The receptacle-side shielding shell 177 extends along the right and left side surfaces and the rear surface of the fit-in tubular portion 172. The receptacle-side shielding shell 177 has three elastic connection pieces 178 formed by cutting and raising the right, left, and rear surfaces thereof obliquely downwardly. The plug 120 is capable of elastically contacting the elastic connection piece 178 when the shielding shell 177 and the plug 120 fit on each other. A substrate connection portion 179 is formed on the right and left side surfaces of the receptacle-side shielding shell 177 and extends out from the fit-in cylindrical portion 172. The substrate connection portion 179 is connected to a grounding circuit (not shown) on the circuit substrate P.

The plug 120 is assembled by initially inserting the retainer 160 into the retainer-mounting opening 131 of the housing 121. The locking projection 162 is engaged by the temporary locking cavity 133 to mount the retainer 160 in the temporary locking position (see FIG. 31). The rear shielding shell 152 is mounted on the mounting hole 125 formed on the rear surface of the housing 121.

Thereafter the short-circuiting member 112, which is fixed to the flat cable 110, is inserted into the accommodation cavity 122 from the rear to lock the short-circuiting member 112 to the projection 123A of the elastic locking piece 123. Thus the housing 121 retains the short-circuiting member 112. At this time, the elastic contact portion 153 of the rear shielding shell 152 contacts the short-circuiting member 112 elastically so that the short-circuiting member 112 and the rear shielding shell 152 become electrically conductive to each other. The inner coverings 113 of the flat cable 110 are inserted into the holding grooves 127, and the cores 114 are inserted into the communication grooves 128A by bending the core wires 114 in the shape of the letter "L", and the front ends of the cores 114 are inserted into the retainer-mounting openings 131 respectively. The retainer 160 then is pressed into the retainer-mounting openings 131, and the locking projection 162 is locked to the notch 134 to mount the retainer 160 in the main locking position. Thus the cores 114 inserted into the retainer-mounting openings 131 are sandwiched between the sandwiching projections 163 of the retainer 160 and the upper wall of the retainer-mounting opening 131. Hence, the front portions of the cores 114 are held therebetween.

The front shielding shell 151 is mounted on the housing 121 by pressing the press-fit projection 156 of the front shielding shell 151 into the mounting hole 135 from the front side of the housing 121 (see FIGS. 25 and 34). As a result, the elastic contact portion 157 of the front shielding shell 151 elastically contacts the upper surface of the short-circuiting member 112. Thus, the short-circuiting member 112 and the rear shielding shell 152 become electrically conductive to each other. The reinforcing projection 158 on the front shielding shell 151 contacts the lower surface of the housing 121 to prevent the portion of the housing 121 below the retainer-mounting opening 131 from deforming down against a pressing force applied thereto when the retainer 160 is pressed into the retainer-mounting opening 131. In this manner, the operation of assembling the plug 120 is completed.

The plug 120 and the receptacle 170 next are fitted on each other. As the operation of fitting the plug 120 into the fit-in tubular portion 172 proceeds, the elastic contact piece 175 of each terminal fitting 173 flexes forward, and each contact portion 175A thereof penetrates into the communication groove 128B, passes through the communication groove 164, and reaches the communication groove 128A, to elastically contact the cores 114 in the communication groove 128A. The elastic connection pieces 178 of the receptacle-side shielding shell 177 contact the front shielding shell 151 or the rear shielding shell 152 of the plug 20 elastically. When the plug 120 and the receptacle 170 have been fitted on each other, the core 114 of each shielded electric wire 111 of the flat cable 110 is connected to the contact (not shown) disposed on the circuit substrate P through the terminal fitting 173, and the shielding layer (not shown) of each core 114 is connected to the grounding circuit on the circuit substrate P through the front shielding shell 151, the rear shielding shell 152, and the receptacle-side shielding shell 177.

As described above, the retainer 160 of the second embodiment retains the front portion of the core 114 by sandwiching the front portion thereof between the retainer 160 and the housing 121. Therefore, it is possible to prevent the core 114 from moving up or curving. Thus, a contact pressure between the mating terminal fitting 173 and the core 114 is secure and a reliable continuity connection can be obtained.

An assembling operation can be performed easily by delivering the housing 121 to a flat cable-mounting site, with the retainer 160 mounted on the temporary locking position and by then mounting the retainer 160 on the main locking position to retain the core 114 to the housing 121.

The elastic locking piece 123 is integral with the housing 121. Thus, the covering portion of the shielded electric wire 111 can be held without using a separate member, by locking the elastic locking piece 123 to the short-circuiting member 112. Therefore it is possible to reduce the number of parts.

Figure 37:
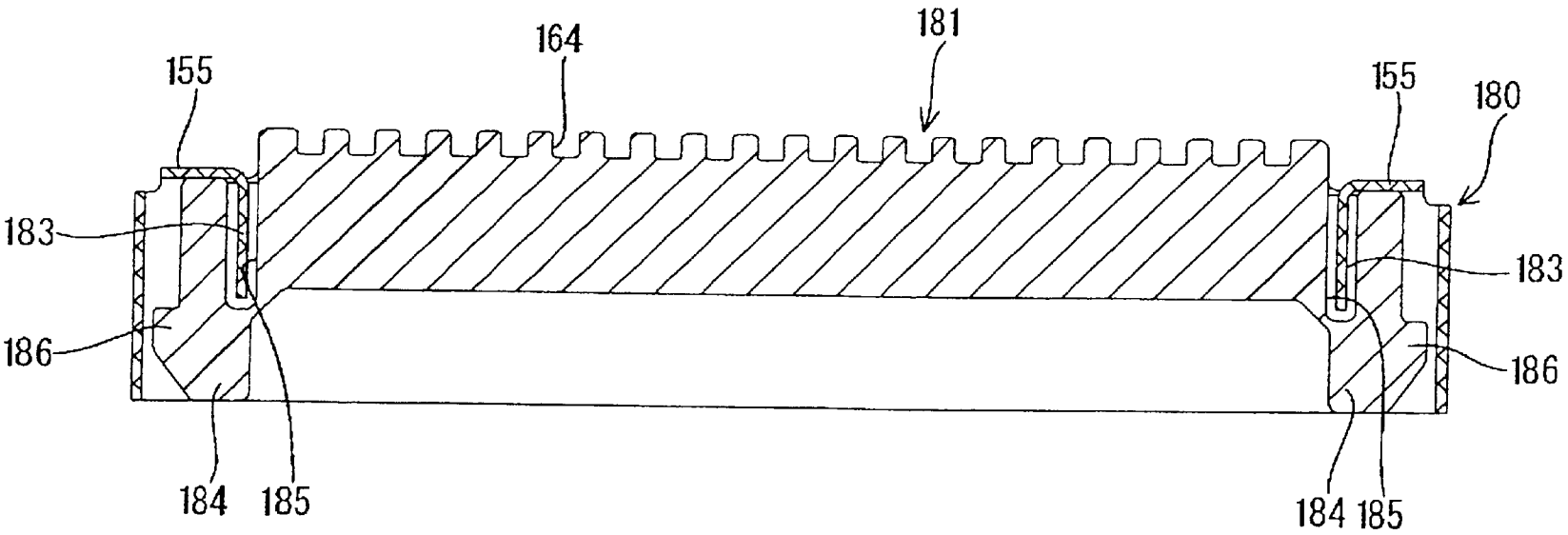
FIG. 37 is a plan sectional view showing a state in which a shielding shell and a retainer have been fitted on each other in a third embodiment.
Figure 38:
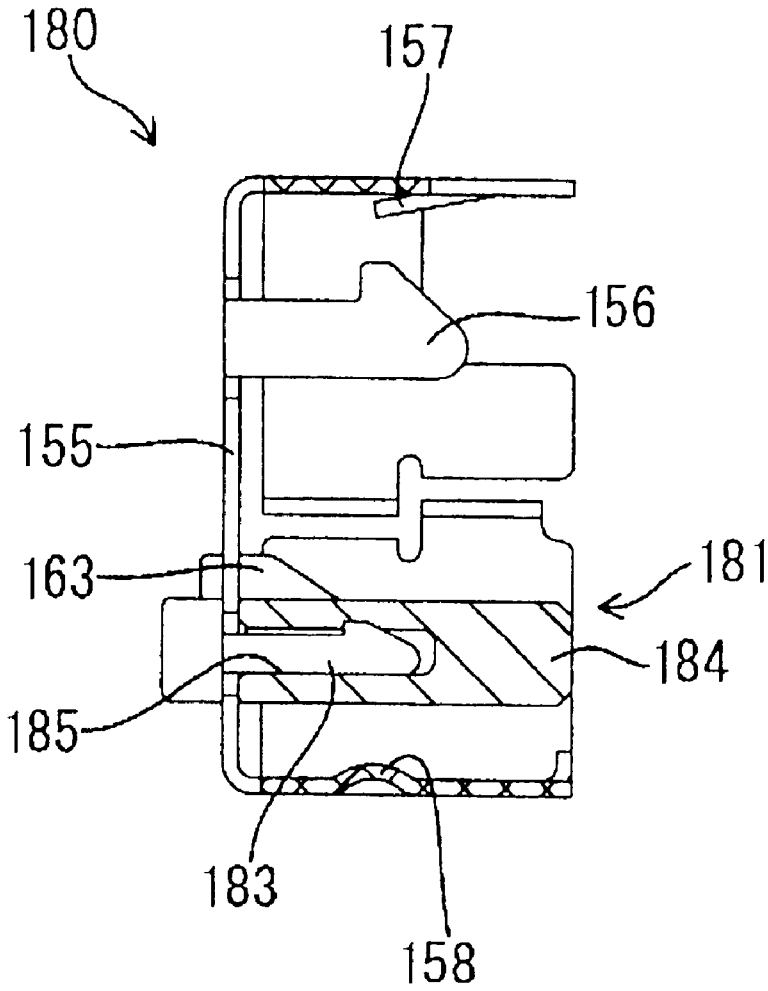
FIG. 38 is a side sectional view showing a state in which the shielding shell and the retainer of the third embodiment have been fitted on each other.
Figure 39:
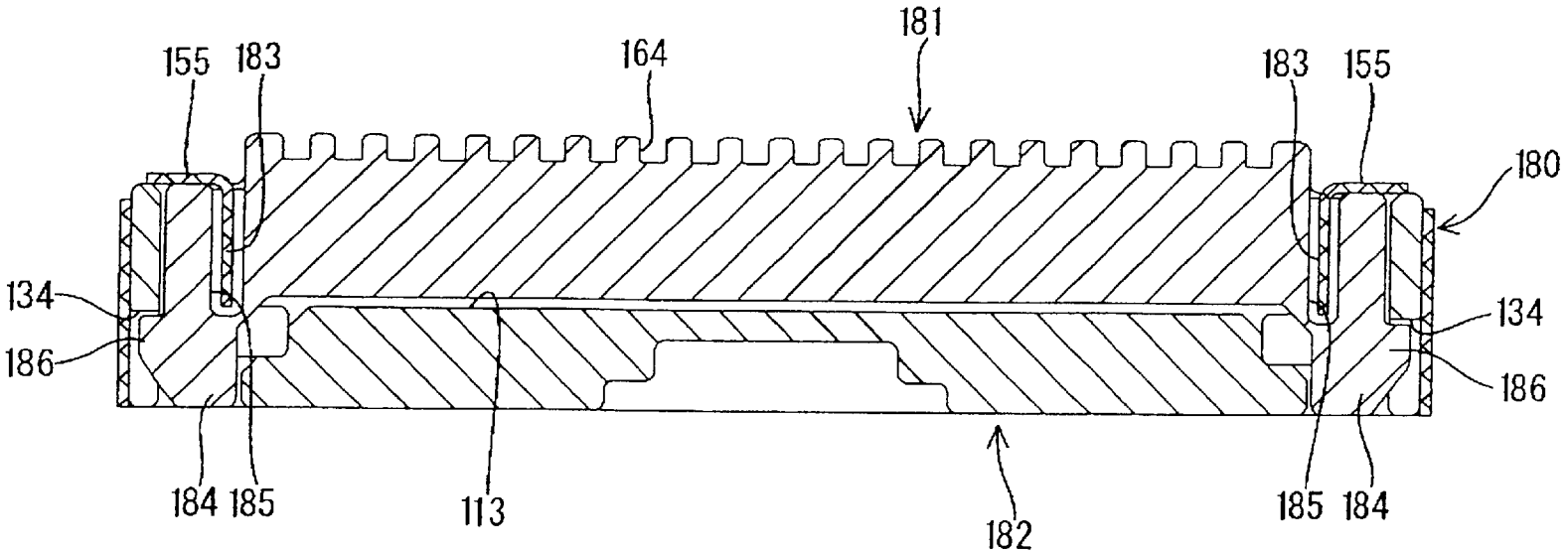
FIG. 39 is a side sectional view showing a state in which the shielding shell and the retainer of the third embodiment have been mounted on the housing.
Figure 40:
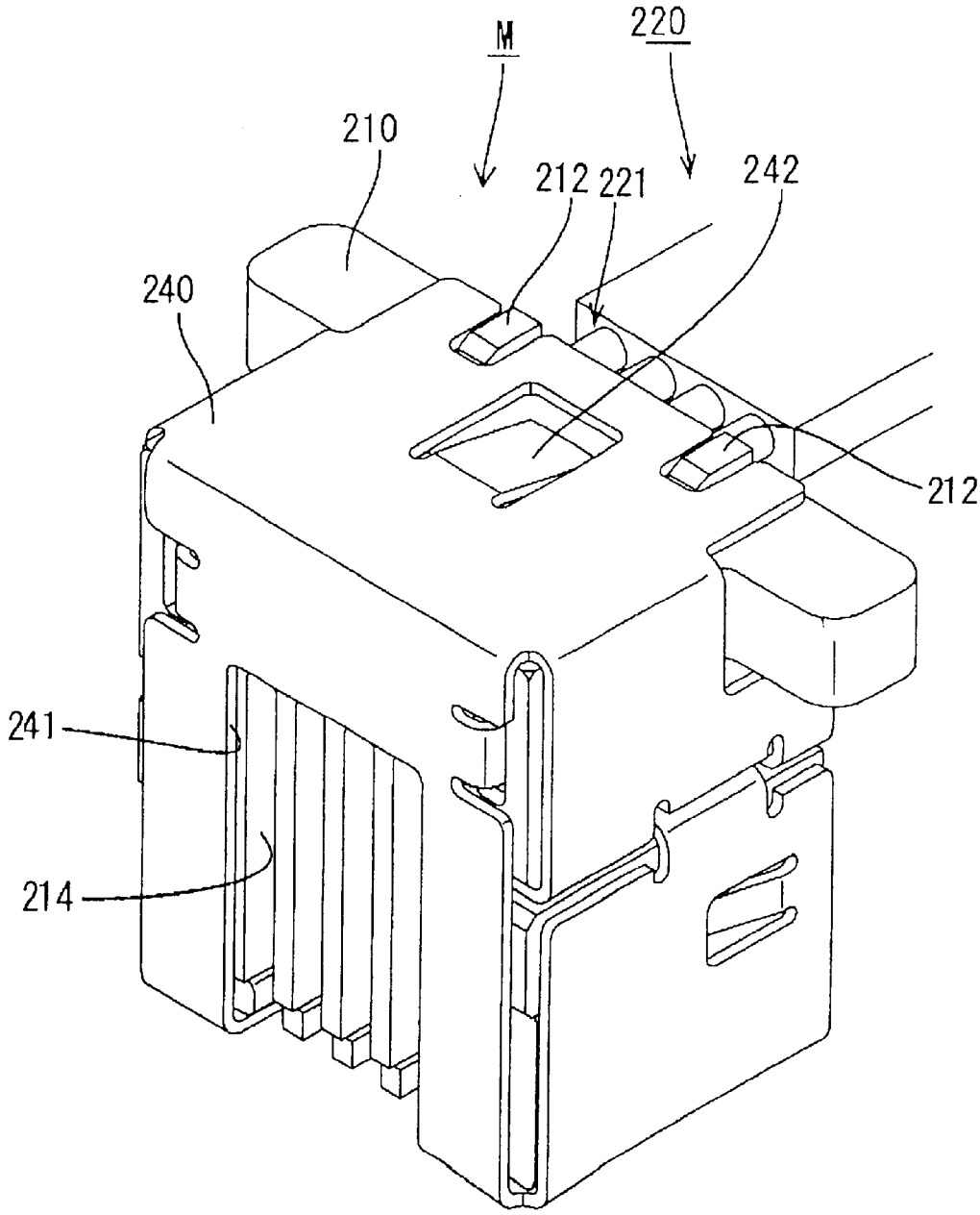
FIG. 40 is a perspective view showing an assembled state of a fourth embodiment.
Figure 41:
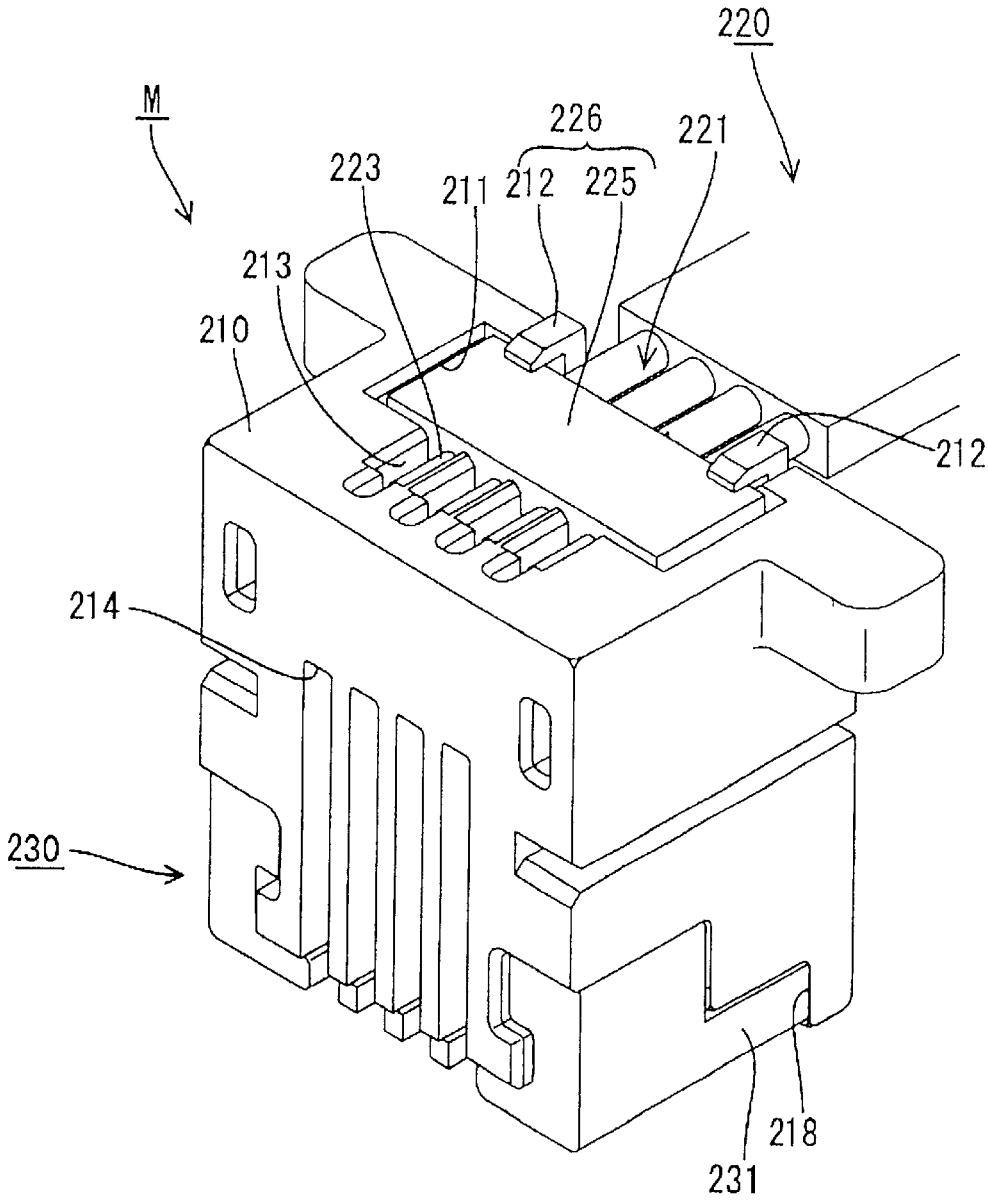
FIG. 41 is a perspective view showing a state in which a shielding shell has been removed from a housing of the fourth embodiment.
Figure 42:
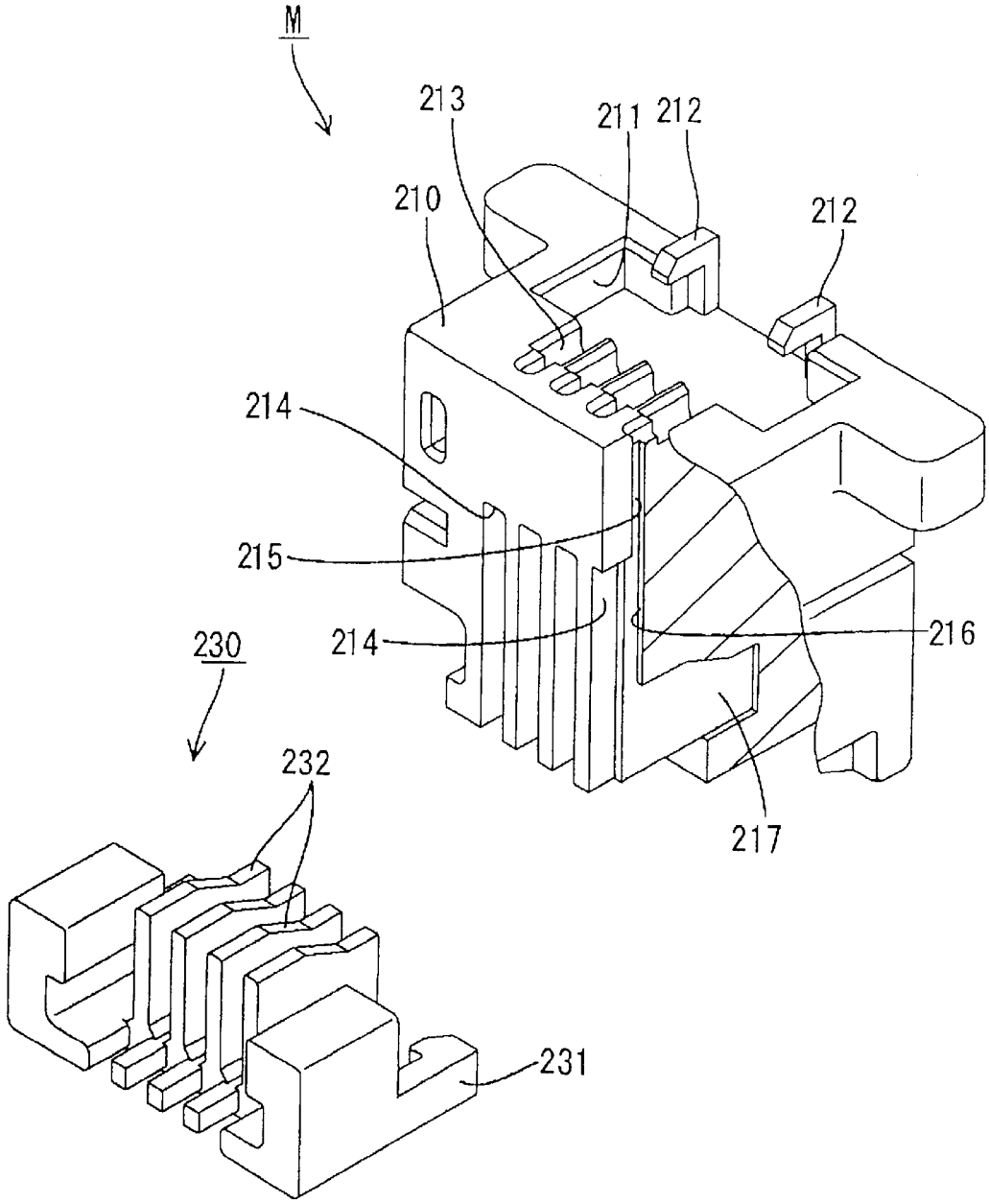
FIG. 42 is a partly cut-out perspective view of the fourth embodiment showing a state in which a retainer has been removed from the housing.
Figure 43:
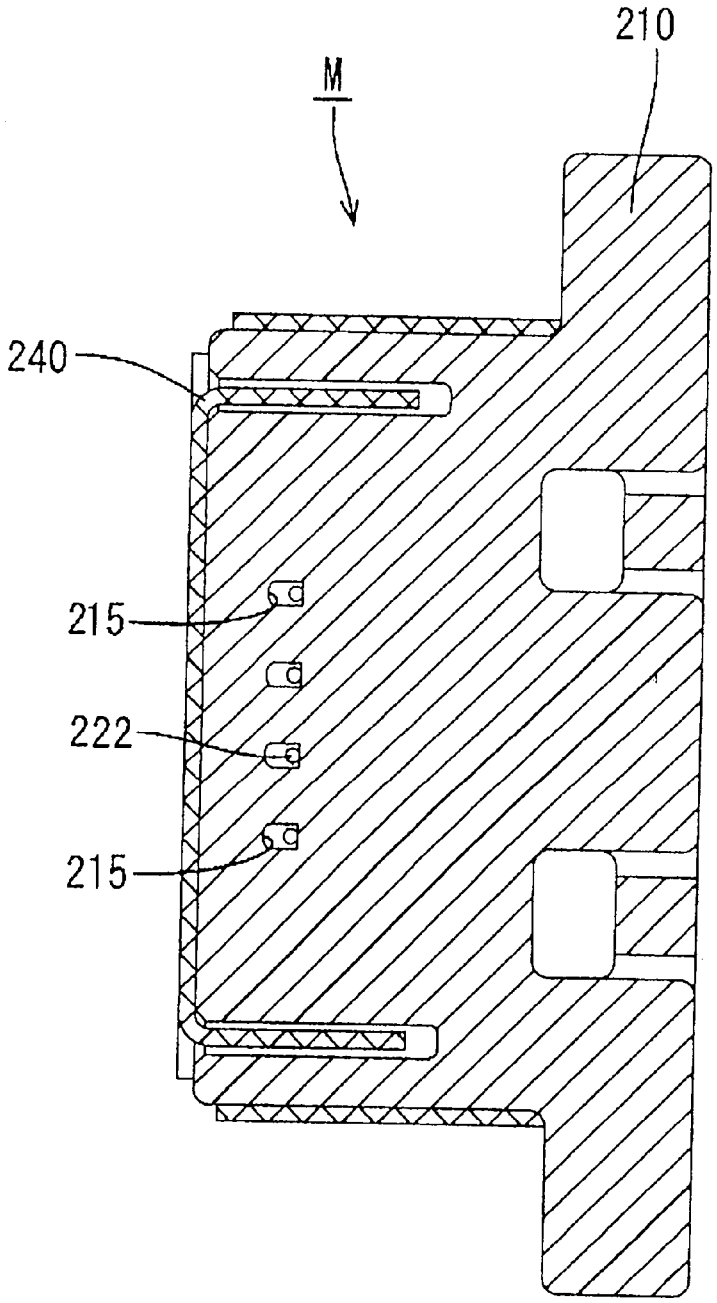
FIG. 43 is a horizontal sectional view of the fourth embodiment.
Figure 44:
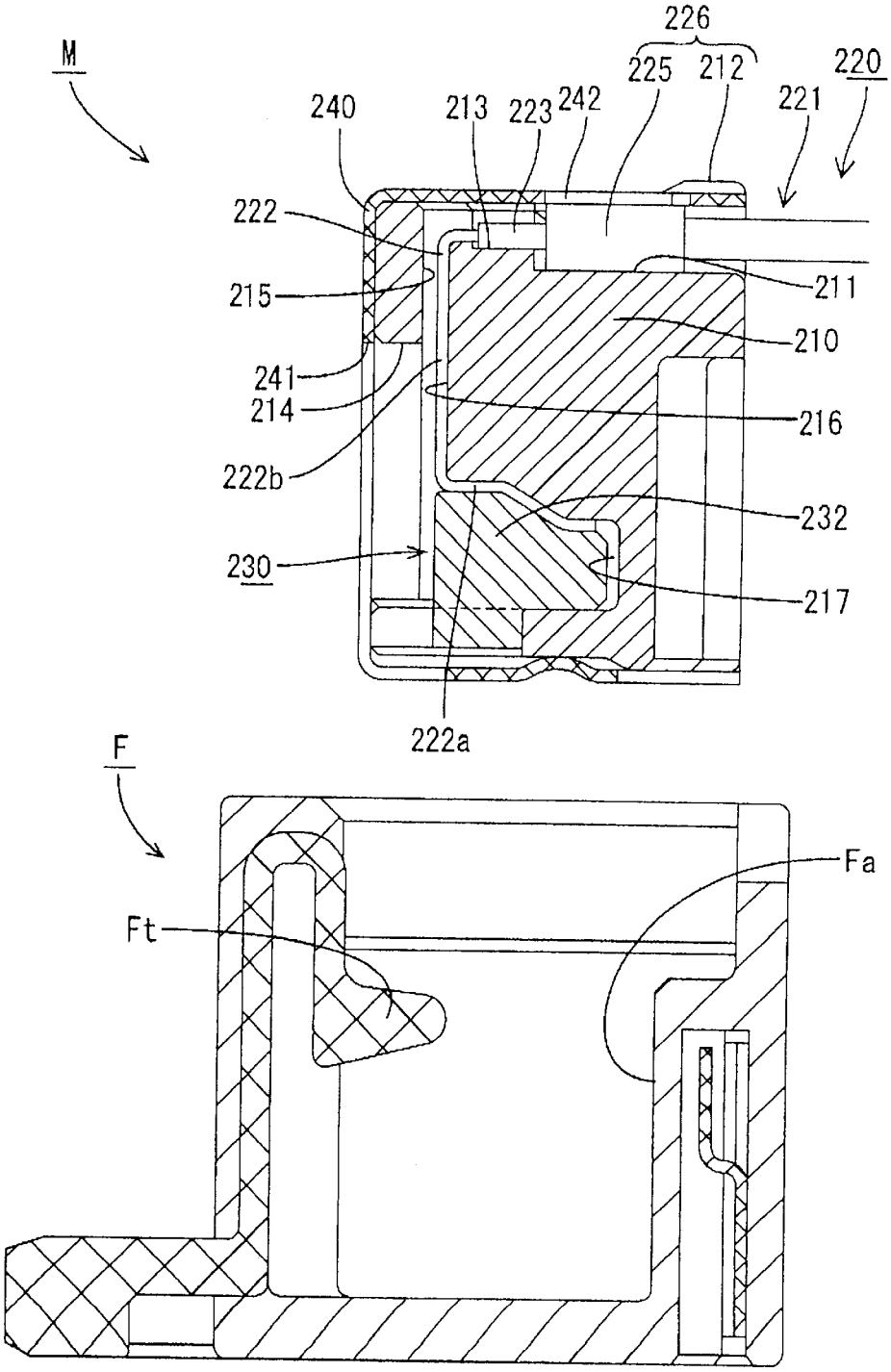
FIG. 44 is a vertical sectional view showing a state in which a connector of the fourth embodiment is removed from a mating connector.
Figure 45:
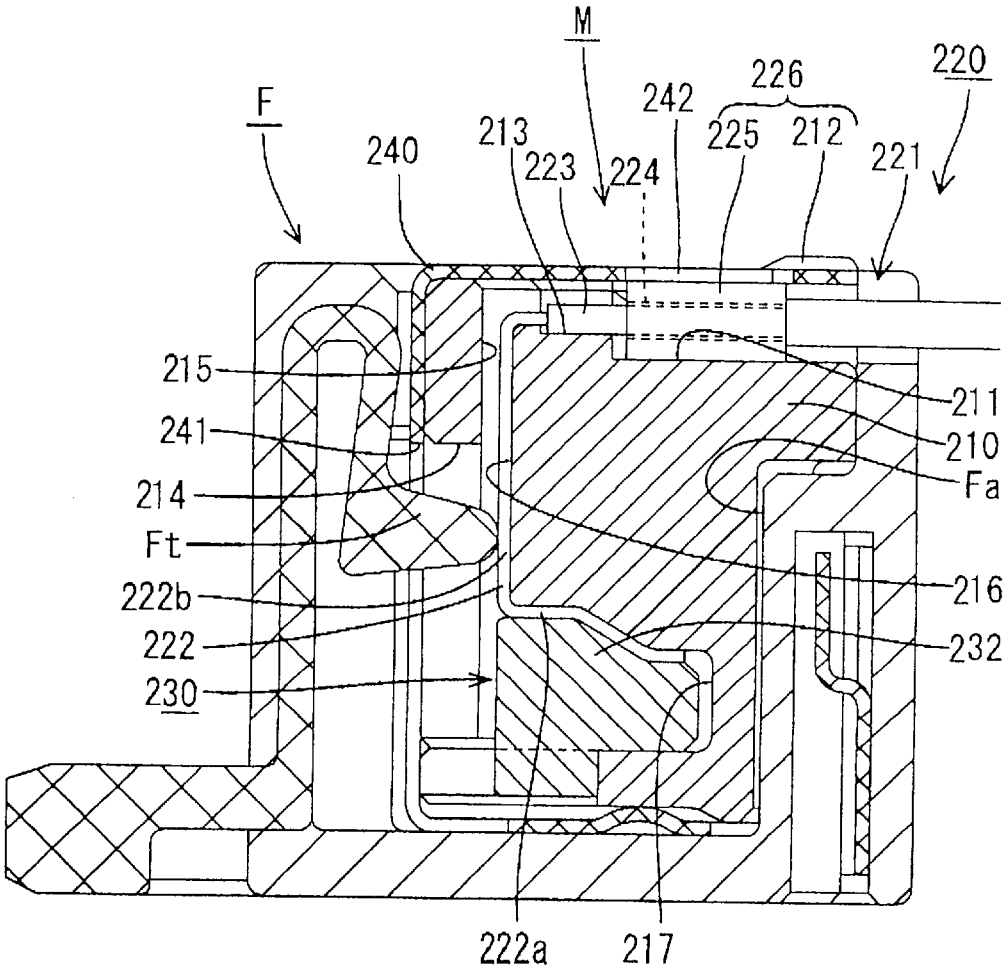
FIG. 45 is a vertical sectional view showing a state in which the connector of the fourth embodiment is fitted on the mating connector.
Figure 46:
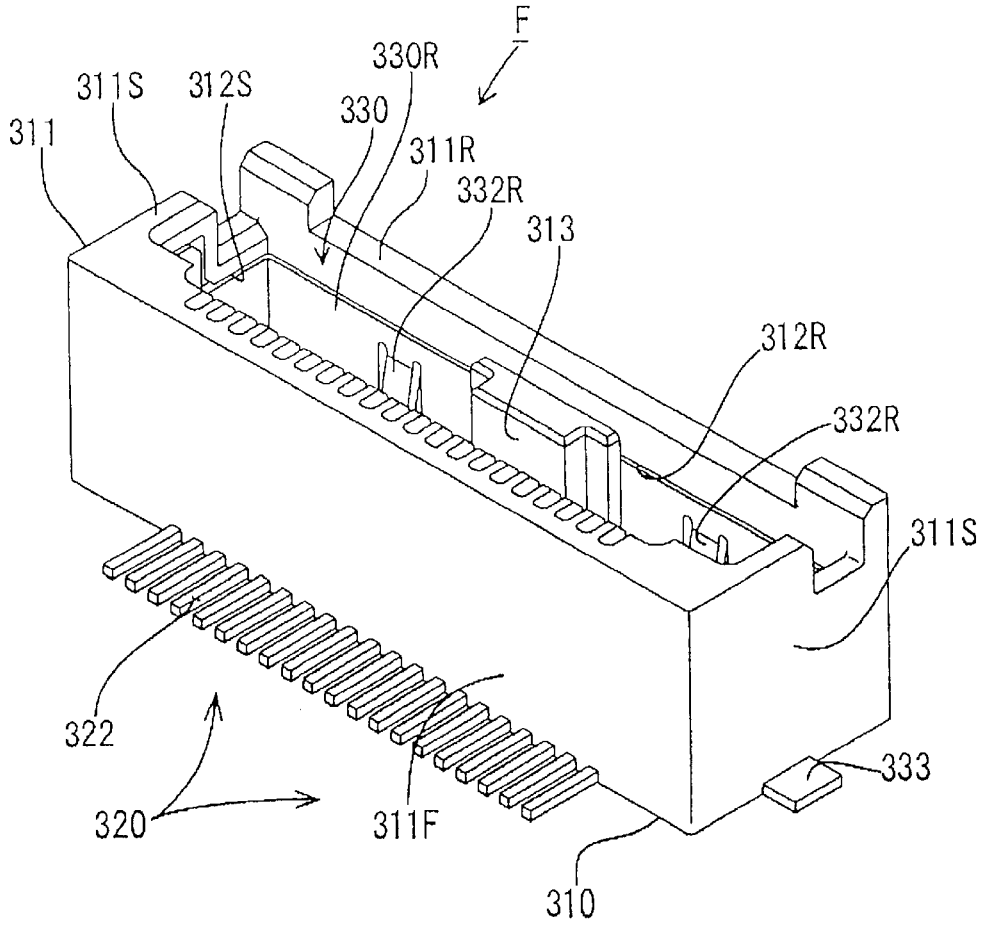
FIG. 46 is a perspective view showing a shielded connector of a fifth embodiment.
Figure 47:
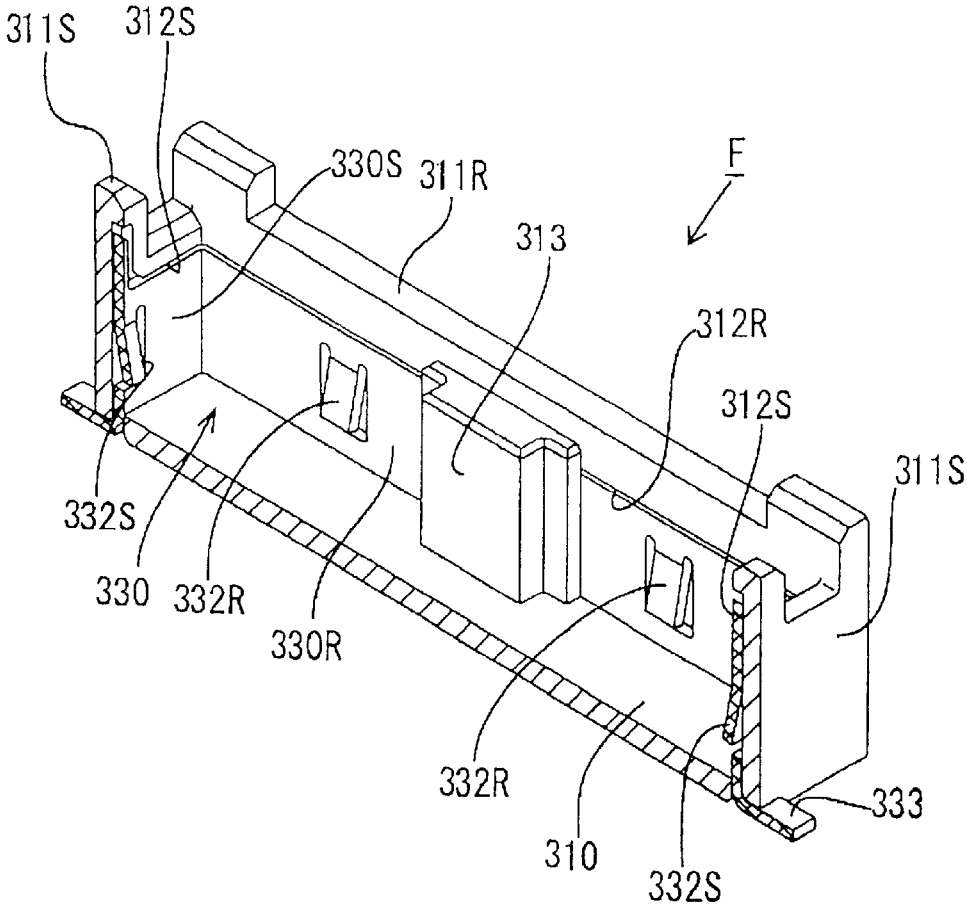
FIG. 47 is a partly cut-out perspective view showing the shielded connector of the fifth embodiment.
Figure 48:
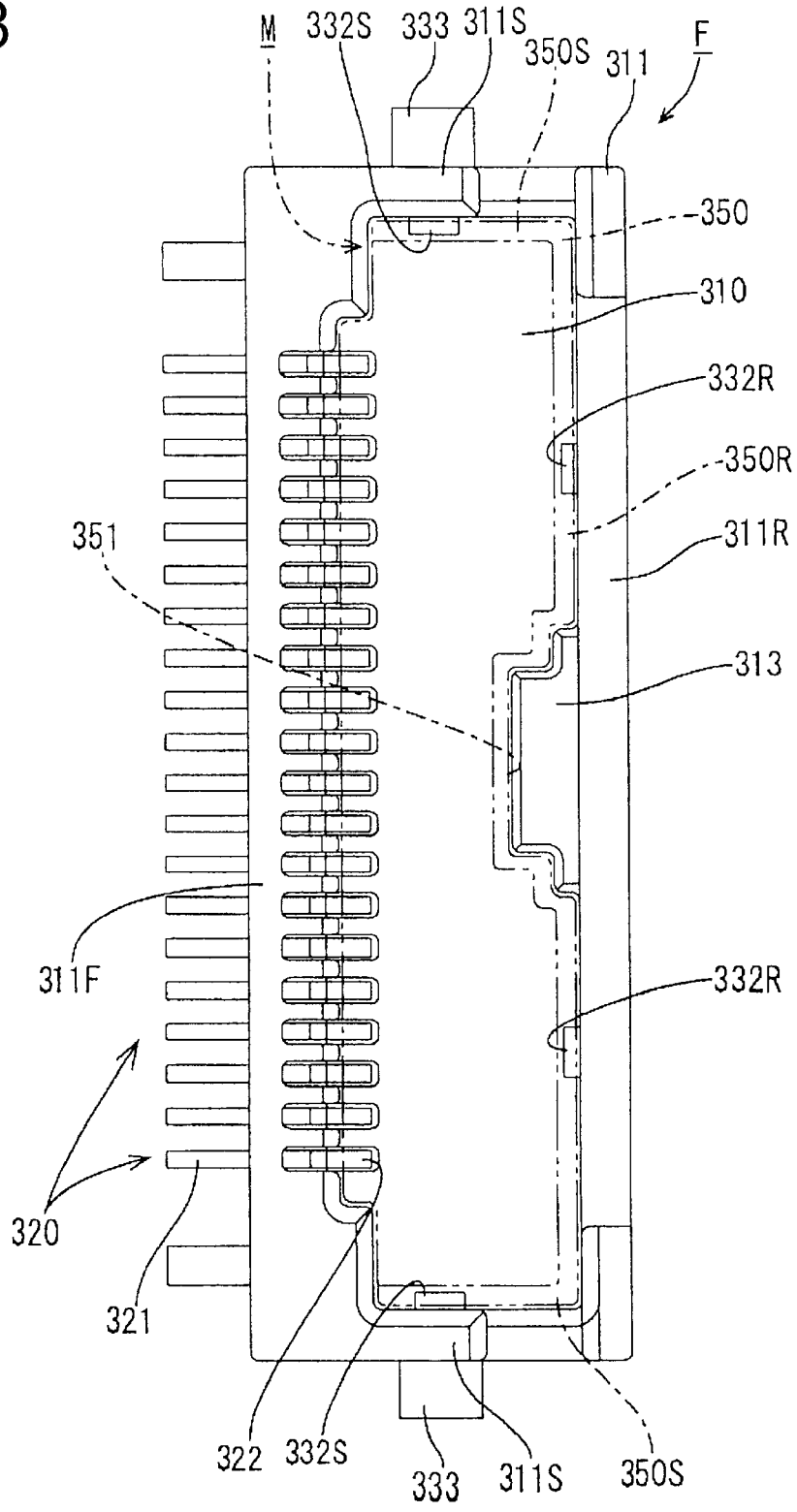
FIG. 48 is a plan view showing the shielded connector of the fifth embodiment.
Figure 49:
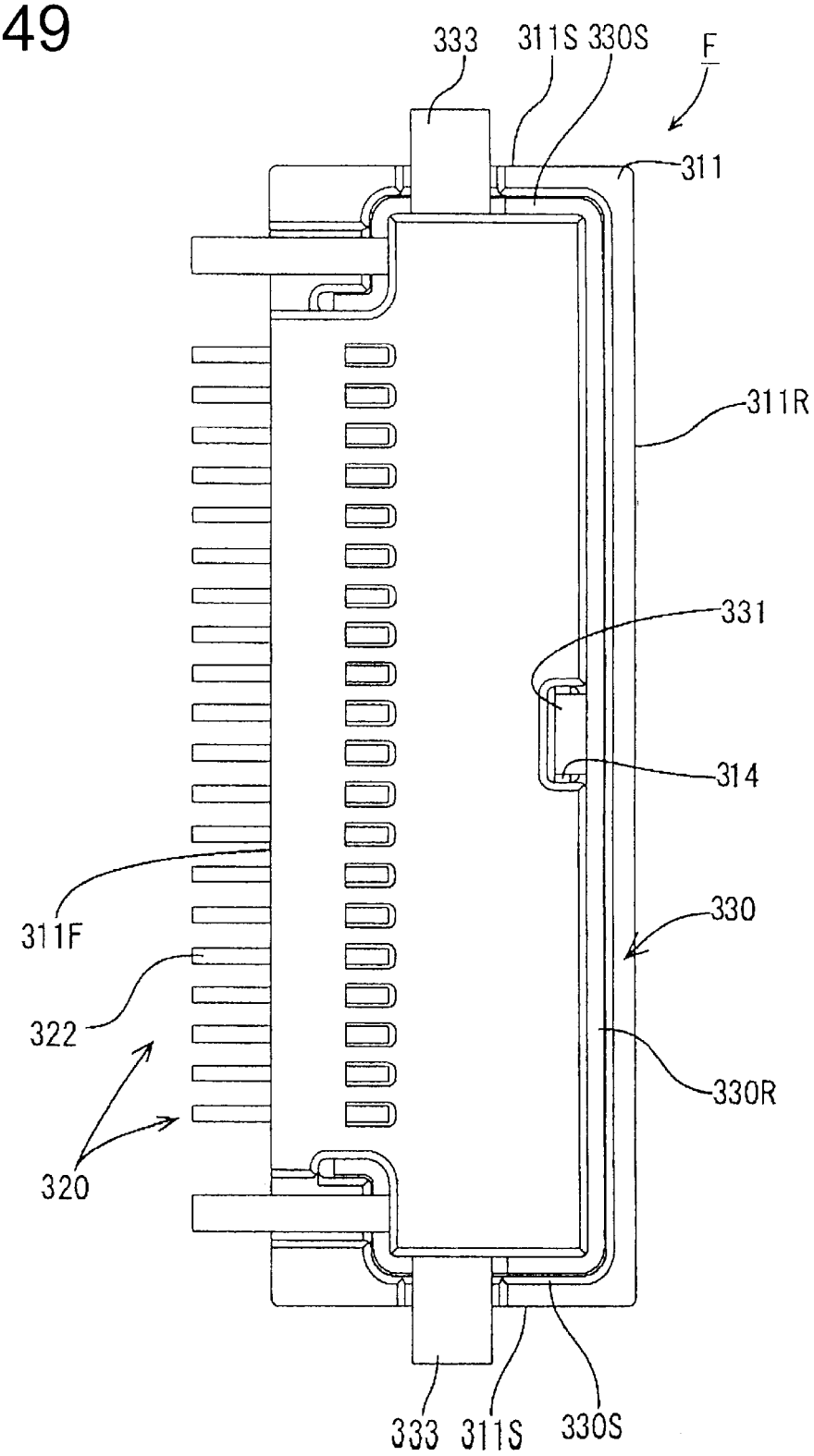
FIG. 49 is a bottom view showing the shielded connector of the fifth embodiment.
Figure 50:
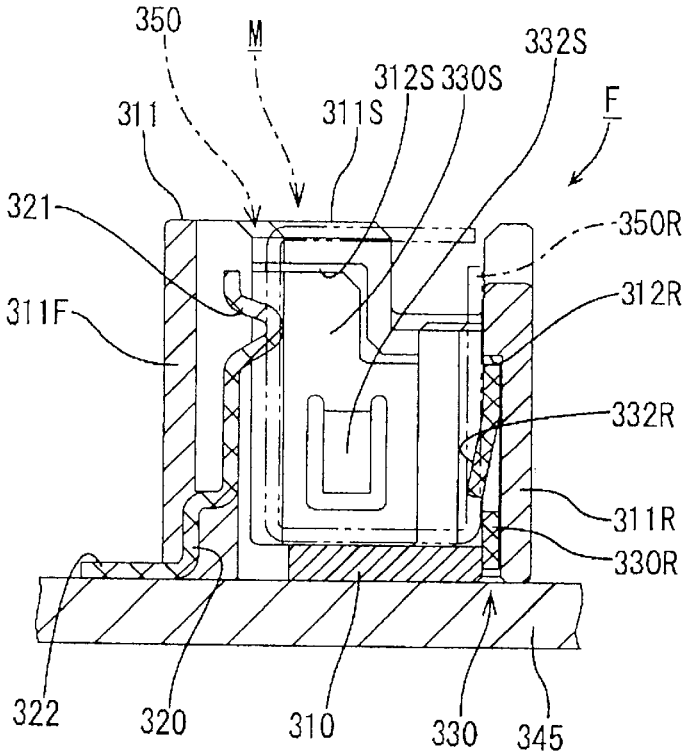
FIG. 50 is a vertical sectional view showing the shielded connector of the fifth embodiment.
Figure 51:
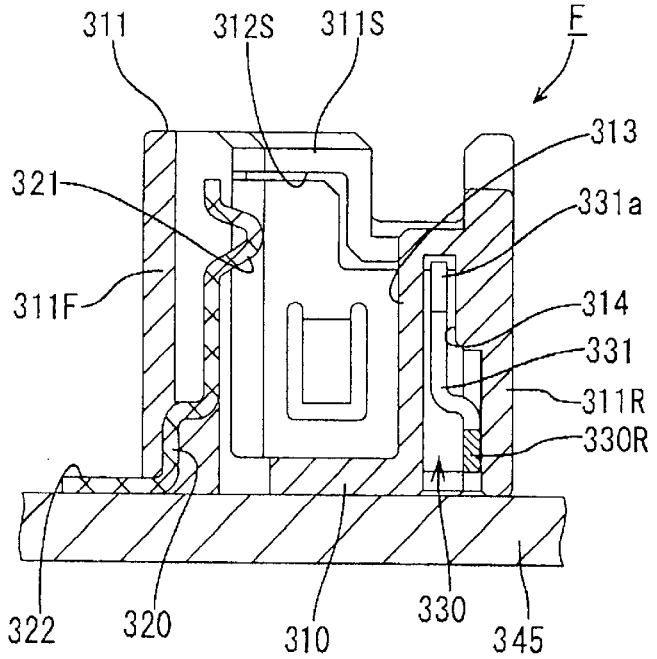
FIG. 51 is a vertical sectional view showing the shielded connector of the fifth embodiment.
Figure 52:
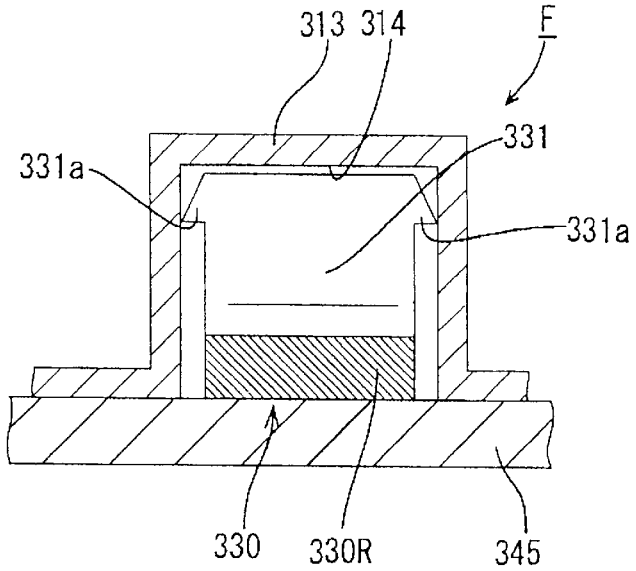
FIG. 52 is a sectional view showing a slip-off prevention construction of a locking piece of the fifth embodiment.
Figure 53:
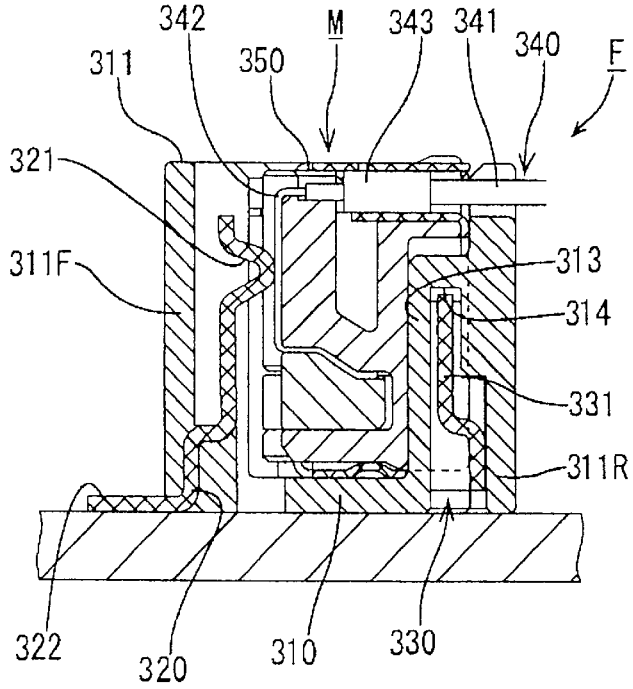
FIG. 53 is a vertical sectional view showing a state in which a plug-side housing has fitted on the shielded connector of the fifth embodiment.
Figure 54:
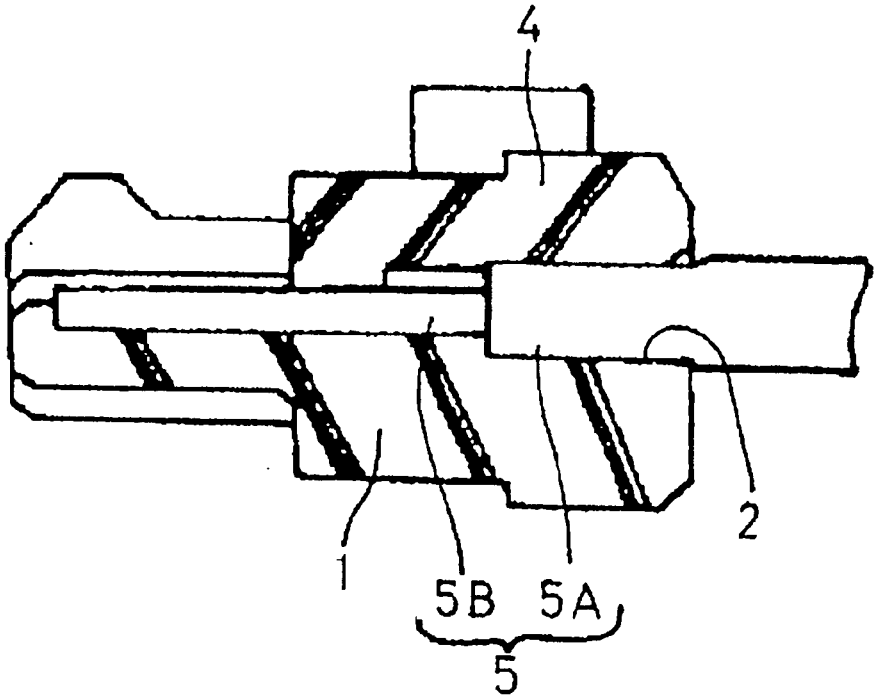
FIG. 54 (PRIOR ART)
FIG. 54 is a side sectional view showing a conventional connector.
Figure 55:
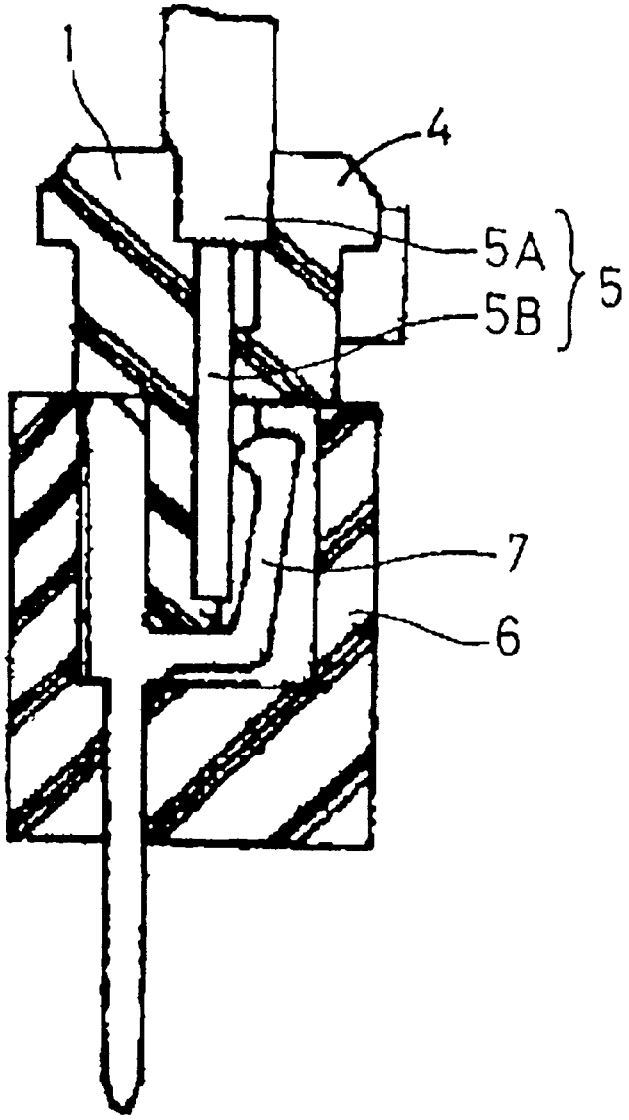
FIG. 55 (PRIOR ART)
FIG. 55 is a side sectional view showing a state in which the conventional connector has fitted on a mating housing.

A third embodiment of the invention is described below with reference to FIGS. 37 through 39, and includes a front shielding shell 180 and a retainer 181 that are mounted on a housing 182. The constructions of most the parts of the third embodiment are similar to those of the second embodiment. Thus only the constructions that are different from those of the second embodiment are described below. The constructions of the third embodiment similar to those of the second embodiment are designated by the reference numerals and symbols of the second embodiment, and description thereof is omitted herein.

The front shielding shell 180 has, a retainer-holding press-fit projection 183 that projects forward from each of a pair of the rear plates 155. The shielding shell 180 can hold a retainer 181 by pressing the retainer-holding press-fit projections 183 into mounting holes 185 formed on the rear surfaces of each of a pair of arms 184 (see FIGS. 37 and 38). A locking projection 186 is formed on the outer surface of each of the arms 184 of the retainer 181. As shown in FIG. 39, similarly to the second embodiment, the core 114 of the flat cable 110 can be locked by the locking projections 186 to the notches 134 respectively formed on a rear portion of both side walls of the retainer-mounting opening 131 of a housing 182.

The retainer 181 of the third embodiment can be held by the shielding shell 180, and the shielding shell 180 and the retainer 181 can be mounted on the housing 182 at a time and at a site where the shielding shell 180 and the retainer 181 are mounted on the housing 182. Therefore, assembly is easy.

A fourth embodiment of the invention is described below with reference to FIGS. 40 through 45. A connector M of the fourth embodiment has a shielding function, and includes a housing 210 made of an insulating synthetic resinous material. The connector M also includes a flat cable 220 having a plurality of shielded electric wires 221, a retainer 230, and a shielding shell 240.

The housing 210 is die-shaped. An accommodation cavity 211, which is rectangular in a plan view, is formed on an upper surface of the housing 210. The rear end of the accommodation cavity 211 is open toward the rear end surface. Two elastic locking pieces 212 are formed at right and left ends of an open portion of the accommodation cavity 211. Covering holding grooves 213 are formed on the upper surface of the housing 210 in a right-to-left direction and are continuous with the front end of the accommodation cavity 211. Vertically long and narrow communication grooves 214 are open on the front surface of the housing 210, such that the pitch between the adjacent communication grooves 214 is equal to the pitch between the covering holding grooves 213. Each communication groove 214 is formed in a region located at about ⅓ from the upper end of the housing 210 and extends to the lower end thereof.

Core holding openings 215 are formed inside the housing 210 such that the upper ends of the core holding openings 215 communicate individually with the front ends of the covering holding grooves 213, and such that the lower ends of the core holding openings 215 communicate individually with the upper ends of the communication grooves 214. A core holding groove 216 extends linearly from the lower end core holding opening 215 and is formed along a rear surface of the communication groove 214. A slit-shaped cavity 217 is formed below the core holding groove 216, and is continuous with a region of about ½ of the lower side of each communication groove 214. The core holding opening 215, the core holding groove 216, and the slit-shaped cavity 217 have equal widths. The left side surfaces of the core holding openings 215, the core holding grooves 216, and the slit-shaped cavities 217 are continuous and flush with each other. The right side surfaces of the core holding openings 215, the core holding grooves 216, and the slit-shaped cavities 217 are also continuous and flush with each other.

The flat cable 220 includes a plurality of the shielded electric wires 221 arranged in the right-to-left direction. Each shielded electric wire 221 has a conductive core 222, an insulating resin cover 223 mounted on the periphery of the core 222, and a tubular shielding layer 224 mounted on the periphery of the cover 223. A short-circuit member 225 is fixed near the end of the flat cable 220 and contacts the shielding layers 224 of the shielded electric wires 221 closely and holds the shielded electric wires 221 at predetermined pitches. The short-circuit member 225 and the elastic locking piece 212 constitute a cover-holding means 226 of the present invention. Cores 222 are exposed by removing the cover 223 from the front end of the flat cable 220 forward from the short-circuiting member 225.

The retainer 230 is made of an insulating synthetic resin and is mounted on the housing 210 in a direction from the front side of the housing 210 toward its rear side. Arms 231 at the right and left ends of the retainer 230 are fitted on a mounting portion 218 of the housing 210 at the right and left side surfaces thereof. Thus the retainer 230 is held in a mounted state. Plate-shaped pressing portions 232 are formed on the retainer 230 and can be fitted through the respective communication grooves 214 and into the slit-shaped cavity 217. The thickness of each pressing portion 232 is equal to the width of the slit-shaped cavity 217. When the retainer 230 is mounted on the housing 210, the upper and rear surfaces of each pressing portion 32 are disposed so that a gap having a dimension equal to or slightly less than the outer diameter of the core 222 is formed between the upper surface of the pressing portion 232 and that of the slit-shaped cavity 217 and between the rear surface of the pressing portion 232 and that of the slit-shaped cavity 217.

The shielding shell 240 is box-shaped and covers the front surface, the upper surface, the lower surface, and the right and left side surfaces of the housing. A notch 241 for exposing the communication groove 214 to the outside is formed on the front wall of the shielding shell 240. An elastic contact piece 242 is formed on the upper surface of the shielding shell 240 for pressing down the short-circuit member 225 in the accommodation cavity 211.

The lower side of the connector M of the fourth embodiment can be fitted into a fit-on cavity Fa of a mating connector F. Mating terminals Ft are arranged on the inner surface of the fit-on cavity Fa at the same pitch as the shielded electric wires 221. With the connector M fitted on the fit-on cavity Fa, the mating terminals Ft advance individually into the respective communication grooves 214, and thus elastically contact the cores 222 fitted individually in the core holding grooves 216 from the front side of the cores 222 toward the rear side thereof.

The flat cable 220 initially is mounted on the housing 210 on which the shielding shell 230 and the retainer 230 have not been mounted. The respective cores 222 of the flat cable 220 are inserted into the core holding openings 215 from the upper side of the core holding openings 215 toward the lower side thereof. A front portion or lower end 222*a* of the core 222 is penetrated into the core holding opening 215, the core holding groove 216 in conformity to the configuration thereof, and the slit-shaped cavity 217 in conformity to the configuration thereof. In this state, the flat cable 220 is thrown down rearward, the cores 222 are bent at the respective upper ends of the core holding openings 215, the front-side portion 222*a* of the core wire 222 is fitted in the covering holding groove 213, the short-circuit member 225 is fitted in the accommodation cavity 211, and the elastic locking piece 212 of the housing 210 is locked to the rear end of the upper surface of the short-circuit member 225. Thus, the flat cable 220 is prevented from moving in the front-to-back and right-to-left directions. Further the elastic locking piece 212 prevents the flat cable 220 from moving up. In this manner, the mounting operation of the cores 222 on the housing 210 is completed. Thereafter the retainer 230 is mounted on the housing 210 from the front side toward the rear side, and each pressing portion 232 is fitted into the slit-shaped cavity 217. At this time, the pressing portion 232 presses the front-side portion 222*a* of the respective core 222 disposed below the core holding groove 216 to the rear, thus forcing the front-side of the core wire 222 into the slit-shaped cavity 217. When the mounting of the retainer 230 on the housing 210 is completed, the front-side portion 222*a* of each core 222 is pressed into the corresponding slit-shaped cavity 217 and is sandwiched between the upper surface of the pressing portion 232 and that of the slit-shaped cavity 217. Thus the front-side 222*a* of each core 222 is prevented from moving in the longitudinal front-to-back direction of the core 222 and its vertical direction. The front 222*a* of the core 222 also is sandwiched between the right and left side surfaces of the slit-shaped cavity 217. Thus the front-side 222*a* of each core 222 is prevented from moving in the right-to-left direction. In this state, a portion 222*b* of the core 222 at the side of the core wire-holding opening 215 is fitted in the core wire-holding groove 216 and is exposed to the front side of the housing 210 through the communication groove 214 for connection with the mating terminal Ft.

After the retainer 230 is mounted on the housing 210 in this manner, the shielding shell 240 is mounted on the housing 210. The elastic contact piece 242 of the retainer 230 is mounted on the housing 210 and contacts the short-circuit member 225 elastically in a direction from the upper side thereof toward the lower side thereof. This contact enables the shielding layer 224 of the shielded electric wire 221 and the shielding shell 240 to be electrically conductive to each other. The elastic force of the elastic contact piece 242 achieves a high contact pressure between the elastic contact piece 242 and the short-circuit member 225. Further the elastic pressing operation of the elastic contact piece 242 prevents the short-circuit member 225 from moving up.

As described above, in the fourth embodiment, the core wires 222 of the shielded electric wires 221 are inserted into the core wire-holding openings 215 individually. Thus even if the resin housing 210 deforms, the cores 222 do not slip off from the core holding openings 215, but remain inserted through the core holding opening 215 and held along a predetermined path.

The shielded electric wire 221 is wired, with a wiring path for the covers 223 held by the cover-holding means 226 perpendicularly continuous with a wiring path for each of the cores 222 held individually by the core holding opening 215 and with the shielded electric wires 221 bent in the shape of a letter "L" by means of the cover-holding means 226 and the core holding opening 215. Thus it is possible to prevent the shielded electric wires 221 from slipping out of place in the axial direction.

The connection portion that is connected to the mating terminal Ft is stretched tight between the bent portion of the upper end of the core wire-holding opening 215 and the retainer 230 and thus is prevented from moving. Accordingly, the connection between the connection portion and the mating terminal Ft can be reliably accomplished.

The short-circuiting member 225 serves as the means for short-circuiting the shielding layers 224 to each other and also has the function of the cover-holding means 226. Therefore a fewer components parts are used than in the case where the cover-holding means 226 is provided separately from the short-circuiting member 225.

A fifth embodiment of the invention will be described below with reference to FIGS. 46 through 53.

A shielded connector F of the fifth embodiment serves as a means for connecting a flat cable 340 to a circuit substrate 345. The shielded connector F fits with a plug-side housing M that holds an end of the flat cable 340. The flat cable 340 has parallel shielded electric wires 341 arranged to extend from an upper surface of the plug-side housing M to a front surface thereof. More particularly, cores 342 of the wires 341 are wired vertically and are arranged parallel with one another in a right-to-left direction on the front surface of the plug-side housing M. A box-shaped plug-side shielding shell 350 is mounted on the plug-side housing M and corresponds to upper and lower surfaces, front and rear surfaces, and right and left surfaces of the plug-side housing M. The plug-side shielding shell 350 is connected to a shielding layer (not shown) of the shielded electric wire 341 through a short-circuiting member 343. The plug-side shielding shell 350 is connected to a receptacle-side shielding shell 330 at right and left side walls 350S and a rear wall 350R thereof. An erroneous fit-on prevention cavity 351 is formed on the rear surface of the plug-side housing M and is fitted on an erroneous fit-on prevention projection 313 of the receptacle-side housing 310. The flat cable 340 is connected to the circuit substrate 345 by fitting the plug-side housing M on the receptacle-side housing 310.

The shielded connector F includes the receptacle-side housing 310, a plurality of terminal fittings 320, and the receptacle-side shielding shell 330.

The receptacle-side housing 310 is made of a synthetic resin and has a fit-on tubular portion 311 with an upper surface. The receptacle-side housing 310 is fixed to an upper surface of the circuit substrate 345. Parallel terminal fittings 320 are mounted on the receptacle-side housing 310 and are arranged at regular pitches in the right-to-left direction along a front wall 311F of the fit-on tubular portion 11. Each terminal fitting 320 has a connection piece 322 that projects forwardly and horizontally from the lower end of the front wall 311F and is connected to a contact (not shown) of the circuit substrate 345. An elastic contact piece 321 is disposed along the inner surface of the front wall 311F and is connected to the core 342 of the shielded electric wire 341 of the plug-side housing M.

Shallow accommodation cavities 312S and 312R are formed on right and left side walls 311S and a rear wall 311R of the fit-on cylindrical portion 311 respectively by hollowing the inner surface of the right and left side walls 311S and the rear wall 311R. The depth of each of the accommodation cavities 312S and 312R is equal to that of the receptacle-side shielding shell 330. The accommodation cavities 312S and 312R are open on the lower surface of the receptacle-side housing 310. The receptacle-side shielding shell 330 is accommodated inside the accommodation cavities 312S and 312R. The erroneous fit-on prevention projection 313 projects in from the center of the rear wall 311R of the fit-on tubular portion 311 in the right-to-left direction of the fit-on tubular portion 311. A locking space 314 is open on the lower surface of the receptacle-side housing 310 and is formed inside the erroneous fit-on prevention projection 313.

Right and left side walls 330S extend forward and perpendicular from the right and left side ends of a rear wall 330R of the receptacle-side shielding shell 330. A slip-off prevention locking piece 331 is formed on the rear wall 330R for insertion into the locking space 314, such that the slip-off prevention locking piece 331 projects toward the inner side of the fit-on tubular portion 311. An elastic connection piece 332S is formed on each of the right and left side walls 330S by partly cutting and raising the right and left side walls 330S. An elastic connection piece 332R is formed on the rear wall 330R by cutting and raising the rear wall 330R at positions right and left with respect to the locking piece 331. A substrate connection portion 333 is formed on each of the right and left side walls 330S and extends outwardly and horizontally from the lower end thereof.

The receptacle-side shielding shell 330 is mounted on the receptacle-side housing 310 from below by fitting the right and left side walls 330S and the rear wall 330R into the accommodation concavities 312S and 312R respectively and fitting the locking piece 331 into the locking space 314. In the mounted state, the receptacle-side shielding shell 330 is held to the receptacle-side housing 310 by engaging a slip-off prevention projection 331*a* disposed at the right and left ends of the locking piece 331 with an inner wall of the locking space 314 in such a manner that the slip-off prevention projection 331*a* cuts into the inner wall of the locking space 314. In the mounted state, the elastic connection pieces 332S and 332R wait for connection with the core 342 of the plug-side housing M, with the elastic connection pieces 332S and 332R disposed inward from the inner surface of the fit-on tubular portion 311 and projecting obliquely down. The substrate connection portion 333 is connected to a grounding circuit (not shown) of the circuit substrate 345.

The plug-side housing M can be in the fit-on tubular portion 311 of the receptacle-side housing 310 from above. Thus, the cores 342 on the front surface of the receptacle-side housing 310 are connected to the elastic contact pieces 321 of the terminal fittings 320, and the right and left side walls 350S of the plug-side shielding shell 350 and the rear wall 350R thereof are connected elastically to the elastic connection pieces 332S and 332R of the receptacle-side shielding shell 330 respectively. Thus, the shielded electric wires 341 of the flat cable 340 are connected to the circuit substrate 345 through the terminal fittings 320, and the shielding layer (not shown) of the flat cable 340 is connected to the plug-side shielding shell 350 through the receptacle-side shielding shell 330.

As described above, the receptacle-side shielding shell 330 corresponds to the rear surface of the plug-side housing M as well as the right and left side surfaces thereof. Thus improved shielding effect can be obtained. The portions of connection between the receptacle-side shielding shell 330 and the plug-side shielding shell 350 are formed on the right and left side surfaces thereof and on the rear surface thereof. Thus a larger number of connection portions are formed the receptacle-side shielding shell 330 and the plug-side shielding shell 350 than a case where the connection portions are formed on only the right and left side surfaces thereof. Accordingly, improvement shielding can be achieved.

The receptacle-side shielding shell 330 is accommodated in the accommodation concavities 312S and 312R formed by hollowing the peripheral wall of the fit-on cylindrical portion 311. Thus, it is possible to thin the portion where the peripheral wall of the fit-on cylindrical portion 311 and the receptacle-side shielding shell 330 overlap each other.

The receptacle-side shielding shell 330 has the slip-off prevention locking piece 331 projecting inward from the rear wall 330R. Thus it is possible to prevent the receptacle-side housing 310 from becoming large. The erroneous fit-on prevention projection 313 has the locking space 314 with which the locking piece 331 engages and the erroneous fit-on prevention concavity 351 formed on the plug-side housing M prevent the plug-side housing M from fitting on the receptacle-side housing 310 with the plug-side housing M disposed in a wrong direction.

The invention is not limited to the embodiments described above with reference to the drawings. For example, the following embodiments are included in the technical scope of the present invention. Further, various modifications can be made without departing from the spirit and scope of the present invention.

The electric wire is disposed in the shape of a letter "L" by the cover-holding means and the core holding opening.

However the path for the electric wire may have other shapes such as a letter "I", "U", "S", and the like.

A connector with a shielding function has been described. However, the invention may be applicable to a connector with no shielding function.

The short-circuiting member serves as the cover-holding means in certain embodiments. However, the short-circuiting member and the cover-holding means may be separate.

The core holding means prevents the core inserted into the core holding groove from moving freely in certain embodiments. However, the width of the core holding groove may be slightly less than the outer diameter of the core wire to prevent the free movement of the core by the friction between the core and the core holding groove.

The plug-side shielding shell and the receptacle-side shielding shell contact each other directly in certain embodiments. However, the plug-side shielding shell and the receptacle-side shielding shell may be conductive to each other through the fixing plate or the grounding member.

The grounding member and the receptacle-side shielding shell are integral with each other. However, the grounding member and the receptacle-side shielding shell may be separate.

The receptacle-side terminal fitting is provided outside the tubular fit-on portion. However, the receptacle-side terminal fitting may be inside the tubular fit-on portion.

The connection means for connecting the plug-side shielding shell and the receptacle-side shielding shell to each other is formed on only the plug-side shielding shell. However, the connection may be provided on both the plug-side shielding shell and the receptacle-side shielding shell or on only the receptacle-side shielding shell.

The slip-off prevention locking piece is formed on the rear surface of the receptacle-side shielding shell. However, the locking piece may be formed on the right and left side surfaces of the receptacle-side shielding shell.

Two connection portions are provided on the rear surface of the receptacle-side shielding shell in certain embodiment. However, other numbers of the connection portions may be provided.

The receptacle-side shielding shell corresponds to only the right and left side surfaces of the plug-side housing and the rear surface thereof in certain embodiments. However, the receptacle-side shielding shell may correspond to the other surfaces of the plug-side housing as well.

The receptacle-side shielding shell is formed along the inner periphery of the fit-on tubular portion. However, the receptacle-side shielding shell may be formed along the periphery of the fit-on tubular portion, and the connection portion may connect to the plug-side shielding shell by penetrating the connection portion through the fit-on tubular portion from the outside to the inside.

The accommodation cavity is formed on the inner peripheral surface of the fit-on tubular portion. However, the accommodation cavity may be formed on the peripheral surface of the fit-on tubular portion.

What is claimed is:

1. A connector comprising:

a housing made of synthetic resin;

a flat cable having a plurality of shielded electric wires with cores, covers disposed over the cores and shielding layers formed on the covers, the covers and the shielding layers being removed at ends of the electric wires to expose the cores;

a cover-disposing portion on an outer surface of said housing for receiving portions of said electric wires with said covers thereon;

a plurality of parallel core holding grooves on said outer surface of said housing, each of said core wire-holding grooves having a depth larger than an outer diameter of each of said wires, a short-circuiting member fixed to said flat cable to short-circuit said shielding layers of said shielded electric wires to each other, said short-circuiting member holding said covers on said cover-disposing portion;

a fixing means for fixing said short-circuiting member to said housing; and wherein said cores are disposed individually along said core holding grooves.

2. The connector of claim 1, wherein a wiring path on said cover-disposing portion is perpendicularly and continuous with a wiring path for said cores held by said core holding grooves.

3. The connector of claim 1, wherein a core holding means holds said cores inside said core holding grooves such that said cores are prevented from freely moving; and mating terminals being insertable into said core holding grooves for connection to said cores individually.

4. A connector for a flat cable, said flat cable having an end, parallel electric wires extending from the end, each said electric wire having a core and a cover, said covers being removed adjacent said end to expose said cores, said connector comprising:

a housing;

a cover holding member for retaining said covered portions of said electric wires to said housing; and a core holding member mounted on said housing and retaining said cores by sandwiching each of said cores between said housing and said core holding member, wherein said core holding member is mounted on said housing such that said core holding member can be shifted between a temporary locking position where said cores can be inserted between said core holding member and said housing and a main locking position where said core holding member retains said cores between said core holding member and said housing.

5. The connector of claim 4, further comprising a shielding shell covering said housing and connected to a shielding layer of each of said electric wires; said shielding shell and said core holding member being mounted on said housing, such that said shielding shell holds said core holding member.

6. A connector for a flat cable, said flat cable having an end, parallel electric wires extending from the end, each said electric wire having a core, a cover and shielding layer, said covers and said shielding layers being removed adjacent said end to expose said cores, said connector comprising; and a short-circuiting member is fixed to said flat cable for short-circuiting the shielding layers of said electric wires to one another;

a housing;

a cover holding member for retaining portions of said electric wires with said covers to said housing, said cover holding member comprises a locking piece formed integrally with said housing and locked to said short-circuiting member;

a core holding member mounted on said housing and retaining said cores by sandwiching each of said cores between said housing and said core holding member;

a shielding shell covering said housing and connected to the shielding layer of each of said electric wires, the shielding shell and the core holding member being mounted on said housing such that said shielding shell holds said core holding member.

7. A shielded connector for connecting a flat cable to a circuit substrate, said flat cable having a plurality of parallel shielded electric wires, said flat cable being mounted on a front surface of a plug-side housing, said plug-side housing having an outer surface covered with a plug-side shielding shell, said connector comprising:

a receptacle-side housing mounted on said circuit substrate and being configured to mate with said plug-side housing;

a plurality of terminal fittings arranged parallel with one another on a front surface of said receptacle-side housing and being connected to said circuit substrate, said terminal fittings being disposed for mating with said shielded electric wires when said plug-side housing is mated with said receptacle-side housing; and a receptacle-side shielding shell on said receptacle-side housing and connected to said circuit substrate and to said plug-side shielding shell when said plug-side housing is mated with said receptacle-side housing, wherein said receptacle-side shielding shell has right and left side walls and a rear wall corresponding to right and left side walls and a rear wall of said plug-side housing respectively and has a connection portion formed on each of said right and left side walls and said rear wall thereof and configured for connection to said plug-side shielding shell, and wherein a fit-on tubular portion for accommodating said plug-side housing therein is formed on said receptacle-side shielding shell; and an accommodation cavity formed by hollowing a peripheral wall of said fit-on tubular portion accommodates said receptacle-side shielding shell.

8. The shielded connector of claim 7, wherein said receptacle-side shielding shell has a slip-off prevention locking piece projecting inward therefrom; and said receptacle-side housing has an erroneous fit-on prevention projection projecting inward from an inner surface of said fit-on tubular portion and a locking space formed therein; and said receptacle-side shielding shell is placed in a slip-off prevention state by accommodating said locking piece in said locking space and by engaging said locking piece with an inner wall of said locking space.

* * * * *